US008794941B2

(12) United States Patent
Santos et al.

(10) Patent No.: US 8,794,941 B2
(45) Date of Patent: Aug. 5, 2014

(54) COMPRESSOR WITH LIQUID INJECTION COOLING

(75) Inventors: Pedro Santos, Cambridge, MA (US); Jeremy Pitts, Boston, MA (US); Andrew Nelson, Somerville, MA (US); Johannes Santen, Far Hills, NJ (US); John Walton, Boston, MA (US); Mitchell Westwood, Boston, MA (US); Harrison O'Hanley, Ipswich, MA (US)

(73) Assignee: Oscomp Systems Inc., Houston, TX (US)

( * ) Notice: Subject to any disclaimer, the term of this patent is extended or adjusted under 35 U.S.C. 154(b) by 402 days.

(21) Appl. No.: 13/220,528

(22) Filed: Aug. 29, 2011

(65) Prior Publication Data

US 2012/0051958 A1 Mar. 1, 2012

Related U.S. Application Data

(60) Provisional application No. 61/378,297, filed on Aug. 30, 2010, provisional application No. 61/485,006, filed on May 11, 2011.

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 18/356*** | (2006.01) |
| ***F04C 29/02*** | (2006.01) |
| ***F01C 21/08*** | (2006.01) |
| ***F04C 29/04*** | (2006.01) |
| *F04C 29/12* | (2006.01) |

(52) U.S. Cl.

CPC ..... *F04C 18/356* (2013.01); *F04C 29/026* (2013.01); *F04C 18/3564* (2013.01); *F01C 21/0836* (2013.01); *F01C 21/0845* (2013.01); *F04C 29/12* (2013.01); *F04C 2210/24* (2013.01); *F04C 29/042* (2013.01)

USPC ..... 418/63; 418/97; 418/151; 418/270

(58) Field of Classification Search

CPC .. F04C 23/008; F04C 18/356; F04C 18/3564; F04C 27/009; F04C 29/0021; F04C 29/026; F04C 29/042; F04C 29/12; F01C 21/0845; F01C 21/0836

USPC ..... 418/60, 63, 97, 104, 151, 270

See application file for complete search history.

(56) References Cited

U.S. PATENT DOCUMENTS

| | | | | |
|---|---|---|---|---|
| 2,324,434 | A * | 7/1943 | Shore | 418/97 |
| 2,800,274 | A | 7/1957 | Makaroff et al. | |

(Continued)

FOREIGN PATENT DOCUMENTS

| | | |
|---|---|---|
| CH | 223597 | 9/1942 |
| DE | 74152 C | 2/1893 |

(Continued)

OTHER PUBLICATIONS

Brown, Royce N., RNB Engineering, Houston, Texas, "Compressors: Selection and Sizing", Gulf Professional Publishing, 3rd Edition, 2005 Elsevier Inc.

(Continued)

*Primary Examiner* — Theresa Trieu

(74) *Attorney, Agent, or Firm* — Pillsbury Winthrop Shaw Pittman LLP

(57) ABSTRACT

A positive displacement compressor designed for near isothermal compression. A rotor includes a curved sealing portion that coincides with a in an interior rotor casing wall. Liquid injectors provide cooling liquid. A gate moves within the compression chamber to either make contact with or be proximate to the rotor as it turns. Gate positioning systems position the gate in this manner, taking into account the shape of the rotor. Outlet valves allow for expulsion of liquids and compressed gas. The unique geometry and relationship between the parts provides for efficiencies and higher pressures not previously found in existing compressor designs.

19 Claims, 31 Drawing Sheets

(56) References Cited

U.S. PATENT DOCUMENTS 3,795,117 A * 3/1974 Moody et al. ..... 62/197
3,820,350 A 6/1974 Brandin et al.
3,820,923 A 6/1974 Zweifel
3,850,554 A 11/1974 Zimmern
3,934,967 A 1/1976 Gannaway
3,936,239 A 2/1976 Shaw
3,936,249 A 2/1976 Sato
3,939,907 A 2/1976 Skvarenina
3,941,521 A 3/1976 Weatherston
3,941,522 A 3/1976 Acord
3,945,220 A 3/1976 Kosfeld
3,945,464 A 3/1976 Sato
3,947,551 A 3/1976 Parrish
3,954,088 A 5/1976 Scott
3,976,404 A 8/1976 Dennison
3,981,627 A 9/1976 Kantor
3,981,703 A 9/1976 Glanvall et al.
3,988,080 A 10/1976 Takada
3,988,081 A 10/1976 Goloff et al.
3,994,638 A 11/1976 Garland et al.
3,995,431 A 12/1976 Schwartzman
3,998,243 A 12/1976 Osterkorn et al.
4,005,949 A 2/1977 Grant
4,012,180 A 3/1977 Berkowitz et al.
4,012,183 A 3/1977 Calabretta
4,018,548 A 4/1977 Berkowitz
4,021,166 A 5/1977 Glanvall et al.
4,022,553 A 5/1977 Poole et al.
4,025,244 A 5/1977 Sato
4,028,016 A 6/1977 Keijer
4,028,021 A 6/1977 Berkowitz
4,032,269 A 6/1977 Sheth
4,032,270 A 6/1977 Sheth et al.
4,033,708 A 7/1977 Weatherston
4,035,114 A 7/1977 Sato
RE29,378 E 8/1977 Bloom
4,048,867 A 9/1977 Saari
4,050,855 A 9/1977 Sakamaki et al.
4,057,367 A 11/1977 Moe et al.
4,058,361 A 11/1977 Giurlando et al.
4,058,988 A 11/1977 Shaw
4,060,342 A 11/1977 Riffe et al.
4,060,343 A 11/1977 Newton
4,061,446 A 12/1977 Sakamaki et al.
4,068,981 A 1/1978 Mandy
4,071,306 A 1/1978 Calabretta
4,072,452 A 2/1978 Sheth
4,076,259 A 2/1978 Raimondi
4,076,469 A 2/1978 Weatherston
4,086,040 A 4/1978 Shibuya et al.
4,086,041 A 4/1978 Takada
4,086,042 A 4/1978 Young
RE29,627 E 5/1978 Weatherston
4,086,880 A 5/1978 Bates
4,099,405 A 7/1978 Hauk et al.
4,099,896 A 7/1978 Glanvall
4,104,010 A 8/1978 Shibuya
4,105,375 A 8/1978 Schindelhauer
4,112,881 A 9/1978 Townsend
4,118,157 A 10/1978 Mayer
4,118,158 A 10/1978 Osaki
4,127,369 A 11/1978 Eiermann et al.
4,132,512 A 1/1979 Roberts
4,135,864 A 1/1979 Lassota
4,135,865 A 1/1979 Takada
4,137,018 A 1/1979 Brucken
4,137,021 A 1/1979 Lassota
4,137,022 A 1/1979 Lassota
4,144,002 A 3/1979 Shibuya et al.
4,144,005 A 3/1979 Brucken
4,150,926 A 4/1979 Eiermann
4,152,100 A 5/1979 Poole et al.
4,174,195 A 11/1979 Lassota
4,174,931 A 11/1979 Ishizuka
4,179,250 A 12/1979 Patel
4,181,474 A 1/1980 Shaw
4,182,441 A 1/1980 Strong et al.
4,196,594 A 4/1980 Abom
4,198,195 A 4/1980 Sakamaki et al.
4,206,930 A 6/1980 Thrane et al.
4,209,287 A 6/1980 Takada
4,218,199 A 8/1980 Eiermann
4,219,314 A 8/1980 Haggerty
4,222,715 A 9/1980 Ruf
4,224,014 A 9/1980 Glanvall
4,227,755 A 10/1980 Lundberg
4,235,217 A 11/1980 Cox
4,236,875 A 12/1980 Widdowson
4,239,467 A 12/1980 Glanvall
4,242,878 A 1/1981 Brinkerhoff
4,244,680 A 1/1981 Ishizuka et al.
4,248,575 A 2/1981 Watanabe et al.
4,249,384 A 2/1981 Harris
4,251,190 A 2/1981 Brown et al.
4,252,511 A 2/1981 Bowdish
4,253,805 A 3/1981 Steinwart et al.
4,255,100 A 3/1981 Linder
4,274,816 A 6/1981 Kobayashi et al.
4,275,310 A 6/1981 Summers et al.
4,279,578 A 7/1981 Kim et al.
4,295,806 A 10/1981 Tanaka et al.
4,299,547 A 11/1981 Simon
4,302,343 A 11/1981 Carswell et al.
4,306,845 A 12/1981 Gunderson
4,311,025 A 1/1982 Rice
4,312,181 A 1/1982 Clark
4,330,240 A 5/1982 Eslinger
4,331,002 A 5/1982 Ladusaw
4,332,534 A 6/1982 Becker
4,336,686 A 6/1982 Porter
RE30,994 E 7/1982 Shaw
4,340,578 A 7/1982 Erickson
4,342,547 A 8/1982 Yamada et al.
4,345,886 A 8/1982 Nakayama et al.
4,355,963 A 10/1982 Tanaka et al.
4,362,472 A 12/1982 Axelsson
4,362,473 A 12/1982 Zeilon
4,367,625 A 1/1983 Vitale
4,371,311 A 2/1983 Walsh
4,373,356 A 2/1983 Connor
4,373,880 A 2/1983 Tanaka et al.
4,373,881 A 2/1983 Matsushita
4,383,804 A 5/1983 Budzich
4,385,498 A 5/1983 Fawcett et al.
4,385,875 A 5/1983 Kanazawa
4,388,048 A 6/1983 Shaw et al.
4,389,172 A 6/1983 Griffith
4,390,322 A 6/1983 Budzich
4,391,573 A 7/1983 Tanaka et al.
4,395,208 A 7/1983 Maruyama et al.
4,396,361 A 8/1983 Fraser, Jr.
4,396,365 A 8/1983 Hayashi
4,397,618 A 8/1983 Stenzel
4,397,620 A 8/1983 Inagaki et al.
4,402,653 A 9/1983 Maruyama et al.
4,403,929 A 9/1983 Nagasaku et al.
4,408,968 A 10/1983 Inagaki et al.
4,415,320 A 11/1983 Maruyama et al.
4,419,059 A 12/1983 Anderson
4,419,865 A 12/1983 Szymaszek
4,423,710 A 1/1984 Williams
4,427,351 A 1/1984 Sano
4,431,356 A 2/1984 Lassota
4,431,387 A 2/1984 Lassota
4,437,818 A 3/1984 Weatherston
4,439,121 A 3/1984 Shaw
4,441,863 A 4/1984 Hotta et al.
4,445,344 A 5/1984 Ladusaw
4,447,196 A 5/1984 Nagasaku et al.
4,451,220 A 5/1984 Ito et al.
4,452,570 A 6/1984 Fujisaki et al.
4,452,571 A 6/1984 Koda et al.
4,455,825 A 6/1984 Pinto
4,457,671 A 7/1984 Watanabe

(56) References Cited

U.S. PATENT DOCUMENTS 4,457,680 A 7/1984 Paget
4,459,090 A 7/1984 Maruyama et al.
4,459,817 A 7/1984 Inagaki et al.
4,460,309 A 7/1984 Walsh
4,460,319 A 7/1984 Ashikian
4,464,102 A 8/1984 Eiermann
4,470,375 A 9/1984 Showalter
4,472,119 A 9/1984 Roberts
4,472,121 A 9/1984 Tanaka et al.
4,472,122 A 9/1984 Yoshida et al.
4,477,233 A 10/1984 Schaefer
4,478,054 A 10/1984 Shaw et al.
4,478,553 A 10/1984 Leibowitz et al.
4,479,763 A 10/1984 Sakamaki et al.
4,484,873 A 11/1984 Inagaki et al.
4,486,158 A 12/1984 Maruyama et al.
4,487,029 A 12/1984 Hidaka et al.
4,487,561 A 12/1984 Eiermann
4,487,562 A 12/1984 Inagaki et al.
4,487,563 A 12/1984 Mori et al.
4,490,100 A 12/1984 Okazaki
4,494,386 A 1/1985 Edwards et al.
4,497,185 A 2/1985 Shaw
4,502,284 A 3/1985 Chrisoghilos
4,502,850 A 3/1985 Inagaki et al.
4,505,653 A 3/1985 Roberts
4,507,064 A 3/1985 Kocher et al.
4,508,491 A 4/1985 Schaefer
4,508,495 A 4/1985 Monden et al.
4,509,906 A 4/1985 Hattori et al.
4,512,728 A 4/1985 Nakano et al.
4,514,156 A 4/1985 Sakamaki et al.
4,514,157 A 4/1985 Nakamura et al.
4,515,513 A 5/1985 Hayase et al.
4,516,914 A 5/1985 Murphy et al.
4,518,330 A 5/1985 Asami et al.
4,519,748 A 5/1985 Murphy et al.
4,521,167 A 6/1985 Cavalleri et al.
4,524,599 A 6/1985 Bailey
4,531,899 A 7/1985 Sudbeck et al.
4,536,130 A 8/1985 Orlando et al.
4,536,141 A 8/1985 Maruyama
4,537,567 A * 8/1985 Kawaguchi et al. ..... 418/63
4,543,046 A 9/1985 Hasegawa
4,543,047 A 9/1985 Hasegawa
4,544,337 A 10/1985 Maruyama
4,544,338 A 10/1985 Takebayashi et al.
4,545,742 A 10/1985 Schaefer
4,548,549 A 10/1985 Murphy et al.
4,548,558 A 10/1985 Sakamaki et al.
4,553,903 A 11/1985 Ashikian
4,553,912 A 11/1985 Lassota
4,557,677 A 12/1985 Hasegawa
4,558,993 A 12/1985 Hori et al.
4,560,329 A 12/1985 Hirahara et al.
4,560,332 A 12/1985 Yokoyama et al.
4,561,829 A 12/1985 Iwata et al.
4,561,835 A 12/1985 Sakamaki et al.
4,564,344 A 1/1986 Sakamaki et al.
4,565,181 A 1/1986 August
4,565,498 A 1/1986 Schmid et al.
4,566,863 A 1/1986 Goto et al.
4,566,869 A 1/1986 Pandeya et al.
4,569,645 A 2/1986 Asami et al.
4,573,879 A 3/1986 Uetuji et al.
4,573,891 A 3/1986 Sakamaki et al.
4,577,472 A 3/1986 Pandeya et al.
4,580,949 A 4/1986 Maruyama et al.
4,580,950 A 4/1986 Sumikawa et al.
4,592,705 A 6/1986 Ueda et al.
4,594,061 A 6/1986 Terauchi
4,594,062 A 6/1986 Sakamaki et al.
4,595,347 A 6/1986 Sakamaki et al.
4,595,348 A 6/1986 Sakamaki et al.
4,598,559 A 7/1986 Tomayko et al.
4,599,059 A 7/1986 Hsu
4,601,643 A 7/1986 Seidel
4,601,644 A 7/1986 Gannaway
4,605,362 A 8/1986 Sturgeon et al.
4,608,002 A 8/1986 Hayase et al.
4,609,329 A 9/1986 Pillis et al.
4,610,602 A 9/1986 Schmid et al.
4,610,612 A 9/1986 Kocher
4,610,613 A 9/1986 Szymaszek
4,614,484 A 9/1986 Riegler
4,616,984 A 10/1986 Inagaki et al.
4,618,317 A 10/1986 Matsuzaki
4,619,112 A 10/1986 Colgate
4,620,837 A 11/1986 Sakamaki et al.
4,621,986 A 11/1986 Sudo
4,623,304 A 11/1986 Chikada et al.
4,624,630 A 11/1986 Hirahara et al.
4,626,180 A 12/1986 Tagawa et al.
4,627,802 A 12/1986 Draaisma et al.
4,629,403 A 12/1986 Wood
4,631,011 A 12/1986 Whitfield
4,636,152 A 1/1987 Kawaguchi et al.
4,636,153 A 1/1987 Ishizuka et al.
4,636,154 A 1/1987 Sugiyama et al.
4,639,198 A 1/1987 Gannaway
4,640,669 A 2/1987 Gannaway
4,645,429 A 2/1987 Asami et al.
4,646,533 A 3/1987 Morita et al.
4,648,815 A 3/1987 Williams
4,648,818 A 3/1987 Sakamaki et al.
4,648,819 A 3/1987 Sakamaki et al.
4,657,493 A 4/1987 Sakamaki et al.
4,664,608 A 5/1987 Adams et al.
4,674,960 A 6/1987 Rando et al.
4,676,067 A 6/1987 Pinto
4,676,726 A 6/1987 Kawaguchi et al.
4,684,330 A 8/1987 Andersson et al.
4,701,110 A 10/1987 Iijima
4,704,069 A 11/1987 Kocher et al.
4,704,073 A 11/1987 Nomura et al.
4,704,076 A 11/1987 Kawaguchi et al.
4,706,353 A 11/1987 Zgliczynski et al.
4,708,598 A 11/1987 Sugita et al.
4,708,599 A 11/1987 Suzuki
4,710,111 A 12/1987 Kubo
4,711,617 A 12/1987 Asami et al.
4,712,986 A 12/1987 Nissen
4,715,435 A 12/1987 Foret
4,715,800 A 12/1987 Nishizawa et al.
4,716,347 A 12/1987 Fujimoto
4,717,316 A 1/1988 Muramatsu et al.
4,720,899 A 1/1988 Ando et al.
D294,361 S 2/1988 Williams
4,725,210 A 2/1988 Suzuki et al.
4,726,739 A 2/1988 Saitou et al.
4,726,740 A 2/1988 Suzuki et al.
4,728,273 A 3/1988 Linder et al.
4,730,996 A 3/1988 Akatsuchi et al.
4,737,088 A 4/1988 Taniguchi et al.
4,739,632 A 4/1988 Fry
4,743,183 A 5/1988 Irie et al.
4,743,184 A 5/1988 Sumikawa et al.
4,746,277 A 5/1988 Glanvall
4,747,276 A 5/1988 Kakinuma
4,758,138 A 7/1988 Timuska
4,759,698 A 7/1988 Nissen
4,762,471 A 8/1988 Asanuma et al.
4,764,095 A 8/1988 Fickelscher
4,764,097 A 8/1988 Hirahara et al.
4,776,074 A 10/1988 Suzuki et al.
4,780,067 A 10/1988 Suzuki et al.
4,781,542 A 11/1988 Ozu et al.
4,781,545 A 11/1988 Yokomizo et al.
4,781,551 A 11/1988 Tanaka
4,782,569 A 11/1988 Wood
4,785,640 A 11/1988 Naruse
4,793,779 A 12/1988 Schabert et al.
4,793,791 A 12/1988 Kokuryo
4,794,752 A 1/1989 Redderson

(56) References Cited

U.S. PATENT DOCUMENTS 4,795,325 A 1/1989 Kishi et al.
4,801,251 A 1/1989 Nakajima et al.
4,815,953 A 3/1989 Iio
4,819,440 A 4/1989 Nakajima et al.
4,822,263 A 4/1989 Nakajima et al.
4,826,408 A 5/1989 Inoue et al.
4,826,409 A 5/1989 Kohayakawa et al.
4,828,463 A 5/1989 Nishizawa et al.
4,828,466 A 5/1989 Kim
4,830,590 A 5/1989 Sumikawa et al.
4,834,627 A 5/1989 Gannaway
4,834,634 A 5/1989 Ono
4,850,830 A 7/1989 Okoma et al.
4,859,154 A 8/1989 Aihara et al.
4,859,162 A 8/1989 Cox
4,859,164 A 8/1989 Shimomura
4,860,704 A 8/1989 Slaughter
4,861,372 A 8/1989 Shimomura
4,867,658 A 9/1989 Sugita et al.
4,877,380 A 10/1989 Glanvall
4,877,384 A 10/1989 Chu
4,881,879 A 11/1989 Ortiz
4,884,956 A 12/1989 Fujitani et al.
4,889,475 A 12/1989 Gannaway et al.
4,895,501 A 1/1990 Bagepalli
4,902,205 A 2/1990 DaCosta et al.
4,904,302 A 2/1990 Shimomura
4,909,716 A 3/1990 Orosz et al.
4,911,624 A 3/1990 Bagepalli
4,915,554 A 4/1990 Serizawa et al.
4,916,914 A 4/1990 Short
4,925,378 A 5/1990 Ushiku et al.
4,929,159 A 5/1990 Hayase et al.
4,929,161 A 5/1990 Aoki et al.
4,932,844 A 6/1990 Glanvall
4,932,851 A 6/1990 Kim
4,934,454 A 6/1990 Vandyke et al.
4,934,656 A 6/1990 Groves et al.
4,934,912 A 6/1990 Iio et al.
4,941,810 A 7/1990 Iio et al.
4,943,216 A 7/1990 Iio
4,943,217 A 7/1990 Nuber
4,944,663 A 7/1990 Iizuka et al.
4,946,362 A 8/1990 Soderlund et al.
4,955,414 A 9/1990 Fujii
4,960,371 A 10/1990 Bassett
4,968,228 A 11/1990 Da Costa et al.
4,968,231 A 11/1990 Zimmern et al.
4,969,832 A 11/1990 Fry
4,971,529 A 11/1990 Gannaway et al.
4,975,031 A 12/1990 Bagepalli et al.
4,978,279 A 12/1990 Rodgers
4,978,287 A 12/1990 Da Costa
4,979,879 A 12/1990 Da Costa
4,983,108 A 1/1991 Kawaguchi et al.
4,990,073 A 2/1991 Kudo et al.
4,993,923 A 2/1991 Daeyaert
4,997,352 A 3/1991 Fujiwara et al.
5,001,924 A 3/1991 Walter et al.
5,004,408 A 4/1991 Da Costa
5,004,410 A 4/1991 Da Costa
5,006,051 A 4/1991 Hattori
5,007,331 A 4/1991 Greiner et al.
5,007,813 A 4/1991 Da Costa
5,009,577 A 4/1991 Hayase et al.
5,009,583 A 4/1991 Carlsson et al.
5,012,896 A 5/1991 Da Costa
5,015,161 A 5/1991 Amin et al.
5,015,164 A 5/1991 Kudou et al.
5,018,948 A 5/1991 Sjte,uml/o/ holm et al.
D317,313 S 6/1991 Yoshida et al.
5,020,975 A 6/1991 Aihara
5,022,146 A 6/1991 Gannaway et al.
5,024,588 A 6/1991 Lassota
5,026,257 A 6/1991 Aihara et al.
5,027,602 A 7/1991 Glen et al.
5,027,606 A 7/1991 Short
5,030,066 A 7/1991 Aihara et al.
5,030,073 A 7/1991 Serizawa et al.
5,035,584 A 7/1991 Akaike et al.
5,037,282 A 8/1991 Englund
5,039,287 A 8/1991 Da Costa
5,039,289 A 8/1991 Eiermann et al.
5,039,900 A 8/1991 Nashiki et al.
5,044,908 A 9/1991 Kawade
5,044,909 A 9/1991 Lindstrom
5,046,932 A 9/1991 Hoffmann
5,049,052 A 9/1991 Aihara
5,050,233 A 9/1991 Hitosugi et al.
5,051,076 A 9/1991 Okoma et al.
5,055,015 A 10/1991 Furukawa
5,055,016 A 10/1991 Kawade
5,062,779 A 11/1991 Da Costa
5,063,750 A 11/1991 Englund
5,067,557 A 11/1991 Nuber et al.
5,067,878 A 11/1991 Da Costa
5,067,884 A 11/1991 Lee
5,069,607 A 12/1991 Da Costa
5,074,761 A 12/1991 Hirooka et al.
5,076,768 A 12/1991 Ruf et al.
5,080,562 A 1/1992 Barrows et al.
5,087,170 A 2/1992 Kousokabe et al.
5,087,172 A 2/1992 Ferri et al.
5,088,892 A 2/1992 Weingold et al.
5,090,879 A 2/1992 Weinbrecht
5,090,882 A 2/1992 Serizawa et al.
5,092,130 A 3/1992 Nagao et al.
5,098,266 A 3/1992 Takimoto et al.
5,102,317 A 4/1992 Okoma et al.
5,104,297 A 4/1992 Sekiguchi et al.
5,108,269 A 4/1992 Glanvall
5,109,764 A 5/1992 Kappel et al.
5,116,208 A 5/1992 Parme
5,120,207 A 6/1992 Soderlund
5,125,804 A 6/1992 Akaike et al.
5,131,826 A 7/1992 Boussicault
5,133,652 A 7/1992 Abe et al.
5,135,368 A 8/1992 Amin et al.
5,135,370 A 8/1992 Iio
5,139,391 A 8/1992 Carrouset
5,144,805 A 9/1992 Nagao et al.
5,144,810 A 9/1992 Nagao et al.
5,151,015 A 9/1992 Bauer et al.
5,151,021 A 9/1992 Fujiwara et al.
5,152,156 A 10/1992 Tokairin
5,154,063 A 10/1992 Nagao et al.
5,169,299 A 12/1992 Gannaway
5,178,514 A 1/1993 Damiral
5,179,839 A 1/1993 Bland
5,184,944 A 2/1993 Scarfone
5,186,956 A 2/1993 Tanino et al.
5,188,524 A 2/1993 Bassine
5,203,679 A 4/1993 Yun et al.
5,203,686 A 4/1993 Scheldorf et al.
5,207,568 A 5/1993 Szymaszek
5,217,681 A 6/1993 Wedellsborg et al.
5,218,762 A 6/1993 Netto Da Costa
5,221,191 A 6/1993 Leyderman et al.
5,222,879 A 6/1993 Kapadia
5,222,884 A 6/1993 Kapadia
5,222,885 A 6/1993 Cooksey
5,226,797 A 7/1993 Da Costa
5,230,616 A 7/1993 Serizawa et al.
5,232,349 A 8/1993 Kimura et al.
5,233,954 A 8/1993 Chomyszak
5,236,318 A 8/1993 Richardson, Jr.
5,239,833 A 8/1993 Fineblum
5,240,386 A 8/1993 Amin et al.
5,242,280 A 9/1993 Fujio
5,244,366 A 9/1993 Delmotte
5,251,456 A 10/1993 Nagao et al.
5,256,042 A 10/1993 McCullough et al.
5,259,740 A 11/1993 Youn
5,264,820 A 11/1993 Kovacich et al.

(56) References Cited

U.S. PATENT DOCUMENTS 5,267,839 A 12/1993 Kimura et al.
5,273,412 A 12/1993 Zwaans
5,284,426 A 2/1994 Strikis et al.
5,293,749 A 3/1994 Nagao et al.
5,293,752 A 3/1994 Nagao et al.
5,302,095 A 4/1994 Richardson, Jr.
5,302,096 A 4/1994 Cavalleri
5,304,033 A 4/1994 Tang
5,304,043 A 4/1994 Shilling
5,306,128 A 4/1994 Lee
5,308,125 A 5/1994 Anderson, Jr.
5,310,326 A 5/1994 Gui et al.
5,311,739 A 5/1994 Clark
5,314,318 A 5/1994 Hata et al.
5,316,455 A 5/1994 Yoshimura et al.
5,322,420 A 6/1994 Yannascoli
5,322,424 A 6/1994 Fujio
5,322,427 A 6/1994 Hsin-Tau
5,328,344 A 7/1994 Sato et al.
5,334,004 A 8/1994 Lefevre et al.
5,336,059 A 8/1994 Rowley
5,337,572 A 8/1994 Longsworth
5,346,376 A 9/1994 Bookbinder et al.
5,348,455 A 9/1994 Herrick et al.
5,352,098 A 10/1994 Hood
5,365,743 A 11/1994 Nagao et al.
5,366,703 A 11/1994 Liechti et al.
5,368,456 A 11/1994 Hirayama et al.
5,370,506 A 12/1994 Fujii et al.
5,370,511 A 12/1994 Strikis et al.
5,372,483 A 12/1994 Kimura et al.
5,374,171 A 12/1994 Cooksey
5,374,172 A 12/1994 Edwards
5,380,165 A 1/1995 Kimura et al.
5,380,168 A 1/1995 Kimura et al.
5,383,773 A 1/1995 Richardson, Jr.
5,383,774 A 1/1995 Toyama et al.
5,385,450 A 1/1995 Kimura et al.
5,385,451 A 1/1995 Fujii et al.
5,385,458 A 1/1995 Chu
5,393,205 A 2/1995 Fujii et al.
5,394,709 A 3/1995 Lorentzen
5,395,326 A 3/1995 Haber et al.
5,397,215 A 3/1995 Spear et al.
5,397,218 A 3/1995 Fujii et al.
5,399,076 A 3/1995 Matsuda et al.
5,411,385 A 5/1995 Eto et al.
5,411,387 A 5/1995 Lundin et al.
5,419,685 A 5/1995 Fujii et al.
5,427,068 A 6/1995 Palmer
5,427,506 A 6/1995 Fry et al.
5,433,179 A 7/1995 Wittry
5,437,251 A 8/1995 Anglim et al.
5,439,358 A 8/1995 Weinbrecht
5,442,923 A 8/1995 Bareiss
5,443,376 A 8/1995 Choi
5,447,033 A 9/1995 Nagao et al.
5,447,422 A 9/1995 Aoki et al.
5,472,327 A 12/1995 Strikis et al.
5,477,688 A 12/1995 Ban et al.
5,479,887 A 1/1996 Chen
5,489,199 A 2/1996 Palmer
5,490,771 A 2/1996 Wehber et al.
5,494,412 A 2/1996 Shin
5,494,423 A 2/1996 Ishiyama et al.
5,499,515 A 3/1996 Kawamura et al.
5,501,579 A 3/1996 Kimura et al.
5,503,539 A 4/1996 Nakajima et al.
5,503,540 A 4/1996 Kim
5,511,389 A 4/1996 Bush et al.
5,518,381 A 5/1996 Matsunaga et al.
5,522,235 A 6/1996 Matsuoka et al.
5,522,356 A 6/1996 Palmer
5,529,469 A 6/1996 Bushnell et al.
5,536,149 A 7/1996 Fujii et al.
5,542,831 A 8/1996 Scarfone
5,542,832 A 8/1996 Sone et al.
5,544,400 A 8/1996 Wells
5,545,021 A 8/1996 Fukuoka et al.
5,556,270 A 9/1996 Komine et al.
5,564,280 A 10/1996 Schilling et al.
5,564,910 A 10/1996 Huh
5,564,916 A 10/1996 Yamamoto et al.
5,564,917 A 10/1996 Leyderman et al.
5,568,796 A 10/1996 Palmer
5,577,903 A 11/1996 Yamamoto
5,580,231 A 12/1996 Yasui
5,582,020 A 12/1996 Scaringe et al.
5,586,443 A 12/1996 Lewis
5,586,876 A 12/1996 Yasnnascoli et al.
5,591,018 A 1/1997 Takeuchi et al.
5,591,023 A 1/1997 Nakamura et al.
5,597,287 A 1/1997 Helmick
5,605,447 A 2/1997 Kim et al.
5,616,017 A 4/1997 Iizuka et al.
5,616,018 A 4/1997 Ma
5,616,019 A 4/1997 Hattori et al.
5,622,149 A 4/1997 Wittry
5,626,463 A 5/1997 Kimura et al.
5,639,208 A 6/1997 Theis
5,640,938 A 6/1997 Craze
5,641,273 A 6/1997 Moseley
5,641,280 A 6/1997 Timuska
5,653,585 A 8/1997 Fresco
5,660,540 A 8/1997 Kang
5,662,463 A 9/1997 Mirzoev et al.
5,664,941 A 9/1997 Bearint
5,667,372 A 9/1997 Hwang et al.
5,672,054 A 9/1997 Cooper et al.
5,674,053 A 10/1997 Paul et al.
5,674,061 A 10/1997 Motegi et al.
5,676,535 A 10/1997 Bushnell
5,678,164 A 10/1997 Berthelemy et al.
5,678,987 A 10/1997 Timuska
5,685,703 A 11/1997 Fukuoka et al.
5,690,475 A 11/1997 Yamada et al.
5,692,887 A 12/1997 Krueger et al.
5,697,763 A 12/1997 Kitchener
5,699,672 A 12/1997 Foerster et al.
5,707,223 A 1/1998 Englund et al.
5,713,732 A 2/1998 Riney
5,727,936 A 3/1998 Eriksson et al.
5,733,112 A 3/1998 Kang
5,738,497 A 4/1998 Hensley
5,758,613 A 6/1998 Edelmayer et al.
5,769,610 A 6/1998 Paul et al.
5,775,882 A 7/1998 Kiyokawa et al.
5,775,883 A 7/1998 Hattori et al.
5,782,618 A 7/1998 Nishikawa et al.
5,788,472 A 8/1998 Lee
5,795,136 A 8/1998 Olsaker et al.
5,800,142 A 9/1998 Motegi et al.
5,820,349 A 10/1998 Caillat
5,820,357 A 10/1998 Itoh
5,823,755 A 10/1998 Wilson et al.
5,829,960 A 11/1998 Dreiman
5,839,270 A 11/1998 Jirnov et al.
5,853,288 A 12/1998 Motegi et al.
5,860,801 A 1/1999 Timuska
5,863,191 A 1/1999 Motegi et al.
5,873,261 A 2/1999 Bae
5,875,744 A 3/1999 Vallejos
5,921,106 A 7/1999 Girault et al.
5,947,710 A 9/1999 Cooper et al.
5,947,711 A 9/1999 Myers et al.
5,950,452 A 9/1999 Sakitani et al.
5,951,269 A 9/1999 Sasa et al.
5,951,273 A 9/1999 Matsunaga et al.
5,957,676 A 9/1999 Peeters
5,961,297 A 10/1999 Haga et al.
5,980,222 A 11/1999 Fry
6,017,186 A 1/2000 Hoeger et al.
6,017,203 A 1/2000 Sugawa et al.
6,027,322 A 2/2000 Ferentinos et al.

(56) References Cited

U.S. PATENT DOCUMENTS 6,032,720 A 3/2000 Riegger et al.
6,039,552 A 3/2000 Mimura
6,045,343 A 4/2000 Liou
6,053,716 A 4/2000 Riegger et al.
6,071,103 A 6/2000 Hirano et al.
6,077,058 A 6/2000 Saitou et al.
6,079,965 A 6/2000 Delmotte
6,086,341 A 7/2000 Fukuhara et al.
6,102,682 A 8/2000 Kim
6,102,683 A 8/2000 Kirsten
6,106,242 A 8/2000 Sung
6,109,901 A 8/2000 Nakamura et al.
6,117,916 A 9/2000 Allam et al.
6,132,195 A 10/2000 Ikoma et al.
6,139,296 A 10/2000 Okajima et al.
6,142,756 A 11/2000 Hashimoto et al.
6,146,774 A 11/2000 Okamoto et al.
6,149,408 A 11/2000 Holt
6,164,263 A 12/2000 Saint-Hilaire et al.
6,164,934 A 12/2000 Niihara et al.
6,176,687 B1 1/2001 Kim et al.
6,195,889 B1 3/2001 Gannaway
6,205,788 B1 3/2001 Warren
6,205,960 B1 3/2001 Vallejos
6,210,130 B1 4/2001 Kakuda et al.
6,213,732 B1 4/2001 Fujio
6,220,825 B1 4/2001 Myers et al.
6,225,706 B1 5/2001 Keller
6,230,503 B1 5/2001 Spletzer
6,233,955 B1 5/2001 Egara
6,241,496 B1 6/2001 Kim et al.
6,250,899 B1 6/2001 Lee et al.
6,261,073 B1 7/2001 Kumazawa
6,270,329 B1 8/2001 Oshima et al.
6,273,694 B1 8/2001 Vading
6,280,168 B1 8/2001 Matsumoto et al.
6,283,728 B1 9/2001 Tomoiu
6,283,737 B1 9/2001 Kazakis et al.
6,287,098 B1 9/2001 Ahn et al.
6,287,100 B1 9/2001 Achtelik et al.
6,290,472 B2 9/2001 Gannaway
6,290,882 B1 9/2001 Maus et al.
6,299,425 B1 10/2001 Hirano et al.
6,302,664 B1 10/2001 Kazakis et al.
6,309,196 B1 10/2001 Jones et al.
6,312,233 B1 11/2001 Ahn et al.
6,312,240 B1 11/2001 Weinbrecht
6,318,981 B1 11/2001 Ebara et al.
6,328,540 B1 12/2001 Kosters et al.
6,328,545 B1 12/2001 Kazakis et al.
6,336,336 B1 1/2002 Kawaminami et al.
6,336,794 B1 1/2002 Kim
6,336,797 B1 1/2002 Kazakis et al.
6,336,799 B1 1/2002 Matsumoto et al.
6,336,800 B1 1/2002 Kim et al.
6,354,262 B2 3/2002 Wade
6,361,306 B1 3/2002 Hinzpeter et al.
6,371,745 B1 4/2002 Bassine
6,379,480 B1 4/2002 Girault et al.
6,398,520 B2 6/2002 Han
6,409,488 B1 6/2002 Ikoma et al.
6,409,490 B1 6/2002 Nemit, Jr. et al.
6,413,061 B1 7/2002 Esumi et al.
6,416,302 B1 7/2002 Achtelik et al.
6,418,927 B1 7/2002 Kullik
6,425,732 B1 7/2002 Rouse et al.
6,428,284 B1 8/2002 Vaisman
6,435,850 B2 8/2002 Sunaga et al.
6,440,105 B1 8/2002 Menne
6,447,268 B1 9/2002 Abramopaulos
6,447,274 B1 9/2002 Horihata et al.
6,461,119 B1 10/2002 Timuska
6,478,560 B1 11/2002 Bowman
6,488,488 B2 12/2002 Achtelik et al.
6,524,086 B2 2/2003 Matsumoto et al.
6,526,751 B1 3/2003 Moeckel
6,533,558 B1 3/2003 Matsumoto et al.
6,547,545 B1 4/2003 Jonsson et al.
6,550,442 B2 4/2003 Garcia
6,557,345 B1 5/2003 Moeckel
6,582,183 B2 6/2003 Eveker et al.
6,589,034 B2 7/2003 Vorwerk et al.
6,592,347 B2 7/2003 Matsumoto et al.
6,595,767 B1 7/2003 Hinzpeter et al.
6,599,113 B1 7/2003 Lee
6,616,428 B2 9/2003 Ebara et al.
6,651,458 B1 11/2003 Ebara et al.
6,658,885 B1 12/2003 Zhou et al.
6,669,450 B2 12/2003 Jeong
6,672,063 B1 1/2004 Proeschel
6,672,263 B2 1/2004 Vallejos
6,676,393 B2 1/2004 Matsumoto et al.
6,685,441 B2 2/2004 Nam
6,692,242 B2 2/2004 Matsumoto et al.
6,716,007 B2 4/2004 Kim et al.
6,722,867 B2 4/2004 Murata
6,732,542 B2 5/2004 Yamasaki et al.
6,733,723 B2 5/2004 Choi et al.
6,745,767 B2 6/2004 Kullik et al.
6,746,223 B2 6/2004 Manole
6,748,754 B2 6/2004 Matsumoto et al.
6,749,405 B2 6/2004 Bassine
6,749,416 B2 6/2004 Arndt et al.
6,751,941 B2 6/2004 Edelman et al.
6,752,605 B2 6/2004 Dreiman et al.
6,764,279 B2 7/2004 Meshenky
6,769,880 B1 8/2004 Hogan et al.
6,769,890 B2 8/2004 Vigano' et al.
6,796,773 B1 9/2004 Choi et al.
6,799,956 B1 10/2004 Yap et al.
6,813,989 B2 11/2004 Santiyanont
6,817,185 B2 11/2004 Coney et al.
6,824,367 B2 11/2004 Matsumoto et al.
6,824,370 B2 11/2004 Takatsu
6,827,564 B2 12/2004 Becker
6,854,442 B2 2/2005 Satapathy et al.
6,858,067 B2 2/2005 Burns et al.
6,860,724 B2 3/2005 Cho et al.
6,877,951 B1 4/2005 Awdalla
6,881,044 B1 4/2005 Thomas, Jr. et al.
6,884,054 B2 4/2005 Shimada
6,892,454 B2 5/2005 Matsumoto et al.
6,892,548 B2 5/2005 Choi et al.
6,896,497 B2 5/2005 Kuo
6,907,746 B2 6/2005 Sato et al.
6,910,872 B2 6/2005 Cho et al.
6,915,651 B2 7/2005 Hille et al.
6,929,455 B2 8/2005 Dreiman et al.
6,931,866 B2 8/2005 Sato et al.
6,932,588 B2 8/2005 Choi et al.
6,935,853 B2 8/2005 Lee et al.
6,962,486 B2 11/2005 Lee et al.
6,974,314 B2 12/2005 Matsumoto et al.
6,983,606 B2 1/2006 Brown
7,008,199 B2 3/2006 Matsumoto et al.
7,011,183 B2 3/2006 Picouet
7,028,476 B2 4/2006 Proeschel
7,029,252 B2 4/2006 Masuda et al.
7,040,880 B2 5/2006 Hasegawa et al.
7,059,842 B2 6/2006 Lee et al.
7,070,395 B2 7/2006 Lee et al.
7,083,689 B2 8/2006 Park
7,101,161 B2 9/2006 Matsumoto et al.
7,104,764 B2 9/2006 Lee et al.
7,128,540 B2 10/2006 Tadano et al.
7,131,821 B2 11/2006 Matumoto et al.
7,134,845 B2 11/2006 Lee et al.
7,140,844 B2 11/2006 Lee et al.
7,144,224 B2 12/2006 Kim et al.
7,150,602 B2 12/2006 Choi et al.
7,150,608 B2 12/2006 Cho et al.
7,153,109 B2 12/2006 Cho et al.
7,168,257 B2 1/2007 Matsumoto et al.
7,172,016 B2 2/2007 Meshenky et al.

(56) References Cited

U.S. PATENT DOCUMENTS

| | | | |
|---|---|---|---|
| 7,174,725 | B2 | 2/2007 | Tadano et al. |
| 7,175,401 | B2 | 2/2007 | Cho et al. |
| 7,186,100 | B2 | 3/2007 | Cho et al. |
| 7,189,068 | B2 | 3/2007 | Thomas, Jr. et al. |
| 7,191,738 | B2 | 3/2007 | Shkolnik |
| 7,192,259 | B2 | 3/2007 | Lee |
| 7,195,451 | B1 | 3/2007 | Awdalla |
| 7,217,110 | B2 | 5/2007 | Dreiman |
| 7,220,108 | B2 | 5/2007 | Cho et al. |
| 7,223,081 | B2 | 5/2007 | Lee et al. |
| 7,223,082 | B2 | 5/2007 | Sato et al. |
| 7,226,275 | B2 | 6/2007 | Lee et al. |
| 7,232,291 | B2 | 6/2007 | Choi et al. |
| 7,241,239 | B2 | 7/2007 | Tanaka |
| 7,252,487 | B2 | 8/2007 | Sato |
| 7,270,521 | B2 | 9/2007 | Sung et al. |
| 7,281,914 | B2 | 10/2007 | Lee |
| 7,284,372 | B2 | 10/2007 | Crow |
| 7,290,994 | B2 | 11/2007 | Kitaichi et al. |
| 7,293,966 | B2 | 11/2007 | Cho et al. |
| 7,293,970 | B2 | 11/2007 | Sato |
| 7,300,259 | B2 | 11/2007 | Cho et al. |
| 7,302,803 | B2 | 12/2007 | Tadano et al. |
| 7,309,217 | B2 | 12/2007 | Cho et al. |
| 7,322,809 | B2 | 1/2008 | Kitaura et al. |
| 7,334,428 | B2 | 2/2008 | Holdsworth |
| 7,344,367 | B2 | 3/2008 | Manole |
| 7,347,676 | B2 | 3/2008 | Kopelowicz |
| 7,354,250 | B2 | 4/2008 | Sung et al. |
| 7,354,251 | B2 | 4/2008 | Cho et al. |
| 7,361,005 | B2 | 4/2008 | Sato |
| 7,363,696 | B2 | 4/2008 | Kimura et al. |
| 7,377,755 | B2 | 5/2008 | Cho |
| 7,377,956 | B2 | 5/2008 | Cheney, Jr. et al. |
| 7,380,446 | B2 | 6/2008 | Baeuerle et al. |
| 7,381,039 | B2 | 6/2008 | Sato |
| 7,381,040 | B2 | 6/2008 | Ogasawara et al. |
| 7,381,356 | B2 | 6/2008 | Shimada et al. |
| 7,390,162 | B2 | 6/2008 | Awdalla |
| 7,399,170 | B2 | 7/2008 | Aya et al. |
| 7,401,475 | B2 | 7/2008 | Hugenroth et al. |
| 7,431,571 | B2 | 10/2008 | Kim et al. |
| 7,435,062 | B2 | 10/2008 | Tadano et al. |
| 7,435,063 | B2 | 10/2008 | Tadano et al. |
| 7,438,540 | B2 | 10/2008 | Sato |
| 7,438,541 | B2 | 10/2008 | Aya et al. |
| 7,458,791 | B2 | 12/2008 | Radziwill |
| 7,462,021 | B2 | 12/2008 | Ebara et al. |
| 7,481,631 | B2 | 1/2009 | Park et al. |
| 7,481,635 | B2 | 1/2009 | Nishikawa et al. |
| 7,488,165 | B2 | 2/2009 | Ogasawara et al. |
| 7,491,042 | B2 | 2/2009 | Matsumoto et al. |
| 7,507,079 | B2 | 3/2009 | Fujisaki |
| 7,510,381 | B2 | 3/2009 | Beckmann et al. |
| 7,520,733 | B2 | 4/2009 | Matumoto et al. |
| 7,524,174 | B2 | 4/2009 | Nishikawa et al. |
| 7,540,727 | B2 | 6/2009 | Byun et al. |
| 7,556,485 | B2 | 7/2009 | Kanayama et al. |
| 7,563,080 | B2 | 7/2009 | Masuda |
| 7,563,085 | B2 | 7/2009 | Sakaniwa et al. |
| 7,566,204 | B2 | 7/2009 | Ogasawara et al. |
| 7,572,116 | B2 | 8/2009 | Nishikawa et al. |
| 7,581,937 | B2 | 9/2009 | Nishikawa et al. |
| 7,581,941 | B2 | 9/2009 | Harada et al. |
| 7,584,613 | B1 | 9/2009 | Crow |
| 7,585,162 | B2 | 9/2009 | Nishikawa et al. |
| 7,585,163 | B2 | 9/2009 | Nishikawa et al. |
| 7,588,427 | B2 | 9/2009 | Bae et al. |
| 7,588,428 | B2 | 9/2009 | Masuda |
| 7,597,547 | B2 | 10/2009 | Ha et al. |
| 7,600,986 | B2 | 10/2009 | Matumoto et al. |
| 7,604,466 | B2 | 10/2009 | Dreiman et al. |
| 7,607,904 | B2 | 10/2009 | Masuda |
| 7,611,341 | B2 | 11/2009 | Byun et al. |
| 7,611,342 | B2 | 11/2009 | Matsumoto et al. |
| 7,611,343 | B2 | 11/2009 | Matsumoto et al. |
| 7,618,242 | B2 | 11/2009 | Higuchi et al. |
| 7,621,729 | B2 | 11/2009 | Matsumoto et al. |
| 7,641,454 | B2 | 1/2010 | Ueda et al. |
| 7,650,871 | B2 | 1/2010 | See |
| 7,658,599 | B2 | 2/2010 | Lee et al. |
| 7,661,940 | B2 | 2/2010 | Maeng |
| 7,665,973 | B2 | 2/2010 | Hwang |
| 7,681,889 | B2 | 3/2010 | Tsuboi et al. |
| 7,690,906 | B2 | 4/2010 | Tado et al. |
| 7,703,433 | B2 | 4/2010 | Webster |
| 7,713,040 | B2 | 5/2010 | Kimura et al. |
| 7,717,686 | B2 | 5/2010 | Kondo et al. |
| 7,722,343 | B2 | 5/2010 | Hirayama |
| 7,726,960 | B2 | 6/2010 | Oui et al. |
| 7,748,968 | B2 | 7/2010 | Morozumi |
| 7,753,663 | B2 | 7/2010 | Shimizu et al. |
| 7,762,792 | B2 | 7/2010 | Tadano et al. |
| 7,768,172 | B2 | 8/2010 | Takahata et al. |
| 7,775,044 | B2 | 8/2010 | Julien et al. |
| 7,775,782 | B2 | 8/2010 | Choi et al. |
| 7,780,426 | B2 | 8/2010 | Cho et al. |
| 7,780,427 | B2 | 8/2010 | Ueda et al. |
| 7,789,641 | B2 | 9/2010 | Masuda |
| 7,793,516 | B2 | 9/2010 | Farrow et al. |
| 7,798,787 | B2 | 9/2010 | Matumoto et al. |
| 7,798,791 | B2 | 9/2010 | Byun et al. |
| 7,802,426 | B2 | 9/2010 | Bollinger |
| 7,802,972 | B2 | 9/2010 | Shimizu et al. |
| 7,806,672 | B2 | 10/2010 | Furusho et al. |
| 7,837,449 | B2 | 11/2010 | Tadano et al. |
| 7,841,838 | B2 | 11/2010 | Kawabe et al. |
| 7,854,602 | B2 | 12/2010 | Bae et al. |
| 7,871,252 | B2 | 1/2011 | Bae et al. |
| 7,874,155 | B2 | 1/2011 | McBride et al. |
| 2011/0023814 | A1 | 2/2011 | Shkolnik et al. |
| 2011/0023977 | A1 * | 2/2011 | Fong et al. ..... 60/408 |

FOREIGN PATENT DOCUMENTS

| | | | |
|---|---|---|---|
| DE | 3611395 | 10/1987 | |
| JP | 61-277889 | 12/1986 | |
| JP | 02140489 A * | 5/1990 | ..... 418/63 |
| JP | 2009-185680 | 8/2009 | |
| SU | 1150401 | 4/1985 | |
| WO | WO 95/18945 | 7/1995 | |
| WO | WO9943926 | 9/1999 | |
| WO | WO 01/20167 | 3/2001 | |
| WO | WO2010017199 | 2/2010 | |

OTHER PUBLICATIONS

Kreith, Frank, "The CRC Handbook of Thermal Engineering", Library of Congress Cataloging-in-Publication Data, 2000 by CRC Press LLC.

Avallone, Eugene A., et al., "Marks' Standard Handbook for Mechanical Engineering", Eleventh Edition, 2007, 1996, 1987, 1978 by the McGraw-Hill Companies, Inc.

"Basic Refrigeration and Air Conditioning", Third Edition, 2005, 1996, 1982, by Tata McGraw-Hill Publishing Company Limited.

Budynas, Richard G. and Nisbett, J. Keith, "Shigley's Mechanical Engineering Design", 8th edition, 2008 by McGraw Hill Higher Education.

Oberg, Erik et al, "Machinery's Handbook", 27th edition, 2004, by Industrial Press Inc, New York, NY.

International Search Report and Written Opinion as issued for International Application No. PCT/US2011/049599, dated Feb. 28, 2013.

International Preliminary Report on Patentability as issued for International Application No. PCT/US2011/049599, dated Mar. 14, 2013.

* cited by examiner

COMPRESSOR WITH LIQUID INJECTION COOLING

This application claims priority to U.S. provisional application Ser. No. 61/378,297, which was filed on Aug. 30, 2010, and U.S. provisional application Ser. No. 61/485,006, which was filed on May 11, 2011.

BACKGROUND

1. Technical Field

The invention generally relates to fluid pumps, such as compressors and expanders. More specifically, preferred embodiments utilize a novel rotary compressor design for compressing air, vapor, or gas for high pressure conditions over 200 psi and power ratings above 10 HP.

2. Related Art

Compressors have typically been used for a variety of applications, such as air compression, vapor compression for refrigeration, and compression of industrial gases. Compressors can be split into two main groups, positive displacement and dynamic. Positive displacement compressors reduce the volume of the compression chamber to increase the pressure of the fluid in the chamber. This is done by applying force to a drive shaft that is driving the compression process. Dynamic compressors work by transferring energy from a moving set of blades to the working fluid.

Positive displacement compressors can take a variety of forms. They are typically classified as reciprocating or rotary compressors. Reciprocating compressors are commonly used in industrial applications where higher pressure ratios are necessary. They can easily be combined into multistage machines, although single stage reciprocating compressors are not typically used at pressures above 80 psig. Reciprocating compressors use a piston to compress the vapor, air, or gas, and have a large number of components to help translate the rotation of the drive shaft into the reciprocating motion used for compression. This can lead to increased cost and reduced reliability. Reciprocating compressors also suffer from high levels of vibration and noise. This technology has been used for many industrial applications such as natural gas compression.

Rotary compressors use a rotating component to perform compression. As noted in the art, rotary compressors typically have the following features in common: (1) they impart energy to the gas being compressed by way of an input shaft moving a single or multiple rotating elements; (2) they perform the compression in an intermittent mode; and (3) they do not use inlet or discharge valves. (Brown, Compressors: Selection and Sizing, 3rd Ed., at 6). As further noted in Brown, rotary compressor designs are generally suitable for designs in which less than 20:1 pressure ratios and 1000 CFM flow rates are desired. For pressure ratios above 20:1, Royce suggests that multistage reciprocating compressors should be used instead.

Typical rotary compressor designs include the rolling piston, screw compressor, scroll compressor, lobe, liquid ring, and rotary vane compressors. Each of these traditional compressors has deficiencies for producing high pressure, near isothermal conditions.

The design of a rotating element/rotor/lobe against a radially moving element/piston to progressively reduce the volume of a fluid has been utilized as early as the mid-19th century with the introduction of the "Yule Rotary Steam Engine." Developments have been made to small-sized compressors utilizing this methodology into refrigeration compression applications. However, current Yule-type designs are limited due to problems with mechanical spring durability (returning the piston element) as well as chatter (insufficient acceleration of the piston in order to maintain contact with the rotor).

For commercial applications, such as compressors for refrigerators, small rolling piston or rotary vane designs are typically used. (P N Ananthanarayanan, Basic Refrigeration and Air Conditioning, 3rd Ed., at 171-72.) In these designs, a closed oil-lubricating system is typically used.

Rolling piston designs typically allow for a significant amount of leakage between an eccentrically mounted circular rotor, the interior wall of the casing, and/or the vane that contacts the rotor. By spinning the rolling piston faster, the leakages are deemed acceptable because the desired pressure and flow rate for the application can be easily reached even with these losses. The benefit of a small self-contained compressor is more important than seeking higher pressure ratios.

Rotary vane designs typically use a single circular rotor mounted eccentrically in a cylinder slightly larger than the rotor. Multiple vanes are positioned in slots in the rotor and are kept in contact with the cylinder as the rotor turns typically by spring or centrifugal force inside the rotor. The design and operation of these type of compressors may be found in Mark's Standard Handbook for Mechanical Engineers, Eleventh Edition, at 14:33-34.

In a sliding-vane compressor design, vanes are mounted inside the rotor to slide against the casing wall. Alternatively, rolling piston designs utilize a vane mounted within the cylinder that slides against the rotor. These designs are limited by the amount of restoring force that can be provided and thus the pressure that can be yielded.

Each of these types of prior art compressors has limits on the maximum pressure differential that it can provide. Typical factors include mechanical stresses and temperature rise. One proposed solution is to use multistaging. In multistaging, multiple compression stages are applied sequentially. Intercooling, or cooling between stages, is used to cool the working fluid down to an acceptable level to be input into the next stage of compression. This is typically done by passing the working fluid through a heat exchanger in thermal communication with a cooler fluid. However, intercooling can result in some condensation of liquid and typically requires filtering out of the liquid elements. Multistaging greatly increases the complexity of the overall compression system and adds costs due to the increased number of components required. Additionally, the increased number of components leads to decreased reliability and the overall size and weight of the system are markedly increased.

For industrial applications, single- and double-acting reciprocating compressors and helical-screw type rotary compressors are most commonly used. Single-acting reciprocating compressors are similar to an automotive type piston with compression occurring on the top side of the piston during each revolution of the crankshaft. These machines can operate with a single-stage discharging between 25 and 125 psig or in two stages, with outputs ranging from 125 to 175 psig or higher. Single-acting reciprocating compressors are rarely seen in sizes above 25 HP. These types of compressors are typically affected by vibration and mechanical stress and require frequent maintenance. They also suffer from low efficiency due to insufficient cooling.

Double-acting reciprocating compressors use both sides of the piston for compression, effectively doubling the machine's capacity for a given cylinder size. They can operate as a single-stage or with multiple stages and are typically sized greater than 10 HP with discharge pressures above 50 psig. Machines of this type with only one or two cylinders require large foundations due to the unbalanced reciprocating forces. Double-acting reciprocating compressors tend to be quite robust and reliable, but are not sufficiently efficient, require frequent valve maintenance, and have extremely high capital costs.

Lubricant-flooded rotary screw compressors operate by forcing fluid between two intermeshing rotors within a housing which has an inlet port at one end and a discharge port at the other. Lubricant is injected into the chamber to lubricate the rotors and bearings, take away the heat of compression, and help to seal the clearances between the two rotors and between the rotors and housing. This style of compressor is reliable with few moving parts. However, it becomes quite inefficient at higher discharge pressures (above approximately 200 psig) due to the intermeshing rotor geometry being forced apart and leakage occurring. In addition, lack of valves and a built-in pressure ratio leads to frequent over or under compression, which translates into significant energy efficiency losses.

Rotary screw compressors are also available without lubricant in the compression chamber, although these types of machines are quite inefficient due to the lack of lubricant helping to seal between the rotors. They are a requirement in some process industries such as food and beverage, semiconductor, and pharmaceuticals, which cannot tolerate any oil in the compressed air used in their processes. Efficiency of dry rotary screw compressors are 15-20% below comparable injected lubricated rotary screw compressors and are typically used for discharge pressures below 150 psig.

Using cooling in a compressor is understood to improve upon the efficiency of the compression process by extracting heat, allowing most of the energy to be transmitted to the gas and compressing with minimal temperature increase. Liquid injection has previously been utilized in other compression applications for cooling purposes. Further, it has been suggested that smaller droplet sizes of the injected liquid may provide additional benefits.

In U.S. Pat. No. 4,497,185, lubricating oil was intercooled and injected through an atomizing nozzle into the inlet of a rotary screw compressor. In a similar fashion, U.S. Pat. No. 3,795,117 uses refrigerant, though not in an atomized fashion, that is injected early in the compression stages of a rotary screw compressor. Rotary vane compressors have also attempted finely atomized liquid injection, as seen in U.S. Pat. No. 3,820,923.

In each example, cooling of the fluid being compressed was desired. Liquid injection in rotary screw compressors is typically done at the inlet and not within the compression chamber. This provides some cooling benefits, but the liquid is given the entire compression cycle to coalesce and reduce its effective heat transfer coefficient. Additionally, these examples use liquids that have lubrication and sealing as a primary benefit. This affects the choice of liquid used and may adversely affect its heat transfer and absorption characteristics. Further, these styles of compressors have limited pressure capabilities and thus are limited in their potential market applications.

Rotary designs for engines are also known, but suffer from deficiencies that would make them unsuitable for an efficient compressor design. The most well-known example of a rotary engine is the Wankel engine. While this engine has been shown to have benefits over conventional engines and has been commercialized with some success, it still suffers from multiple problems, including low reliability and high levels of hydrocarbon emissions.

Published International Pat. App. No. WO 2010/017199 and U.S. Pat. Pub. No. 2011/0023814 relate to a rotary engine design using a rotor, multiple gates to create the chambers necessary for a combustion cycle, and an external cam-drive for the gates. The force from the combustion cycle drives the rotor, which imparts force to an external element. Engines are designed for a temperature increase in the chamber and high temperatures associated with the combustion that occurs within an engine. Increased sealing requirements necessary for an effective compressor design are unnecessary and difficult to achieve. Combustion forces the use of positively contacting seals to achieve near perfect sealing, while leaving wide tolerances for metal expansion, taken up by the seals, in an engine. Further, injection of liquids for cooling would be counterproductive and coalescence is not addressed.

Liquid mist injection has been used in compressors, but with limited effectiveness. In U.S. Pat. No. 5,024,588, a liquid injection mist is described, but improved heat transfer is not addressed. In U.S. Pat. Publication. No. U.S. 2011/0023977, liquid is pumped through atomizing nozzles into a reciprocating piston compressor's compression chamber prior to the start of compression. It is specified that liquid will only be injected through atomizing nozzles in low pressure applications. Liquid present in a reciprocating piston compressor's cylinder causes a high risk for catastrophic failure due to hydrolock, a consequence of the incompressibility of liquids when they build up in clearance volumes in a reciprocating piston, or other positive displacement, compressor. To prevent hydrolock situations, reciprocating piston compressors using liquid injection will typically have to operate at very slow speeds, adversely affecting the performance of the compressor.

The prior art lacks compressor designs in which the application of liquid injection for cooling provides desired results for a near-isothermal application. This is in large part due to the lack of a suitable positive displacement compressor design that can both accommodate a significant amount of liquid in the compression chamber and pass that liquid through the compressor outlet without damage.

BRIEF SUMMARY

The presently preferred embodiments are directed to rotary compressor designs. These designs are particularly suited for high pressure applications, typically above 200 psig with compression ratios typically above for existing high-pressure positive displacement compressors.

One illustrative embodiment of the design includes a non-circular-shaped rotor rotating within a cylindrical casing and mounted concentrically on a drive shaft inserted axially through the cylinder. The rotor is symmetrical along the axis traveling from the drive shaft to the casing with cycloid and constant radius portions. The constant radius portion corresponds to the curvature of the cylindrical casing, thus providing a sealing portion. The changing rate of curvature on the other portions provides for a non-sealing portion. In this illustrative embodiment, the rotor is balanced by way of holes and counterweights.

A gate structured similar to a reciprocating rectangular piston is inserted into and withdrawn from the bottom of the cylinder in a timed manner such that the tip of the piston remains in contact with or sufficiently proximate to the surface of the rotor as it turns. The coordinated movement of the gate and the rotor separates the compression chamber into a low pressure and high pressure region.

As the rotor rotates inside the cylinder, the compression volume is progressively reduced and compression of the fluid occurs. At the same time, the intake side is filled with gas through the inlet. An inlet and exhaust are located to allow fluid to enter and exit the chamber at appropriate times. During the compression process, atomized liquid is injected into the compression chamber in such a way that a high and rapid rate of heat transfer is achieved between the gas being compressed and the injected cooling liquid. This results in near isothermal compression, which enables a much higher efficiency compression process.

The rotary compressor embodiments sufficient to achieve near isothermal compression are capable of achieving high pressure compression at higher efficiencies. It is capable of compressing gas only, a mixture of gas and liquids, or for pumping liquids. As one of ordinary skill in the art would appreciate, the design can also be used as an expander.

The particular rotor and gate designs may also be modified depending on application parameters. For example, different cycloidal and constant radii may be employed. Alternatively, double harmonic or other functions may be used for the variable radius. The gate may be of one or multiple pieces. It may implement a contacting tip-seal, liquid channel, or provide a non-contacting seal by which the gate is proximate to the rotor as it turns.

Several embodiments provide mechanisms for driving the gate external to the main casing. In one embodiment, a spring-backed cam drive system is used. In others, a belt-based system with or without springs may be used. In yet another, a dual cam follower gate positioning system is used. Further, an offset gate guide system may be used. Further still, linear actuator, magnetic drive, and scotch yoke systems may be used.

The presently preferred embodiments provide advantages not found in the prior art. The design is tolerant of liquid in the system, both coming through the inlet and injected for cooling purposes. High compression ratios are achievable due to effective cooling techniques. Lower vibration levels and noise are generated. Valves are used to minimize inefficiencies resulting from over- and under-compression common in existing rotary compressors. Seals are used to allow higher pressures and slower speeds than typical with other rotary compressors. The rotor design allows for balanced, concentric motion, reduced acceleration of the gate, and effective sealing between high pressure and low pressure regions of the compression chamber.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
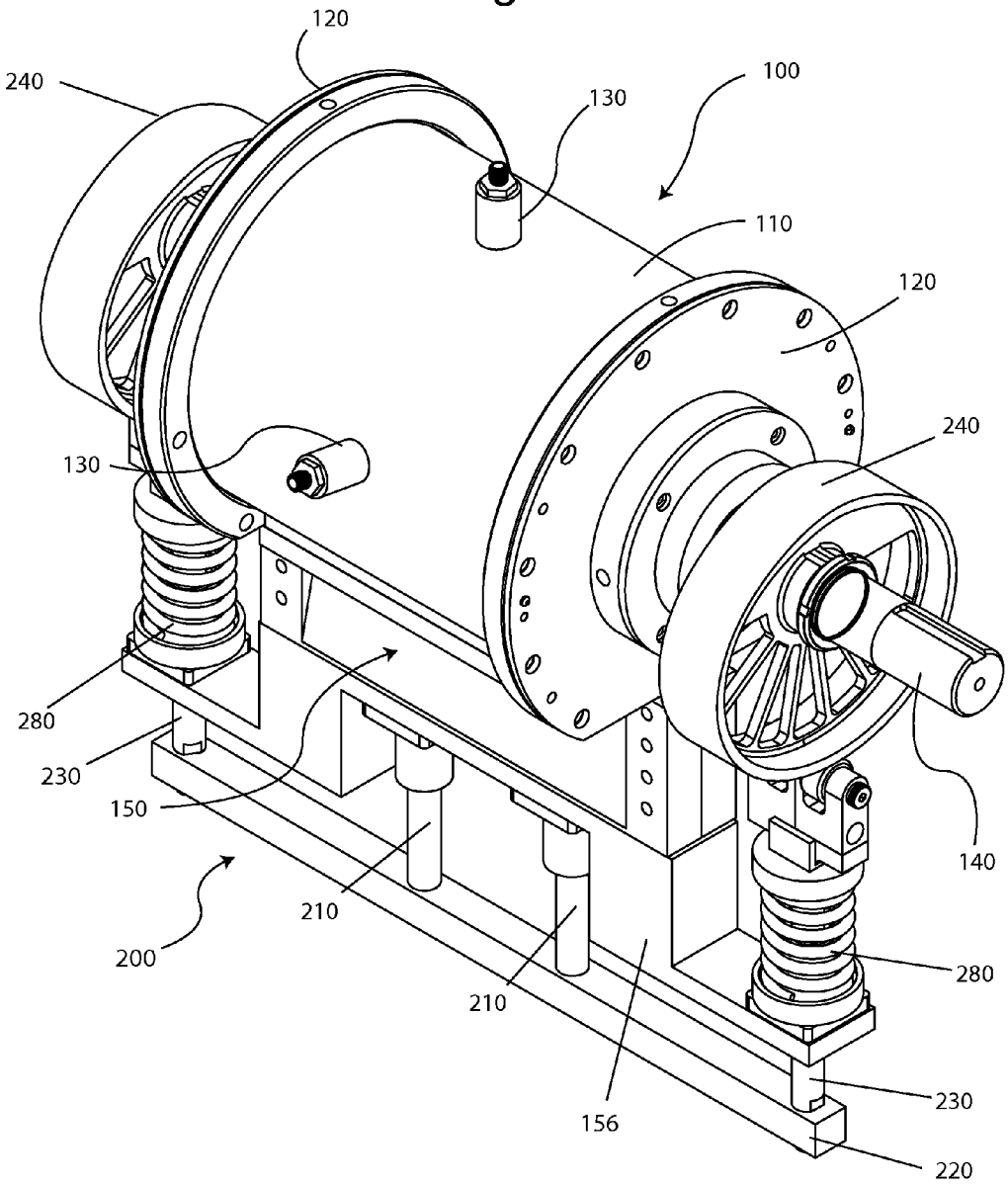
FIG. 1 is a perspective view of a rotary compressor with a spring-backed cam drive in accordance with an embodiment of the present invention.
Figure 2:
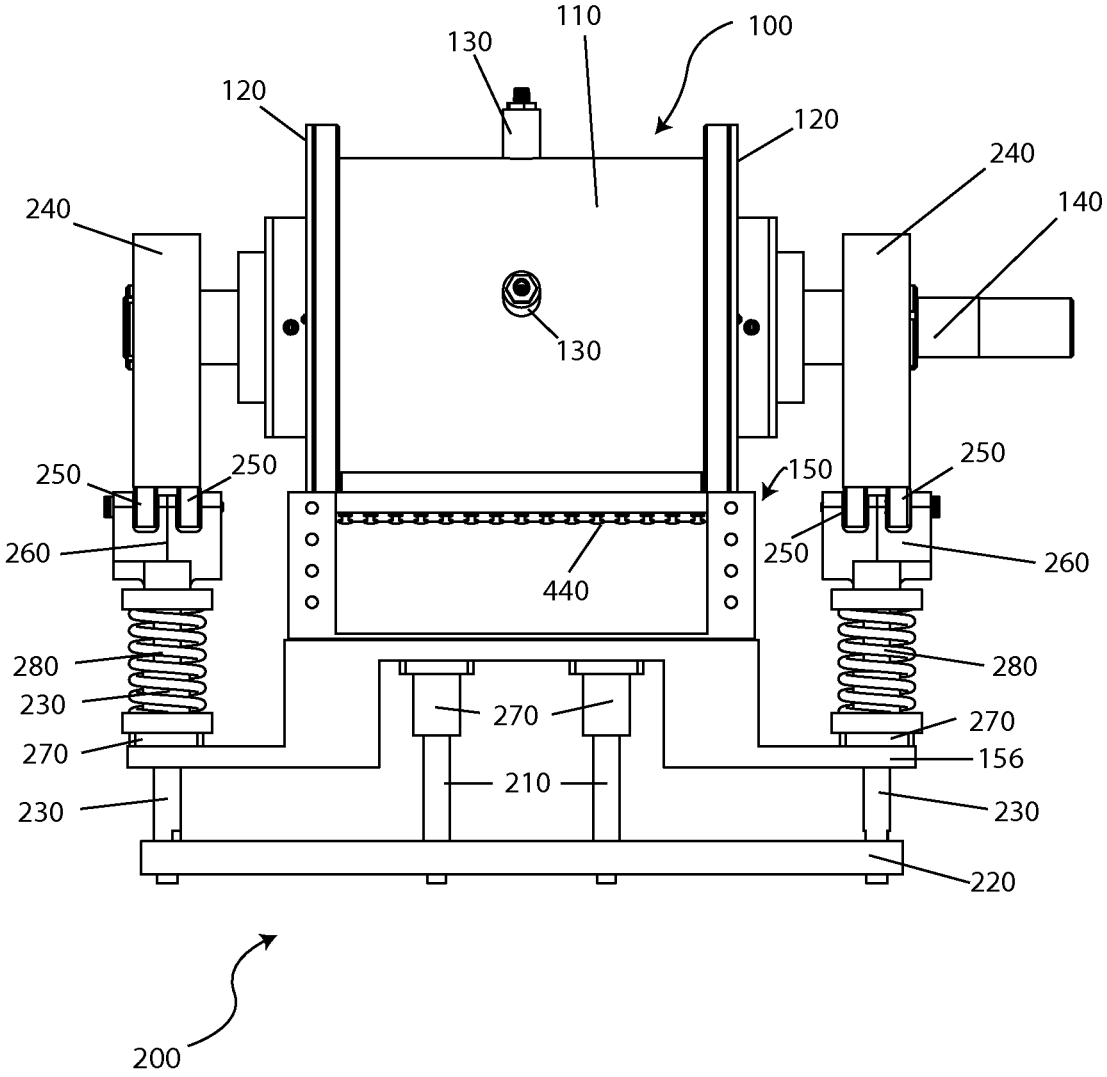
FIG. 2 is a right-side view of a rotary compressor with a spring-backed cam drive in accordance with an embodiment of the present invention.

To the extent that the following terms are utilized herein, the following definitions are applicable:

Balanced rotation: the center of mass of the rotating mass is located on the axis of rotation.

Chamber volume: any volume that can contain fluids for compression.

Compressor: a device used to increase the pressure of a compressible fluid. The fluid can be either gas or vapor, and can have a wide molecular weight range.

Concentric: the center or axis of one object coincides with the center or axis of a second object Concentric rotation: rotation in which one object's center of rotation is located on the same axis as the second object's center of rotation.

Positive displacement compressor: a compressor that collects a fixed volume of gas within a chamber and compresses it by reducing the chamber volume.

Proximate: sufficiently close to restrict fluid flow between high pressure and low pressure regions. Restriction does not need to be absolute; some leakage is acceptable.

Rotor: A rotating element driven by a mechanical force to rotate about an axis. As used in a compressor design, the rotor imparts energy to a fluid.

Rotary compressor: A positive-displacement compressor that imparts energy to the gas being compressed by way of an input shaft moving a single or multiple rotating elements FIGS. 1 through 7 show external views of an embodiment of the present invention in which a rotary compressor includes spring backed cam drive gate positioning system. Main housing 100 includes a main casing 110 and end plates 120, each of which includes a hole through which drive shaft 140 passes axially. Liquid injector assemblies 130 are located on holes in the main casing 110. The main casing includes a hole for the inlet flange 160, and a hole for the gate casing 150.

Figure 28:
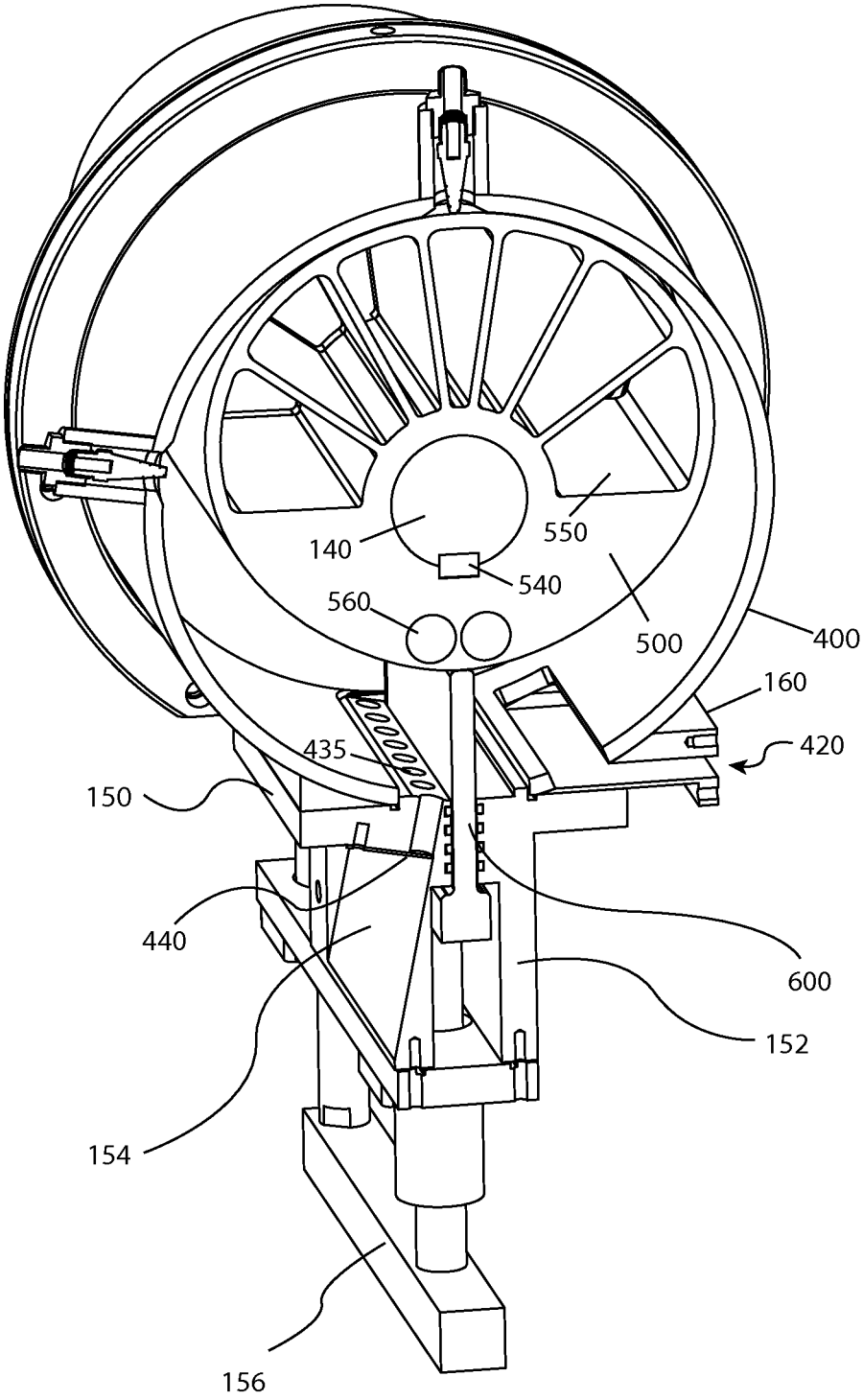
FIG. 28 is perspective, cross-sectional view of a rotary compressor in accordance with an embodiment of the present invention.

Gate casing 150 is connected to and positioned below main casing 110 at a hole in main casing 110. The gate casing 150 is comprised of two portions: an inlet side 152 and an outlet side 154. As shown in FIG. 28, the outlet side 154 includes outlet ports 435, which are holes which lead to outlet valves 440. Alternatively, an outlet valve assembly may be used.

Referring back to FIGS. 1-7, the spring-backed cam drive gate positioning system 200 is attached to the gate casing 150 and drive shaft 140. The gate positioning system 200 moves gate 600 in conjunction with the rotation of rotor 500. A movable assembly includes gate struts 210 and cam struts 230 connected to gate support arm 220 and bearing support plate 156. The bearing support plate 156 seals the gate casing 150 by interfacing with the inlet and outlet sides through a bolted gasket connection. Bearing support plate 156 is shaped to seal gate casing 150, mount bearing housings 270 in a sufficiently parallel manner, and constrain compressive springs 280. Bearing housings 270, also known as pillow blocks, are concentric to the gate struts 210 and the cam struts 230.

Two cam followers 250 are located tangentially to each cam 240, providing a downward force on the gate. Drive shaft 140 turns cams 240, which transmits force to the cam followers 250. The cam followers 250 may be mounted on a through shaft, which is supported on both ends, or cantilevered and only supported on one end. The cam followers 250 are attached to cam follower supports 260, which transfer the force into the cam struts 230. As cams 240 turn, the cam followers 250 are pushed down, thus moving the cam struts 230 down. This moves the gate support arm 220 and the gate strut 210 down. This, in turn, moves the gate 600 down.

Springs 280 provide a restorative upward force to keep the gate 600 timed appropriately to seal against the rotor 500. As the cams 240 continue to turn and no longer effectuate a downward force on the cam followers 250, springs 280 provide an upward force. As shown in this embodiment, compression springs are utilized. As one of ordinary skill in the art would appreciate, tension springs and the shape of the bearing support plate 156 may be altered to provide for the desired upward or downward force. The upward force of the springs 280 pushes the cam follower support 260 and thus the gate support arm 220 up which in turn moves the gate 600 up.

Due to the varying pressure angle between the cam followers 250 and cams 240, the preferred embodiment may utilize an exterior cam profile that differs from the rotor 500 profile. This variation in profile allows for compensation for the changing pressure angle to ensure that the tip of the gate 600 remains proximate to the rotor 500 throughout the entire compression cycle.

Figure 3:
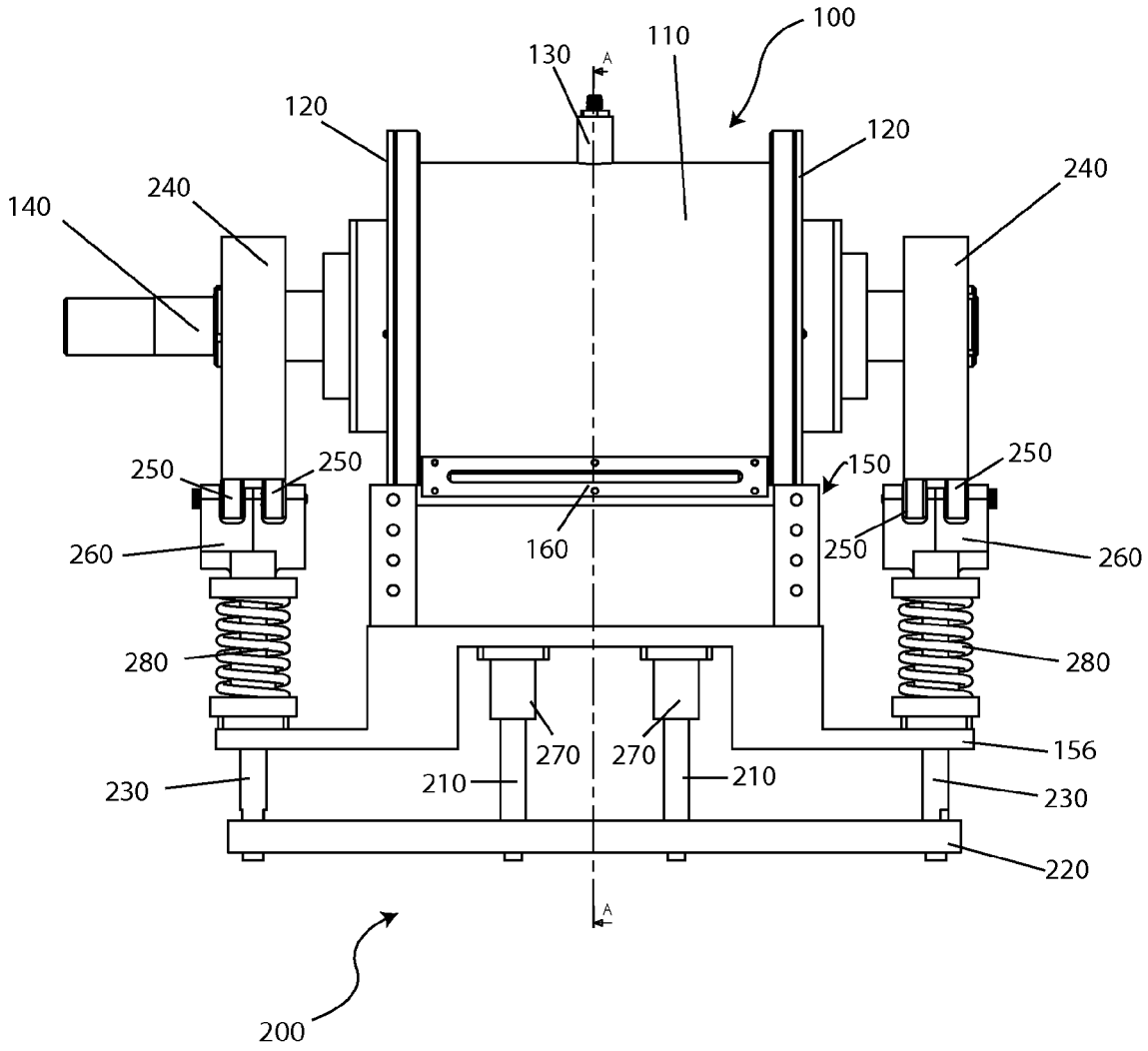
FIG. 3 is a left-side view of a rotary compressor with a spring-backed cam drive in accordance with an embodiment of the present invention.
Figure 4:
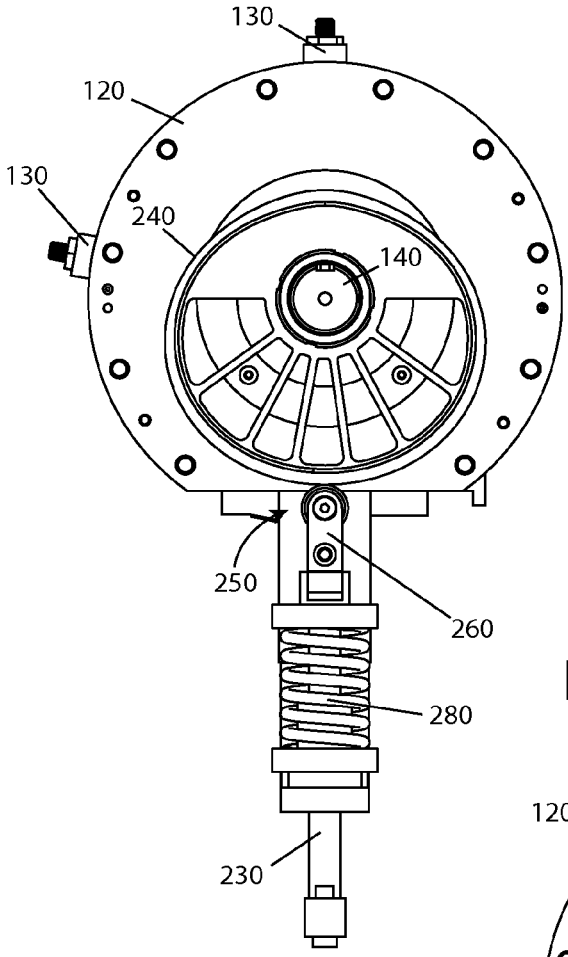
FIG. 4 is a front view of a rotary compressor with a spring-backed cam drive in accordance with an embodiment of the present invention.
Figure 5:
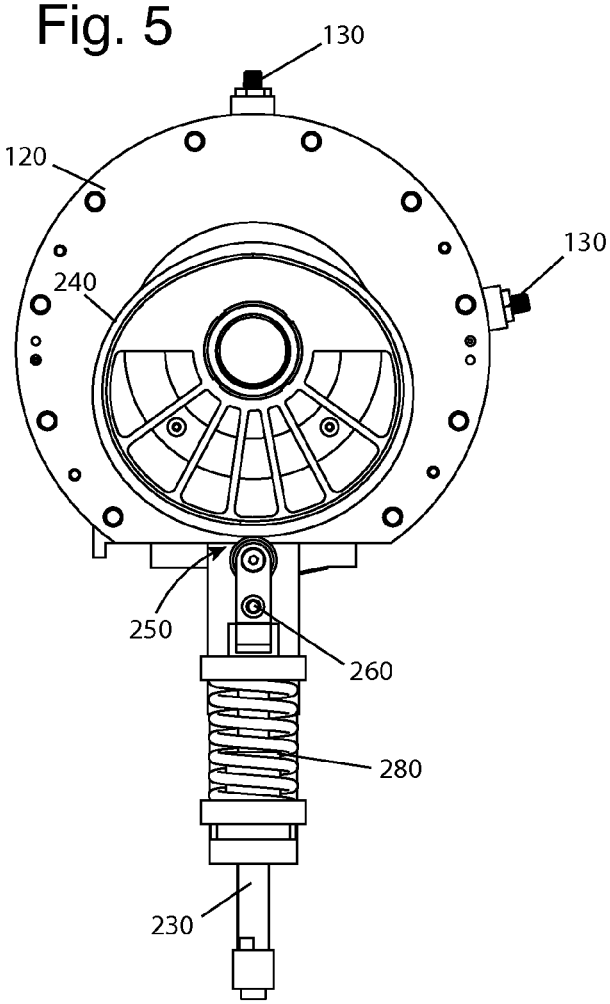
FIG. 5 is a back view of a rotary compressor with a spring-backed cam drive in accordance with an embodiment of the present invention.
Figure 6:
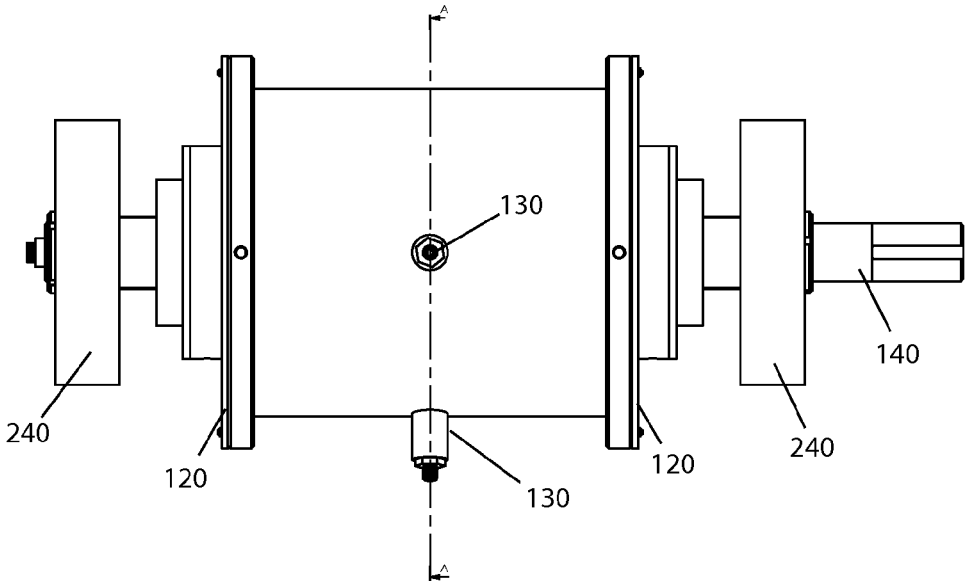
FIG. 6 is a top view of a rotary compressor with a spring-backed cam drive in accordance with an embodiment of the present invention.
Figure 7:
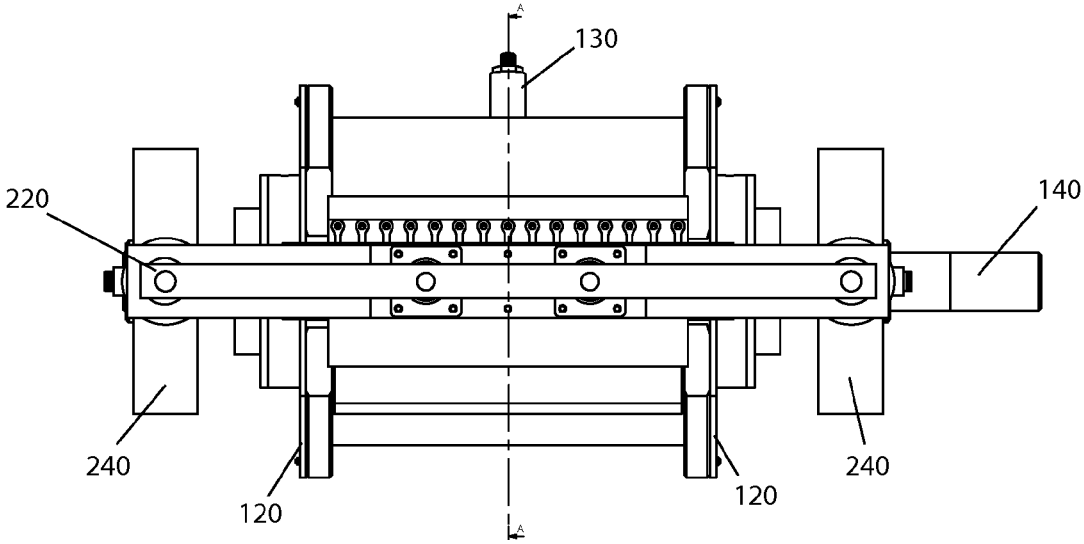
FIG. 7 is a bottom view of a rotary compressor with a spring-backed cam drive in accordance with an embodiment of the present invention.
Figure 8:
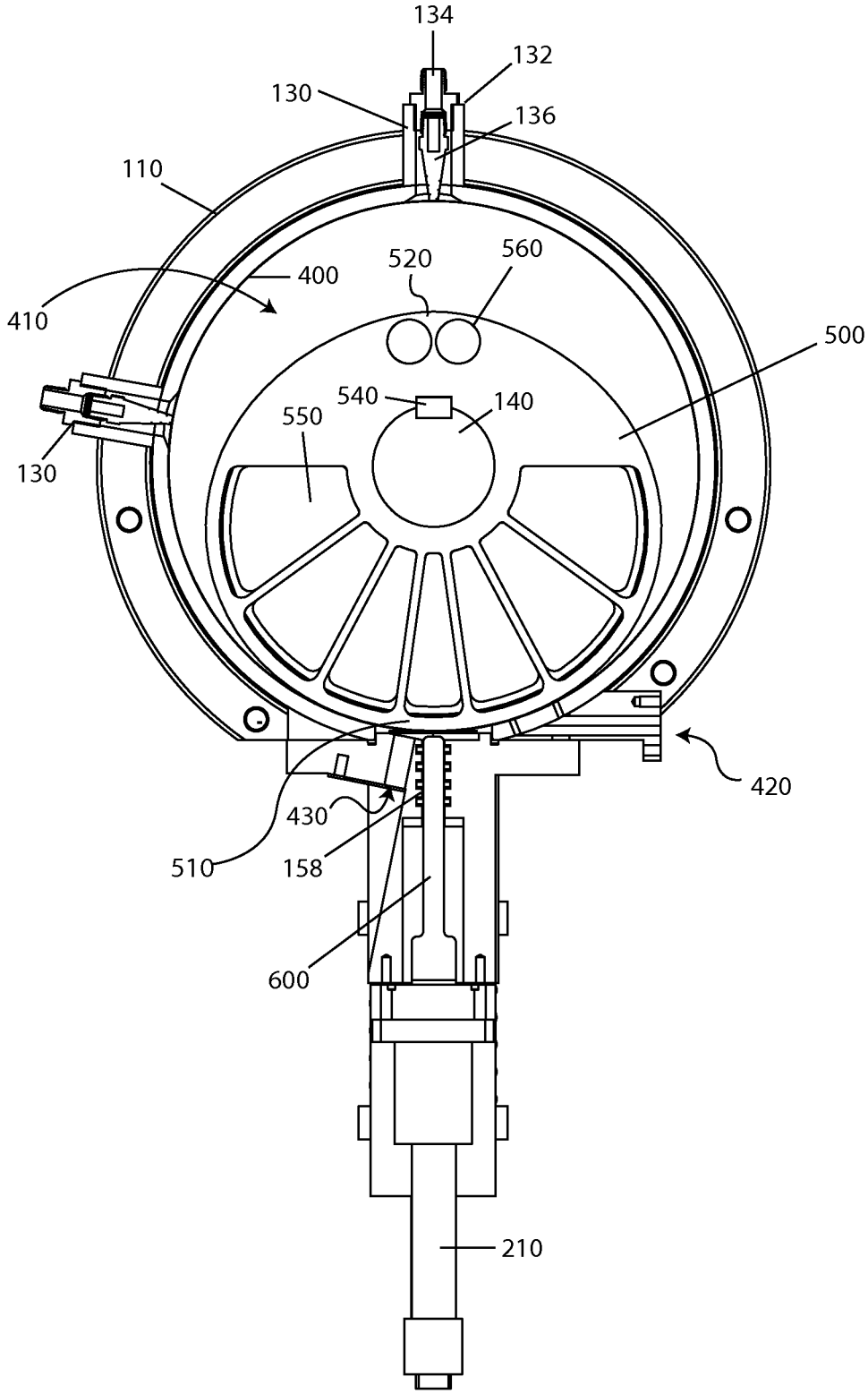
FIG. 8 is a cross-sectional view of a rotary compressor with a spring-backed cam drive in accordance with an embodiment of the present invention.

Line A in FIGS. 3, 6, and 7 shows the location for the cross-sectional view of the compressor in FIG. 8. As shown in FIG. 8, the main casing 110 has a cylindrical shape. Liquid injector housings 132 are attached to, or may be cast as a part of, the main casing 110 to provide for openings in the rotor casing 400. Because it is cylindrically shaped in this embodiment, the rotor casing 400 may also be referenced as the cylinder. The interior wall defines a rotor casing volume 410. The rotor 500 concentrically rotates with drive shaft 140 and is affixed to the drive shaft 140 by way of key 540 and press fit.

Figure 9:
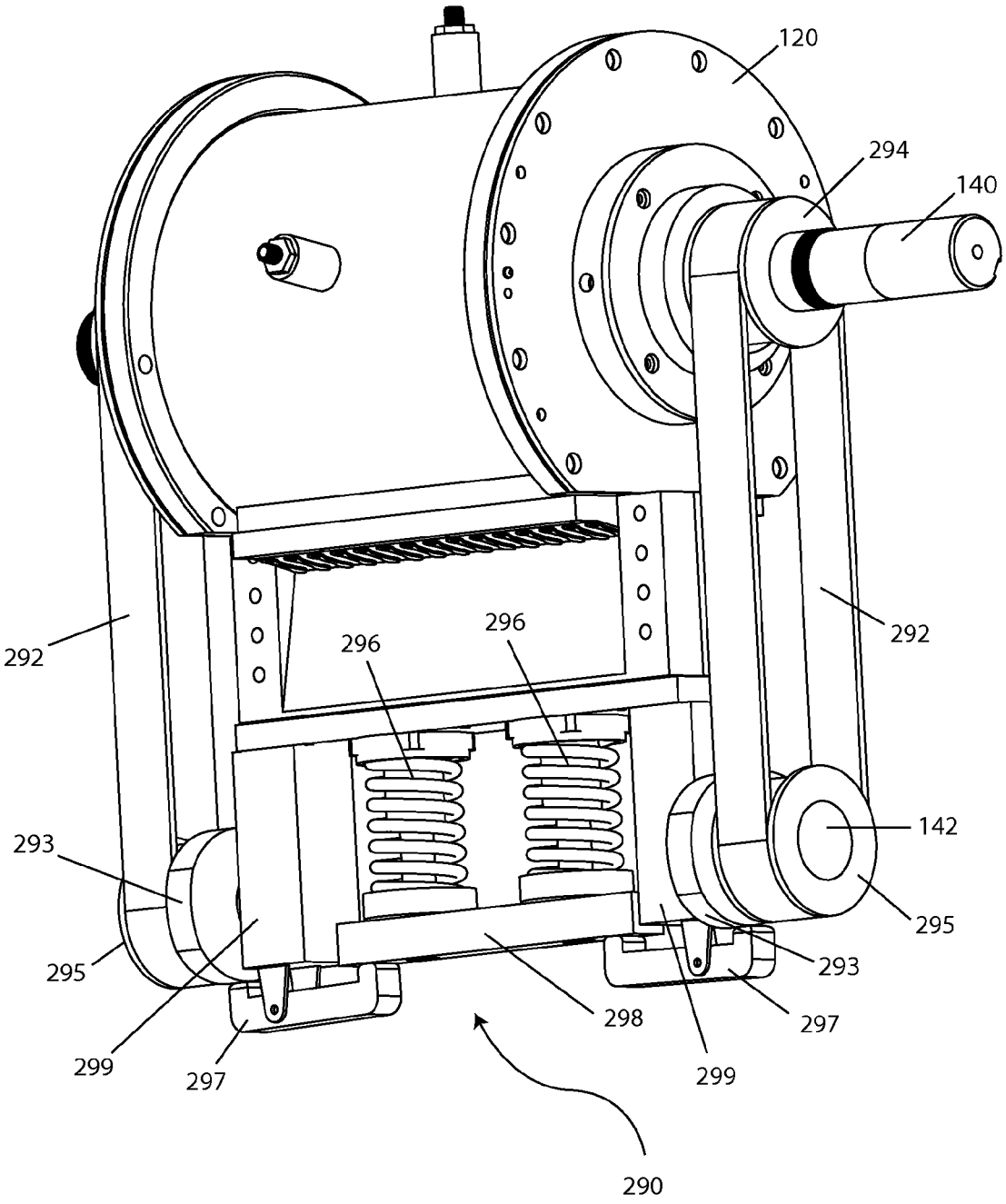
FIG. 9 is a perspective view of rotary compressor with a belt-driven, spring-biased gate positioning system in accordance with an embodiment of the present invention.
Figure 10:
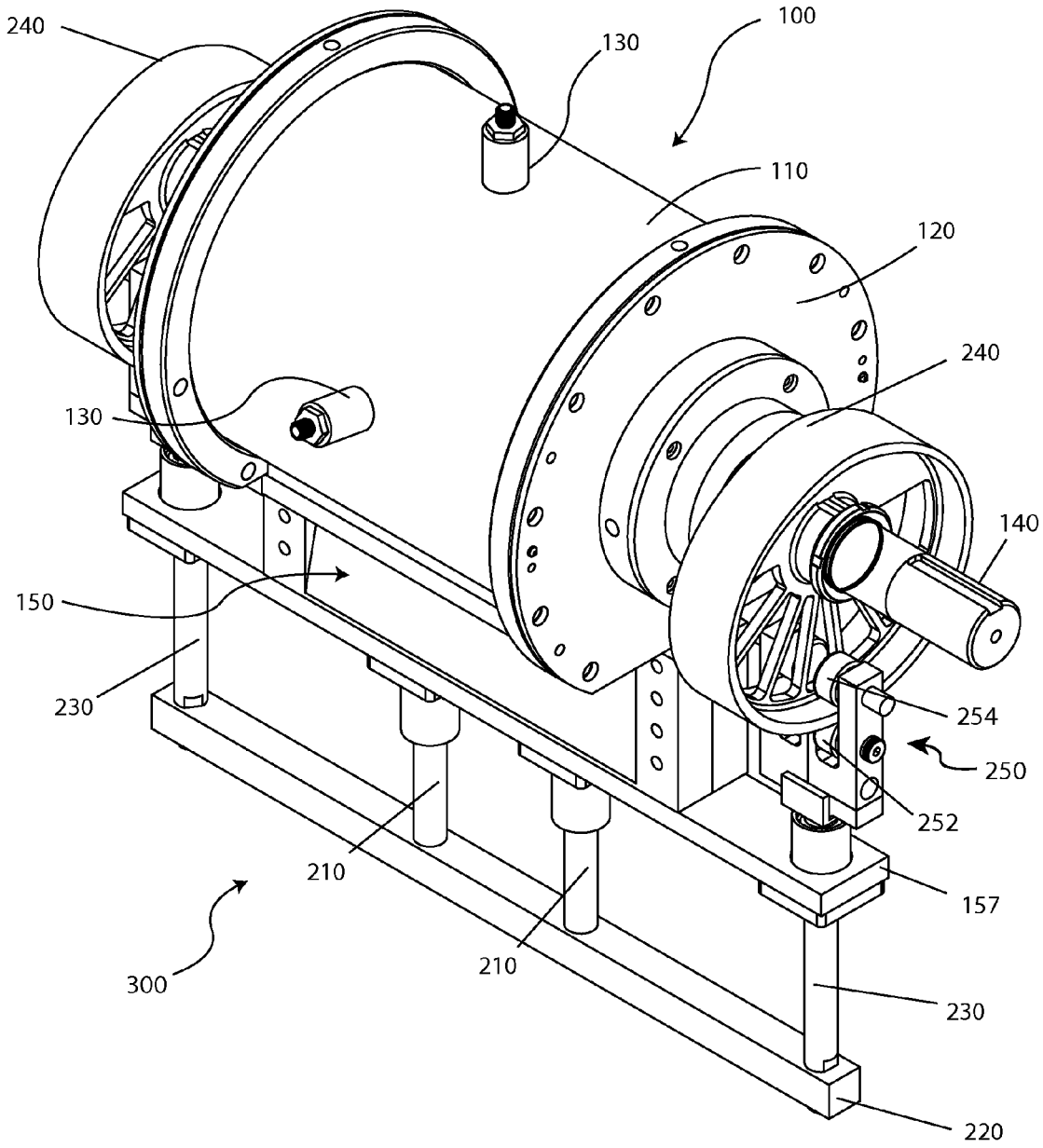
FIG. 10 is a perspective view of a rotary compressor with a dual cam follower gate positioning system in accordance with an embodiment of the present invention.
Figure 11:
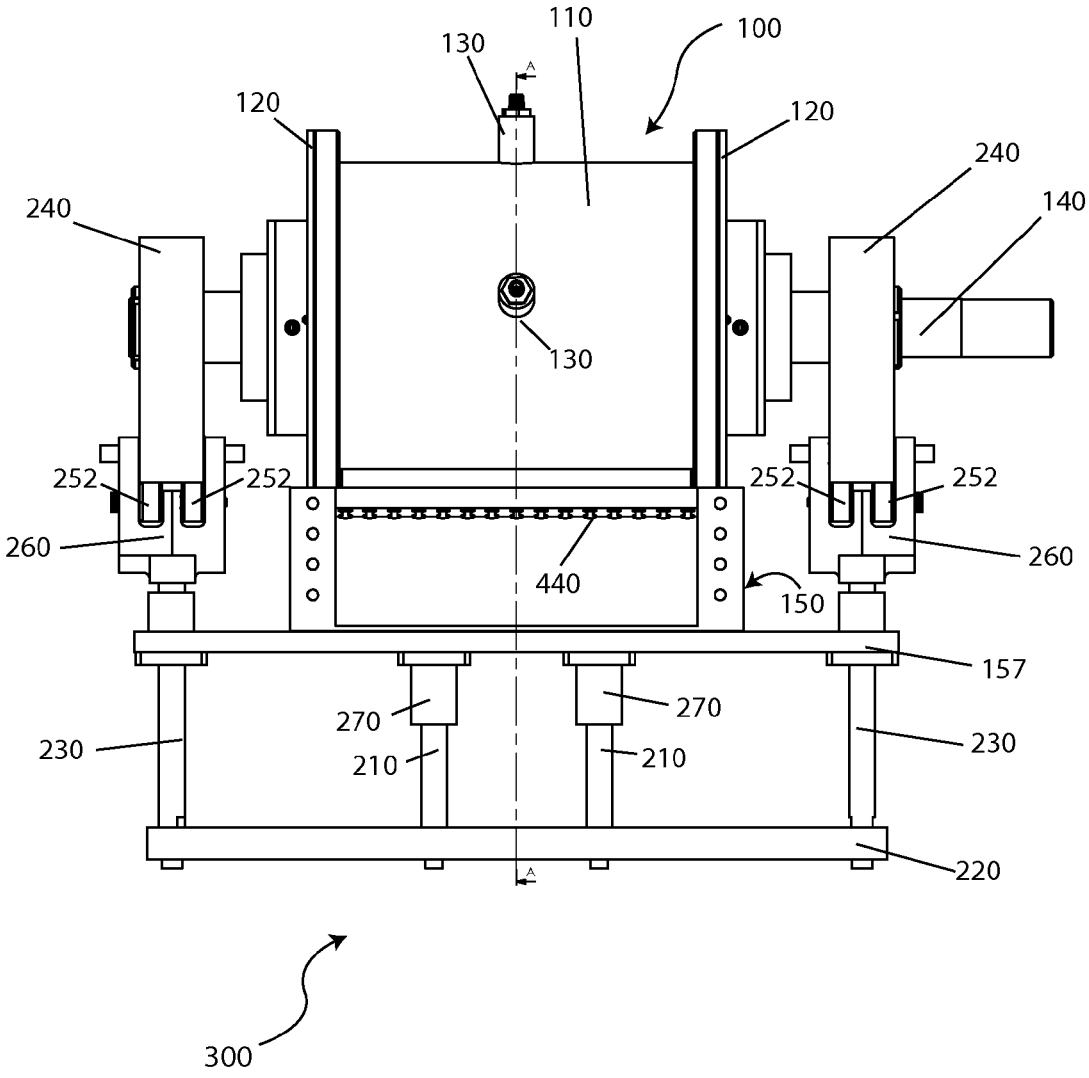
FIG. 11 is a right-side view of a rotary compressor with a dual cam follower gate positioning system in accordance with an embodiment of the present invention.
Figure 12:
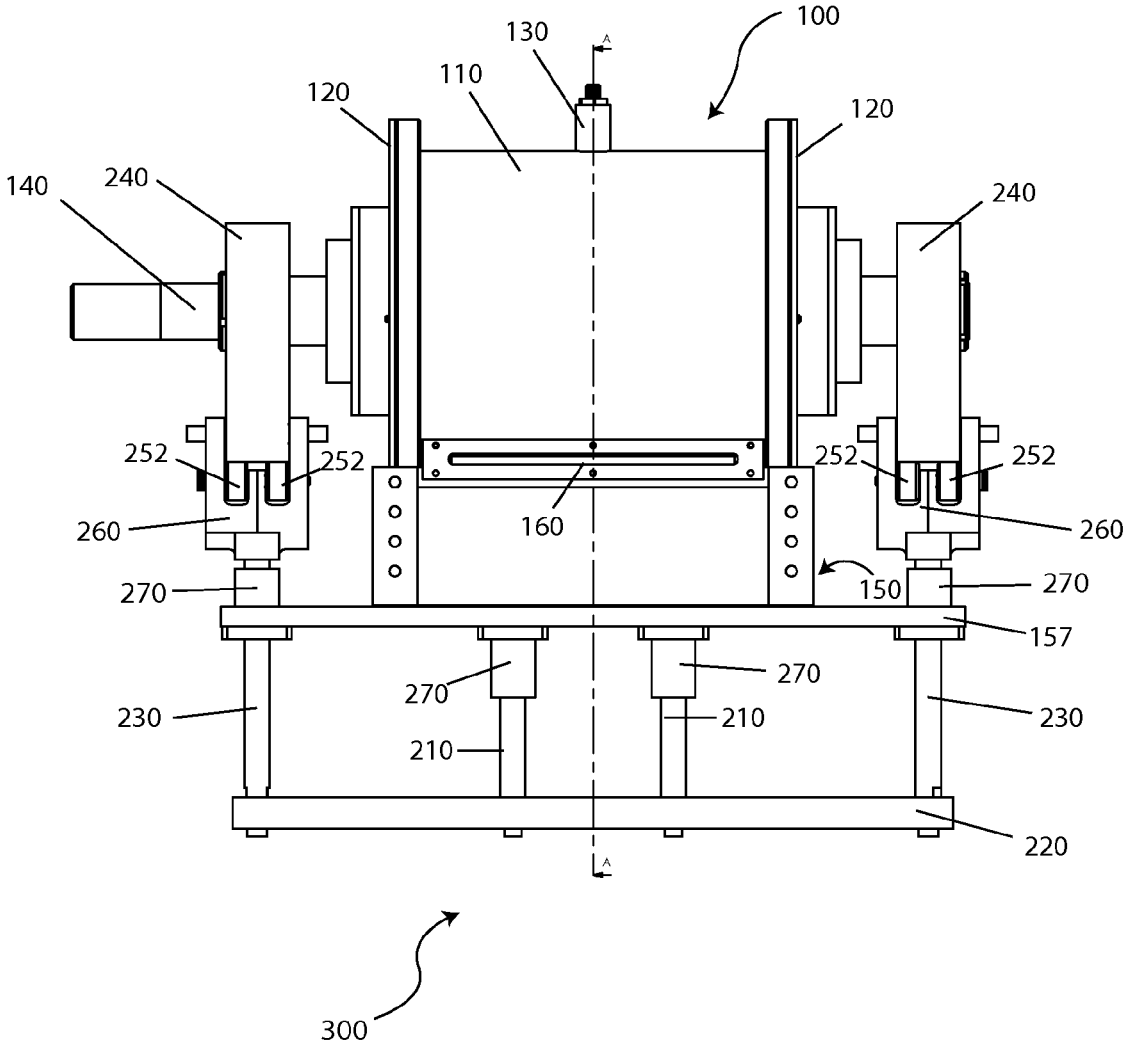
FIG. 12 is a left-side view of a rotary compressor with a dual cam follower gate positioning system in accordance with an embodiment of the present invention.
Figure 13:
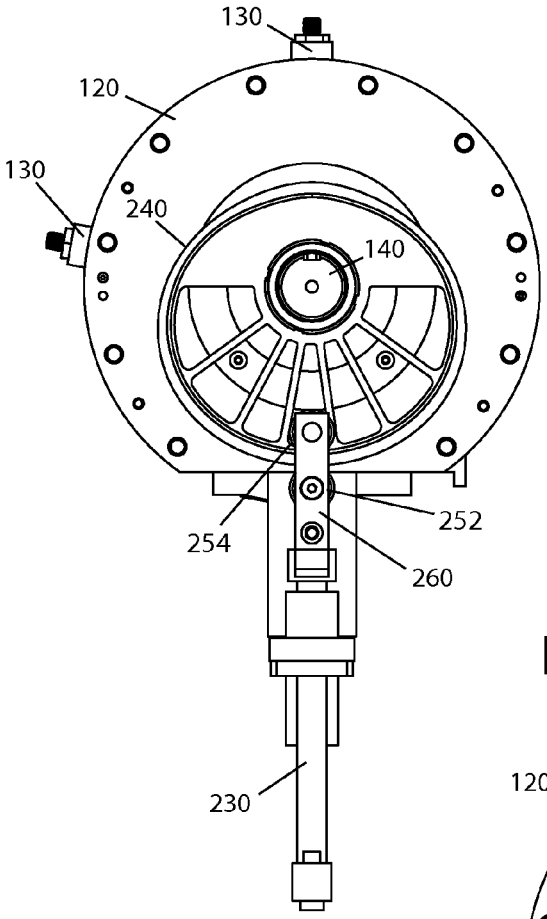
FIG. 13 is a front view of a rotary compressor with a dual cam follower gate positioning system in accordance with an embodiment of the present invention.
Figure 14:
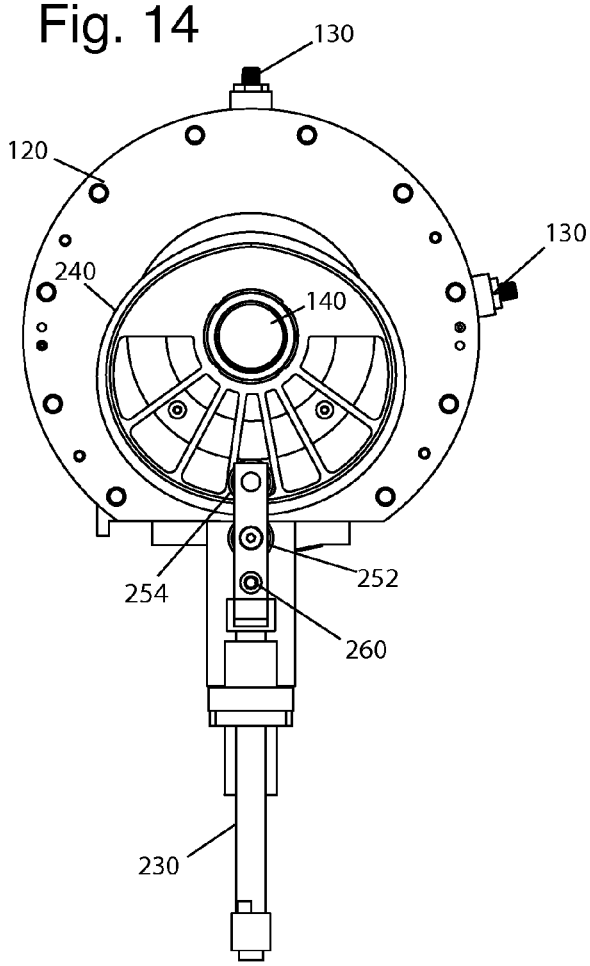
FIG. 14 is a back view of a rotary compressor with a dual cam follower gate positioning system in accordance with an embodiment of the present invention.
Figure 15:
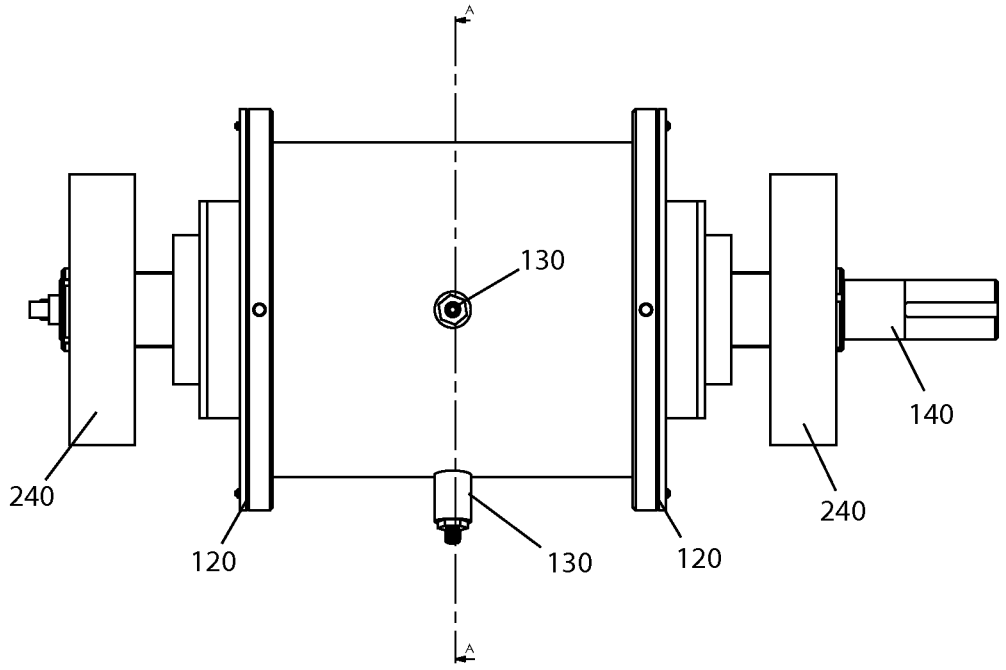
FIG. 15 is a top view of a rotary compressor with a dual cam follower gate positioning system in accordance with an embodiment of the present invention.
Figure 16:
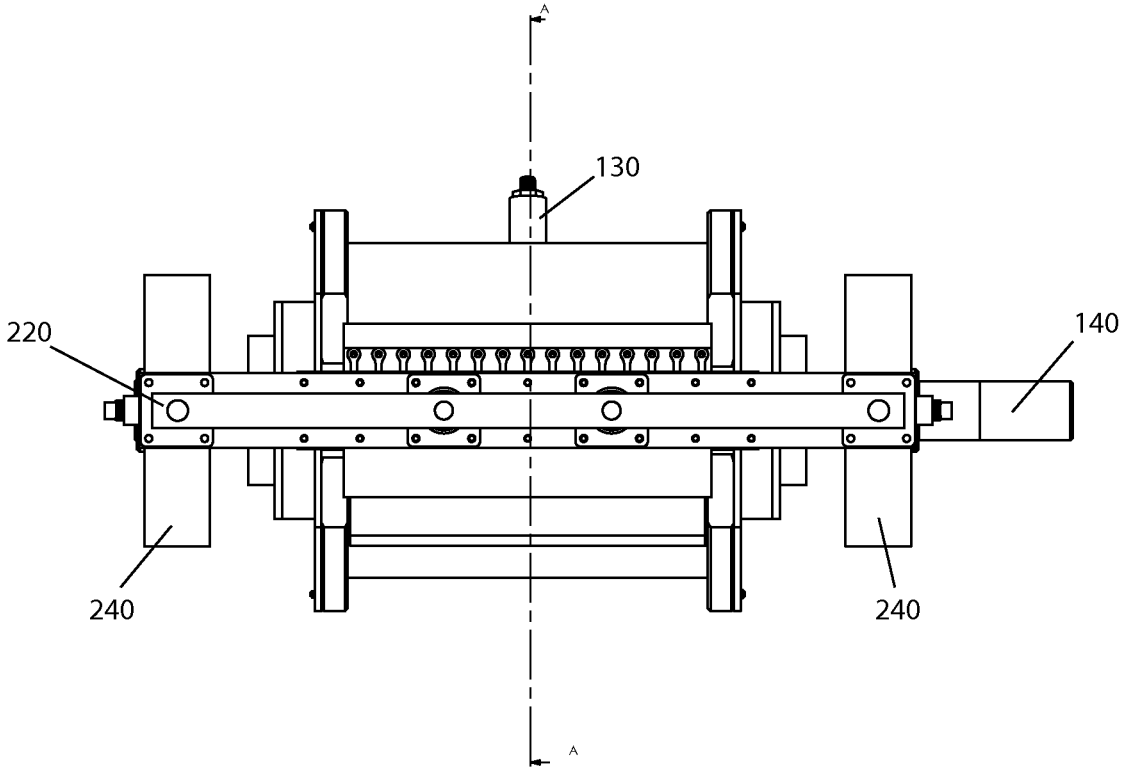
FIG. 16 is a bottom view of a rotary compressor with a dual cam follower gate positioning system in accordance with an embodiment of the present invention.

FIG. 9 shows an embodiment of the present invention in which a timing belt with spring gate positioning system is utilized. This embodiment 290 incorporates two timing belts 292 each of which is attached to the drive shaft 140 by way of sheaves 294. The timing belts 292 are attached to secondary shafts 142 by way of sheaves 295. Gate strut springs 296 are mounted around gate struts. Rocker arms 297 are mounted to rocker arm supports 299. The sheaves 295 are connected to rocker arm cams 293 to push the rocker arms 297 down. As the inner rings push down on one side of the rocker arms 297, the other side pushes up against the gate support bar 298. The gate support bar 298 pushes up against the gate struts and gate strut springs 296. This moves the gate up. The springs 296 provide a downward force pushing the gate down.

FIGS. 10 through 17 show external views of a rotary compressor embodiment utilizing a dual cam follower gate positioning system. The main housing 100 includes a main casing 110 and end plates 120, each of which includes a hole through which a drive shaft 140 passes axially. Liquid injector assemblies 130 are located on holes in the main casing 110. The main casing 110 also includes a hole for the inlet flange 160 and a hole for the gate casing 150. The gate casing 150 is mounted to and positioned below the main casing 110 as discussed above.

A dual cam follower gate positioning system 300 is attached to the gate casing 150 and drive shaft 140. The dual cam follower gate positioning system 300 moves the gate 600 in conjunction with the rotation of the rotor 500. In a preferred embodiment, the size and shape of the cams is nearly identical to the rotor in cross-sectional size and shape. In other embodiments, the rotor, cam shape, curvature, cam thickness, and variations in the thickness of the lip of the cam may be adjusted to account for variations in the attack angle of the cam follower. Further, large or smaller cam sizes may be used. For example, a similar shape but smaller size cam may be used to reduce roller speeds.

A movable assembly includes gate struts 210 and cam struts 230 connected to gate support arm 220 and bearing support plate 156. In this embodiment, the bearing support plate 157 is straight. As one of ordinary skill in the art would appreciate, the bearing support plate can utilize different geometries, including structures designed to or not to perform sealing of the gate casing 150. In this embodiment, the bearing support plate 157 serves to seal the bottom of the gate casing 150 through a bolted gasket connection. Bearing housings 270, also known as pillow blocks, are mounted to bearing support plate 157 and are concentric to the gate struts 210 and the cam struts 230.

Drive shaft 140 turns cams 240, which transmit force to the cam followers 250, including upper cam followers 252 and lower cam followers 254. The cam followers 250 may be mounted on a through shaft, which is supported on both ends, or cantilevered and only supported on one end. In this embodiment, four cam followers 250 are used for each cam 240. Two lower cam followers 252 are located below and follow the outside edge of the cam 240. They are mounted using a through shaft. Two upper cam followers 254 are located above the previous two and follow the inside edge of the cams 240. They are mounted using a cantilevered connection.

The cam followers 250 are attached to cam follower supports 260, which transfer the force into the cam struts 230. As the cams 240 turn, the cam struts 230 move up and down. This moves the gate support arm 220 and gate struts 210 up and down, which in turn, moves the gate 600 up and down.

Figure 17:
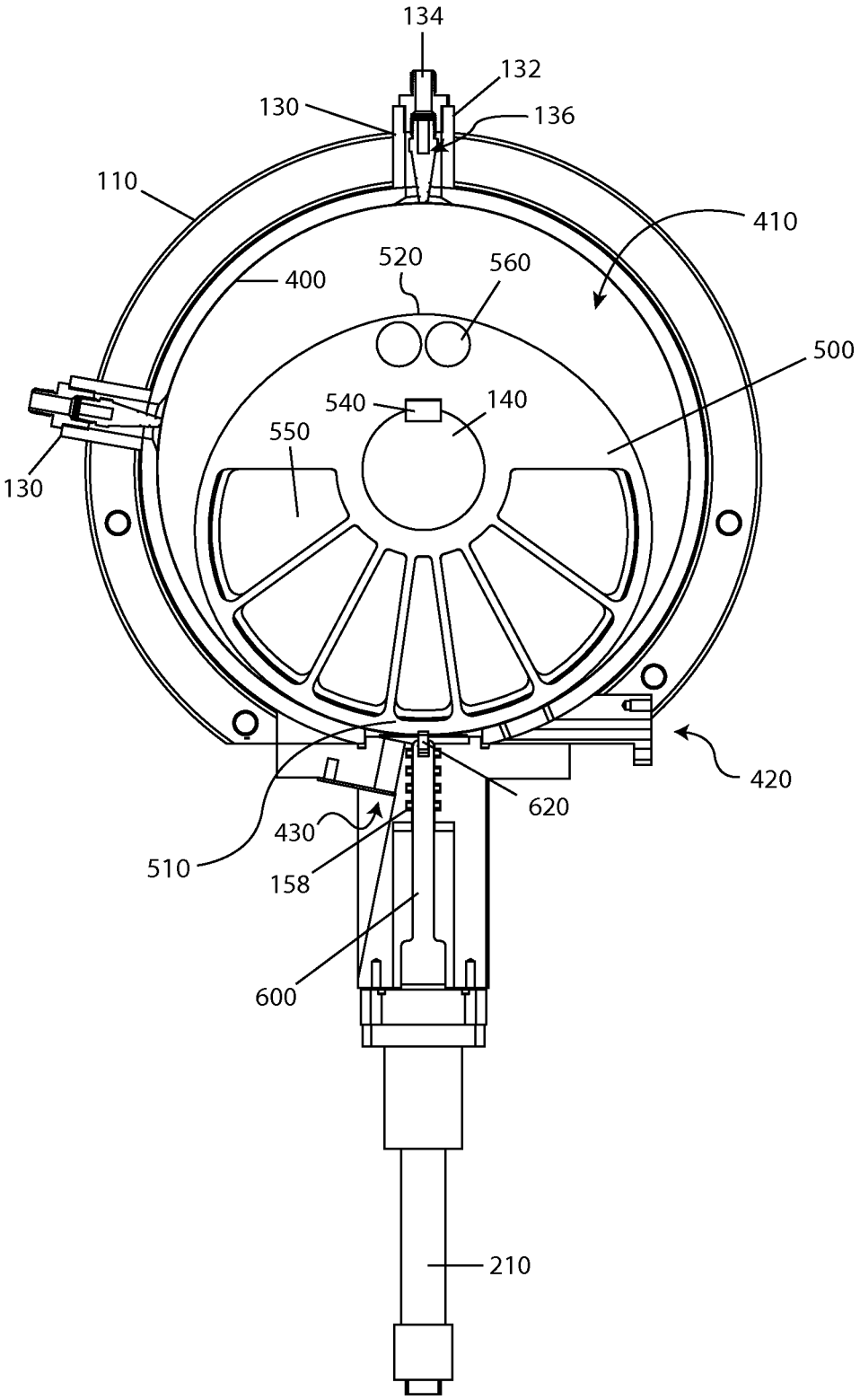
FIG. 17 is a cross-sectional view of a rotary compressor with a dual cam follower gate positioning system in accordance with an embodiment of the present invention.

Line A in FIGS. 11, 12, 15, and 16 show the location for the cross-sectional view of the compressor in FIG. 17. As shown in FIG. 17, the main casing 110 has a cylindrical shape. Liquid injector housings 132 are attached to or may be cast as a part of the main casing 110 to provide for openings in the rotor casing 400. The rotor 500 concentrically rotates around drive shaft 140.

Figure 18:
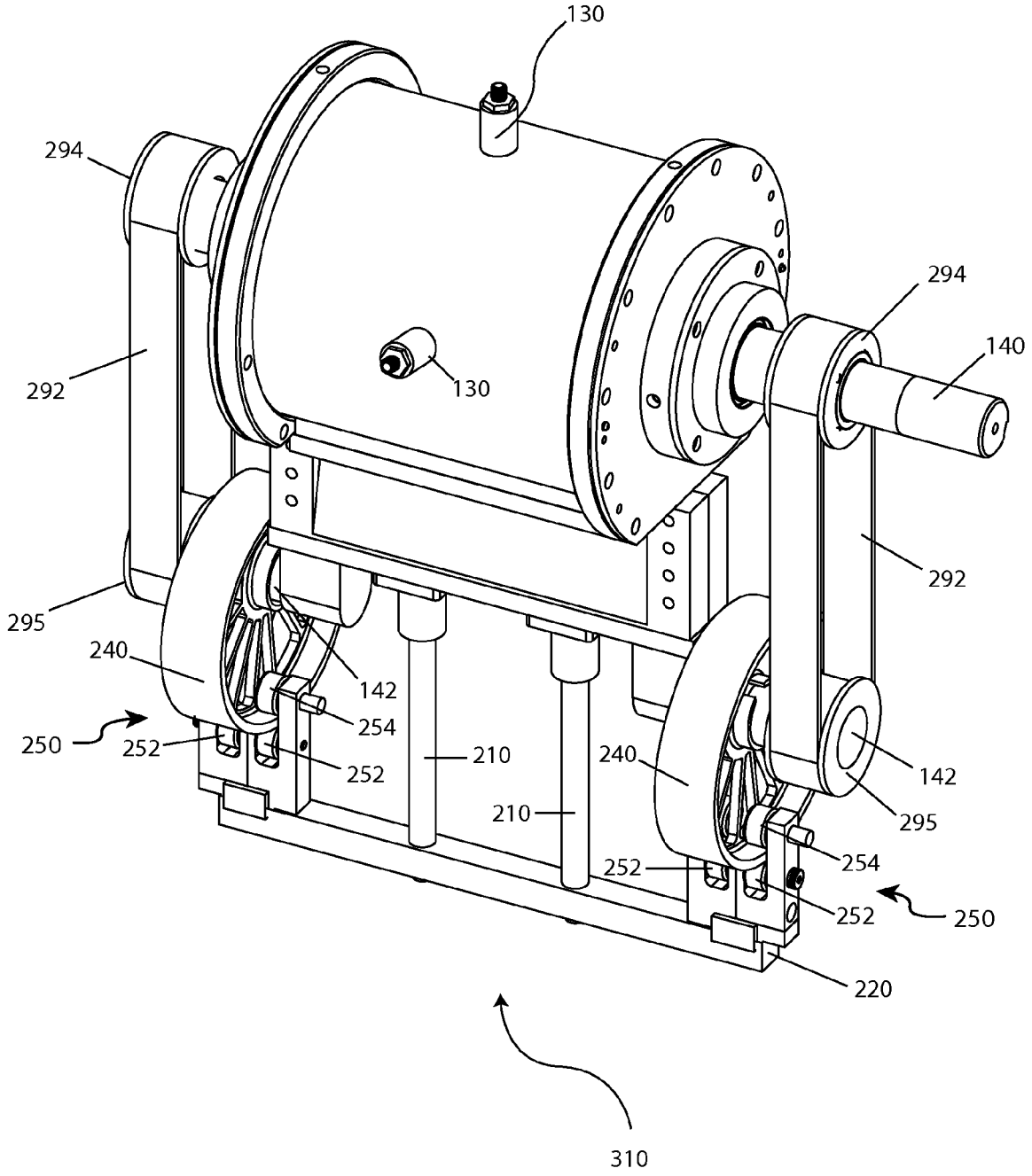
FIG. 18 is perspective view of a rotary compressor with a belt-driven gate positioning system in accordance with an embodiment of the present invention.
Figure 19:
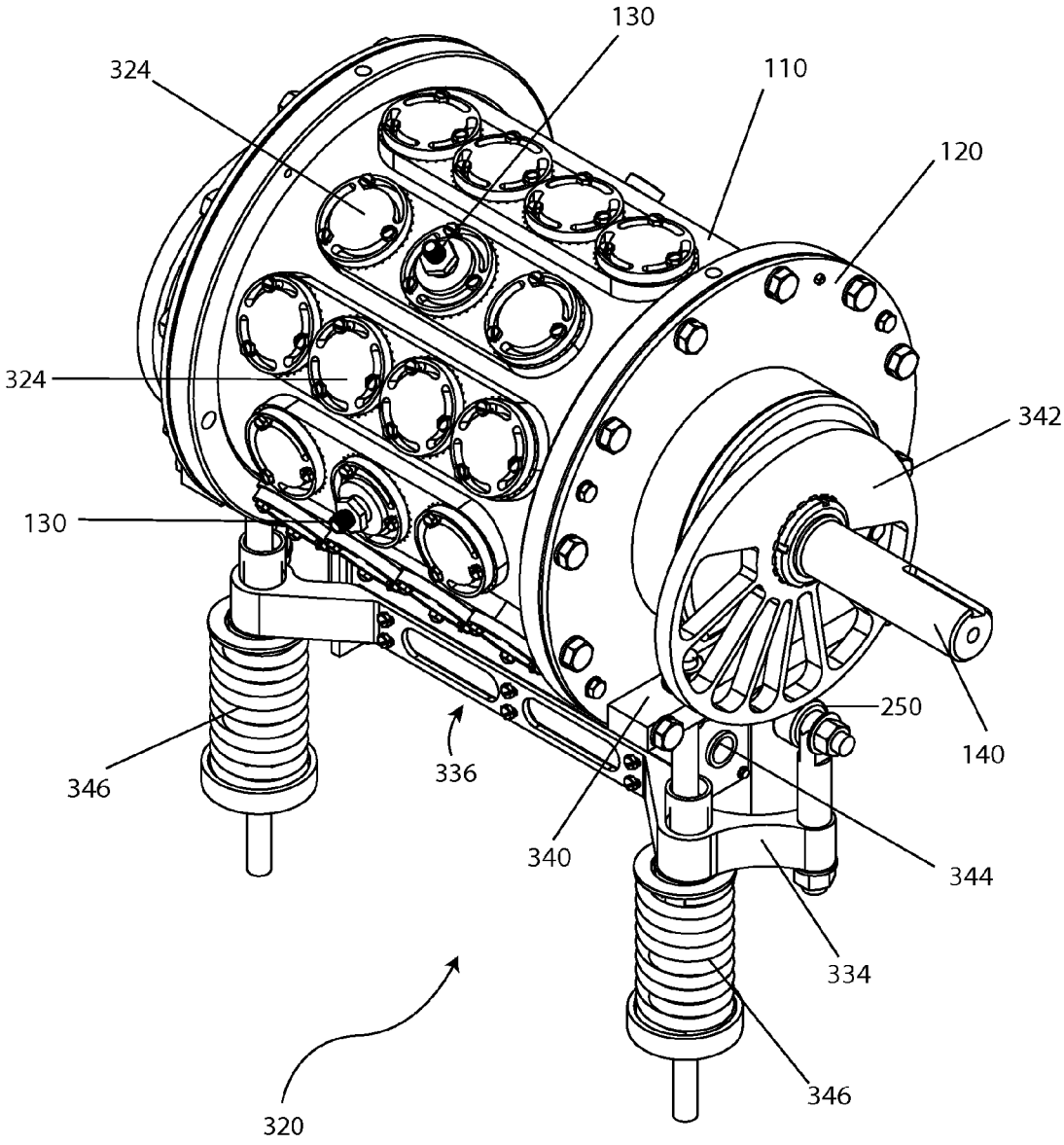
FIG. 19 is perspective view of a rotary compressor with an offset gate guide positioning system in accordance with an embodiment of the present invention.
Figure 20:
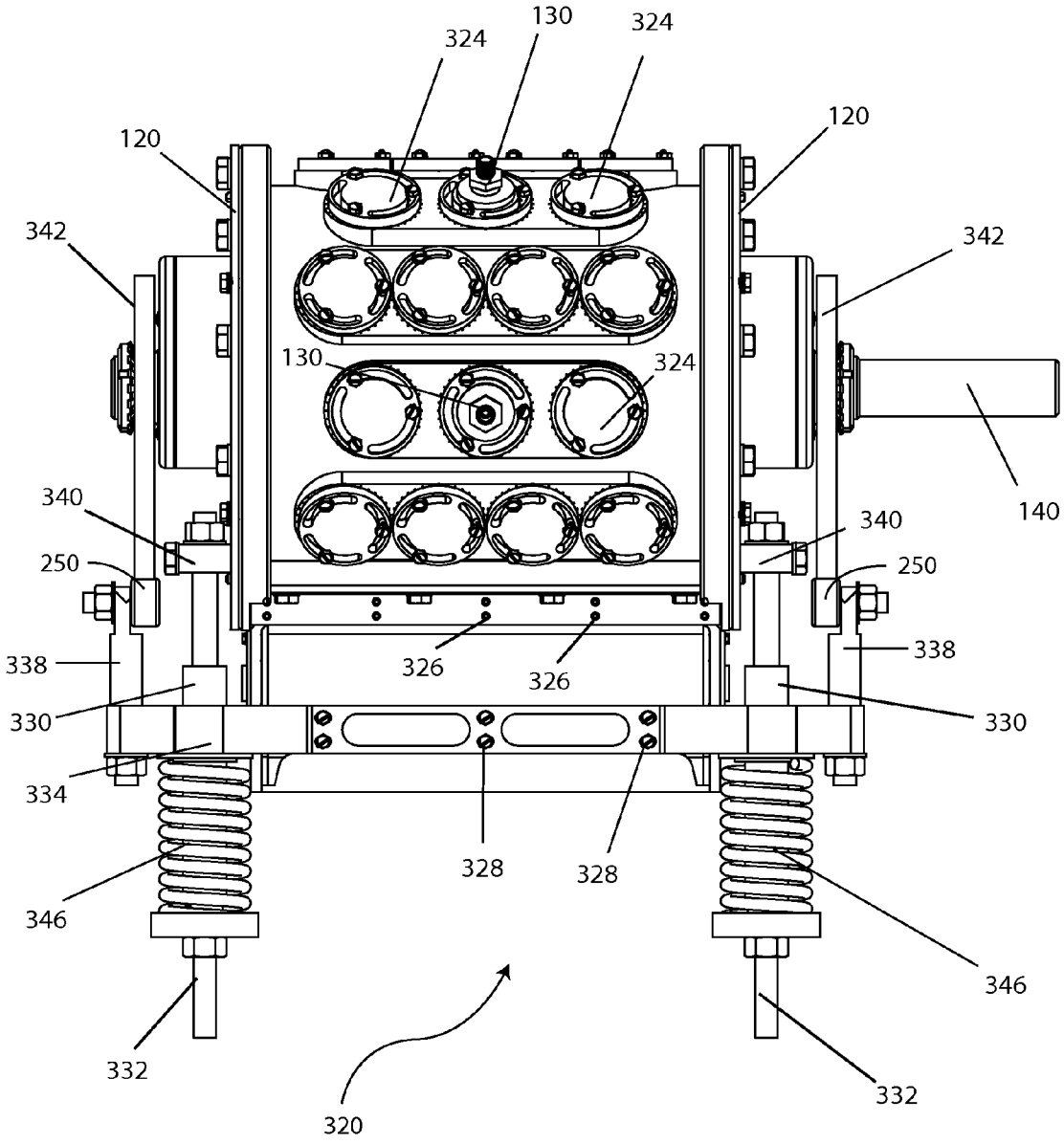
FIG. 20 is a right-side view of a rotary compressor with an offset gate guide positioning system in accordance with an embodiment of the present invention.
Figure 21:
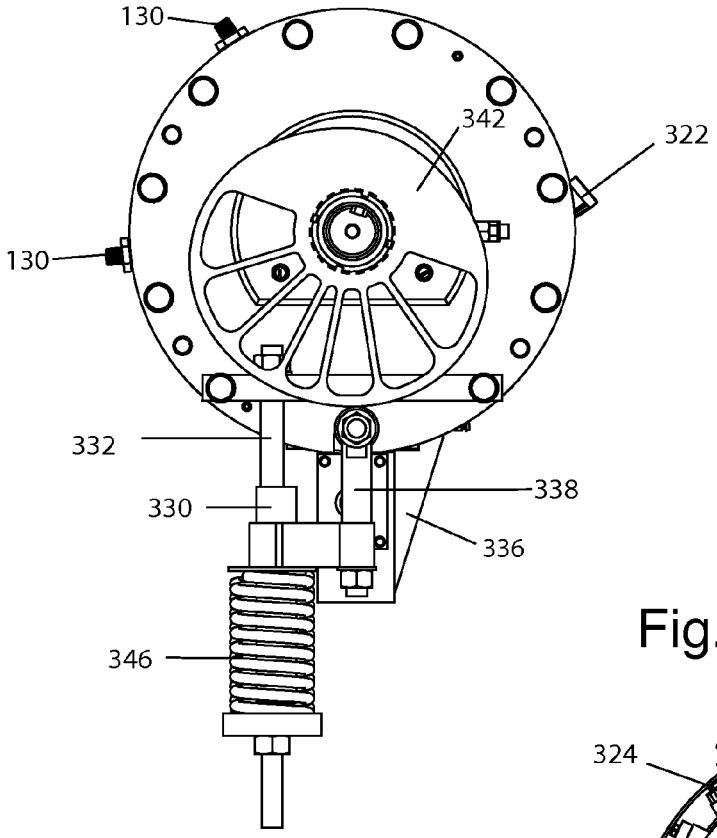
FIG. 21 is a front view of a rotary compressor with an offset gate guide positioning system in accordance with an embodiment of the present invention.
Figure 22:
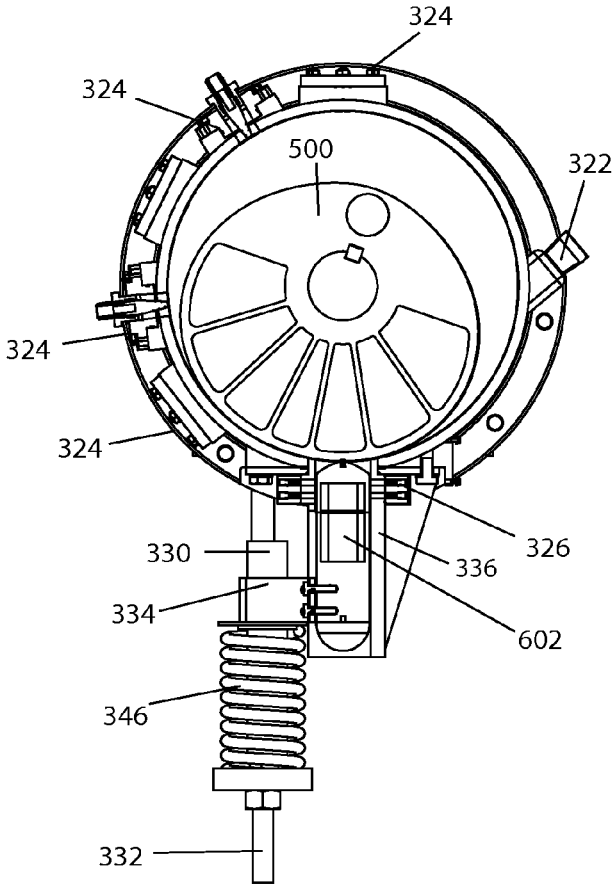
FIG. 22 is a cross-sectional view of a rotary compressor with an offset gate guide positioning system in accordance with an embodiment of the present invention.

An embodiment using a belt driven system 310 is shown in FIG. 18. Timing belts 292 are connected to the drive shaft 140 by way of sheaves 294. The timing belts 292 are each also connected to secondary shafts 142 by way of another set of sheaves 295. The secondary shafts 142 drive the external cams 240, which are placed below the gate casing 150 in this embodiment. Sets of upper and lower cam followers 254 and 252 are applied to the cams 240, which provide force to the movable assembly including gate struts 210 and gate support arm 220. As one of ordinary skill in the art would appreciate, belts may be replaced by chains or other materials.

An embodiment of the present invention using an offset gate guide system is shown in FIGS. 19 through 22 and 33. Outlet of the compressed gas and injected fluid is achieved through a ported gate system 602 comprised of two parts bolted together to allow for internal lightening features. Fluid passes through channels 630 in the upper portion of the gate 602 and travels to the lengthwise sides to outlet through an exhaust port 344 in a timed manner with relation to the angle of rotation of the rotor 500 during the cycle. Discrete point spring-backed scraper seals 326 provide sealing of the gate 602 in the single piece gate casing 336. Liquid injection is achieved through a variety of flat spray nozzles 322 and injector nozzles 130 across a variety of liquid injector port 324 locations and angles.

Reciprocating motion of the two-piece gate 602 is controlled through the use of an offset spring-backed cam follower control system 320 to achieve gate motion in concert with rotor rotation. Single cams 342 drive the gate system downwards through the transmission of force on the cam followers 250 through the cam struts 338. This results in controlled motion of the crossarm 334, which is connected by bolts (some of which are labeled as 328) with the two-piece gate 602. The crossarm 334 mounted linear bushings 330, which reciprocate along the length of cam shafts 332, control the motion of the gate 602 and the crossarm 334. The cam shafts 332 are fixed in a precise manner to the main casing through the use of cam shaft support blocks 340. Compression springs 346 are utilized to provide a returning force on the crossarm 334, allowing the cam followers 250 to maintain constant rolling contact with the cams, thereby achieving controlled reciprocating motion of the two-piece gate 602.

Figure 23:
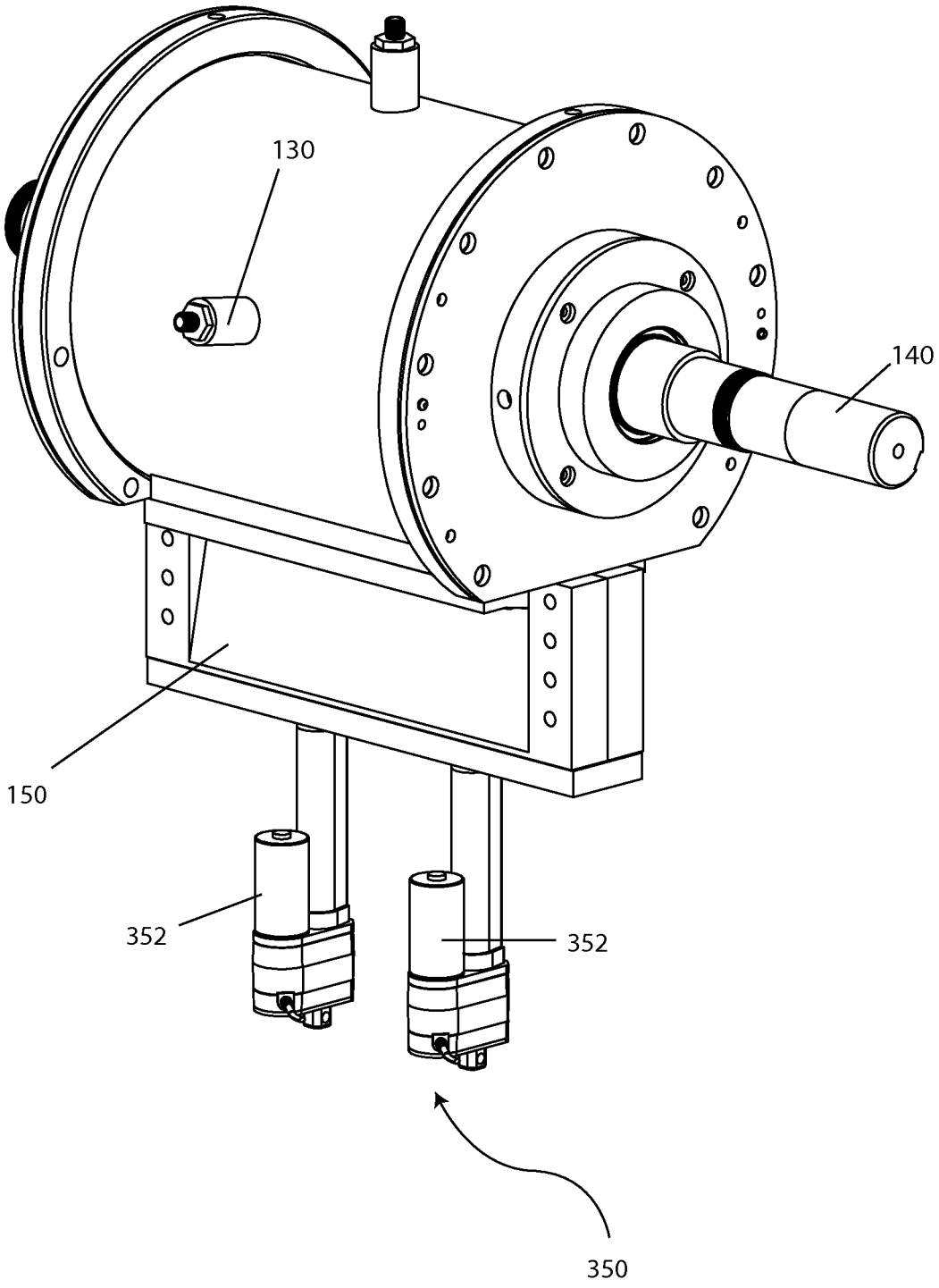
FIG. 23 is perspective view of a rotary compressor with a linear actuator gate positioning system in accordance with an embodiment of the present invention.

FIG. 23 shows an embodiment using a linear actuator system 350 for gate positioning. A pair of linear actuators 352 is used to drive the gate. In this embodiment, it is not necessary to mechanically link the drive shaft to the gate as with other embodiments. The linear actuators 352 are controlled so as to raise and lower the gate in accordance with the rotation of the rotor. The actuators may be electronic, hydraulic, belt-driven, electromagnetic, gas-driven, variable-friction, or other means. The actuators may be computer controlled or controlled by other means.

Figure 24A:
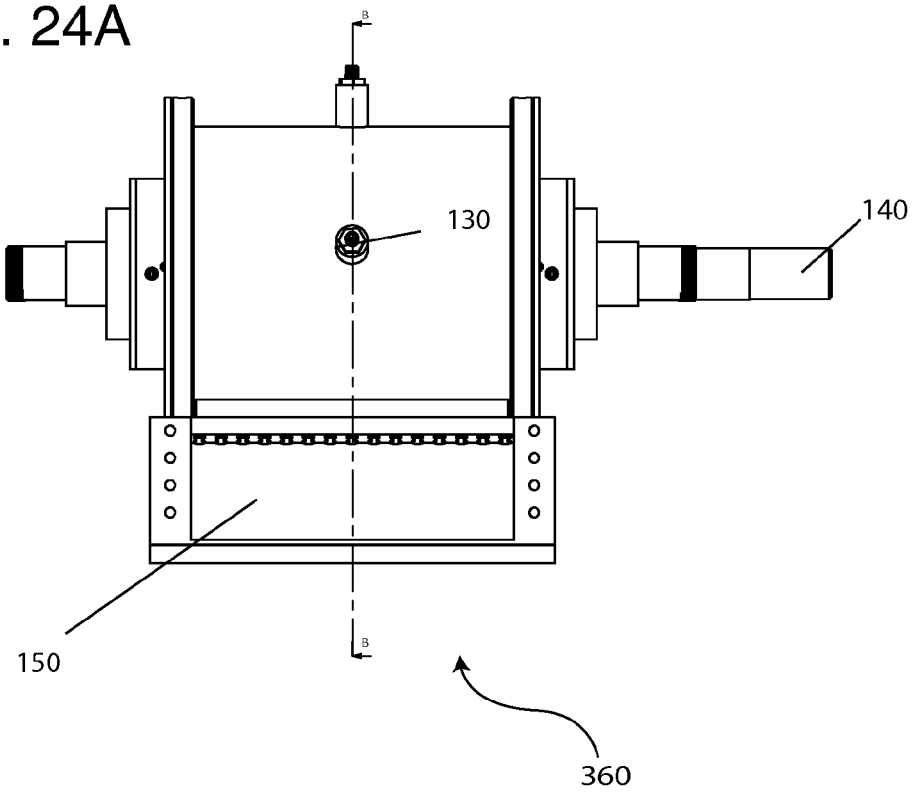
FIGS. 24A and B are right side and cross-section views, respectively, of a rotary compressor with a magnetic drive gate positioning system in accordance with an embodiment of the present invention
Figure 24B:
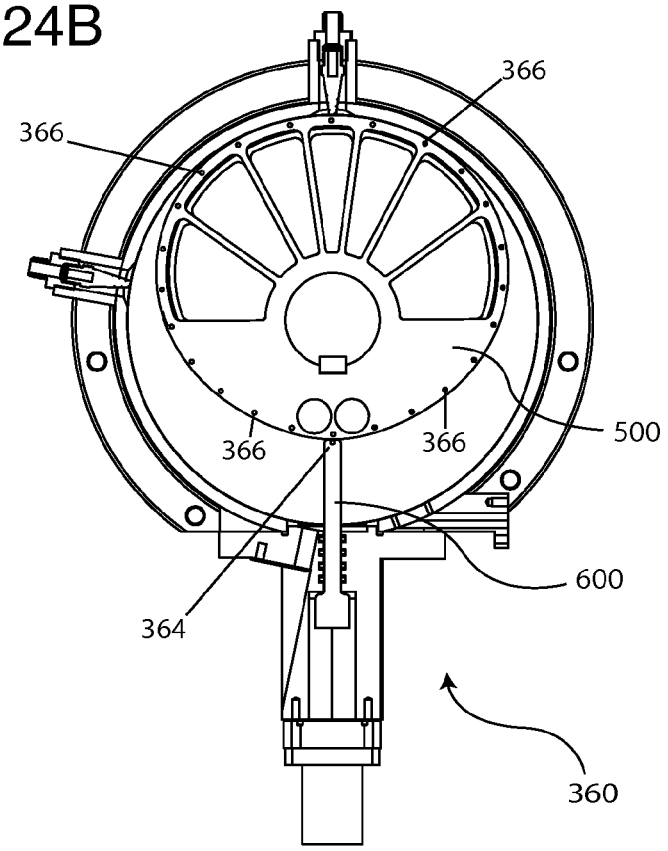

FIGS. 24A and B show a magnetic drive system 360. The gate system may be driven, or controlled, in a reciprocating motion through the placement of magnetic field generators, whether they are permanent magnets or electromagnets, on any combination of the rotor 500, gate 600, and/or gate casing 150. The purpose of this system is to maintain a constant distance from the tip of the gate 600 to the surface of the rotor 500 at all angles throughout the cycle. In a preferred magnetic system embodiment, permanent magnets 366 are mounted into the ends of the rotor 500 and retained. In addition, permanent magnets 364 are installed and retained in the gate 600. Poles of the magnets are aligned so that the magnetic force generated between the rotor's magnets 366 and the gate's magnets 364 is a repulsive force, forcing the gate 600 down throughout the cycle to control its motion and maintain constant distance. To provide an upward, returning force on the gate 600, additional magnets (not shown) are installed into the bottom of the gate 600 and the bottom of the gate casing 150 to provide an additional repulsive force. The magnetic drive systems are balanced to precisely control the gate's reciprocating motion.

Alternative embodiments may use an alternate pole orientation to provide attractive forces between the gate and rotor on the top portion of the gate and attractive forces between the gate and gate casing on the bottom portion of the gate. In place of the lower magnet system, springs may be used to provide a repulsive force. In each embodiment, electromagnets may be used in place of permanent magnets. In addition, switched reluctance electromagnets may also be utilized. In another embodiment, electromagnets may be used only in the rotor and gate. Their poles may switch at each inflection point of the gate's travel during its reciprocating cycle, allowing them to be used in an attractive and repulsive method.

Alternatively, direct hydraulic or indirect hydraulic (hydropneumatic) can be used to apply motive force/energy to the gate to drive it and position it adequately. Solenoid or other flow control valves can be used to feed and regulate the position and movement of the hydraulic or hydropneumatic elements. Hydraulic force may be converted to mechanical force acting on the gate through the use of a cylinder based or direct hydraulic actuators using membranes/diaphragms.

Figure 25:
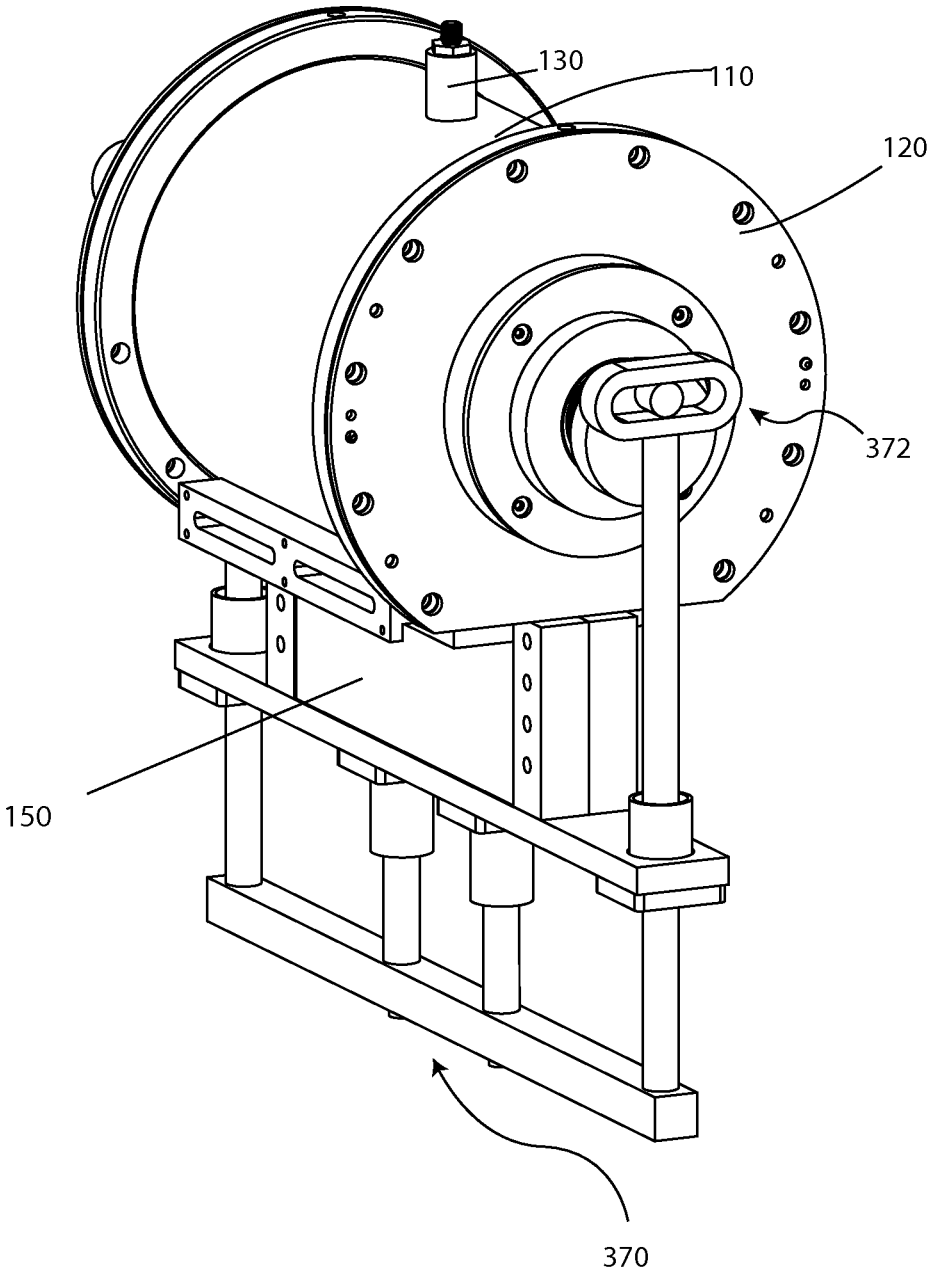
FIG. 25 is perspective view of a rotary compressor with a scotch yoke gate positioning system in accordance with an embodiment of the present invention.

FIG. 25 shows an embodiment using a scotch yoke gate positioning system 370. Here, a pair of scotch yokes 372 is connected to the drive shaft and the bearing support plate. A roller rotates at a fixed radius with respect to the shaft. The roller follows a slot within the yoke 372, which is constrained to a reciprocating motion. The yoke geometry can be manipulated to a specific shape that will result in desired gate dynamics.

As one of skill in the art would appreciate, these alternative drive mechanisms do not require any particular number of linkages between the drive shaft and the gate. For example, a single spring, belt, linkage bar, or yoke could be used. Depending on the design implementation, more than two such elements could be used.

FIGS. 26A-26F show a compression cycle of an embodiment utilizing a tip seal 620. As the drive shaft 140 turns, the rotor 500 and gate strut 210 push up gate 600 so that it is timed with the rotor 500. As the rotor 500 turns clockwise, the gate 600 rises up until the rotor 500 is in the 12 o'clock position shown in FIG. 26C. As the rotor 500 continues to turn, the gate 600 moves downward until it is back at the 6 o'clock position in FIG. 26F. The gate 600 separates the portion of the cylinder that is not taken up by rotor 500 into two components: an intake component 412 and a compression component 414.

Figure 26C:
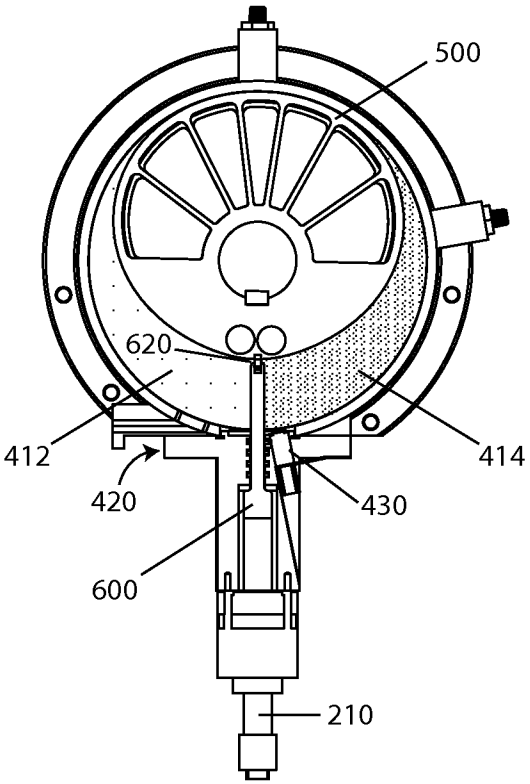
FIGS. 26A-F are cross-sectional views of the inside of an embodiment of a rotary compressor with a contacting tip seal in a compression cycle in accordance with an embodiment of the present invention.
Figure 26B:
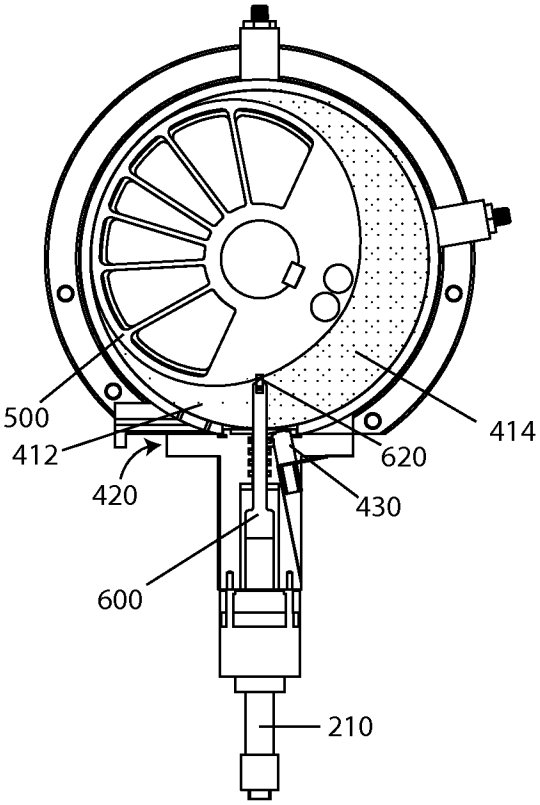
Figure 26A:
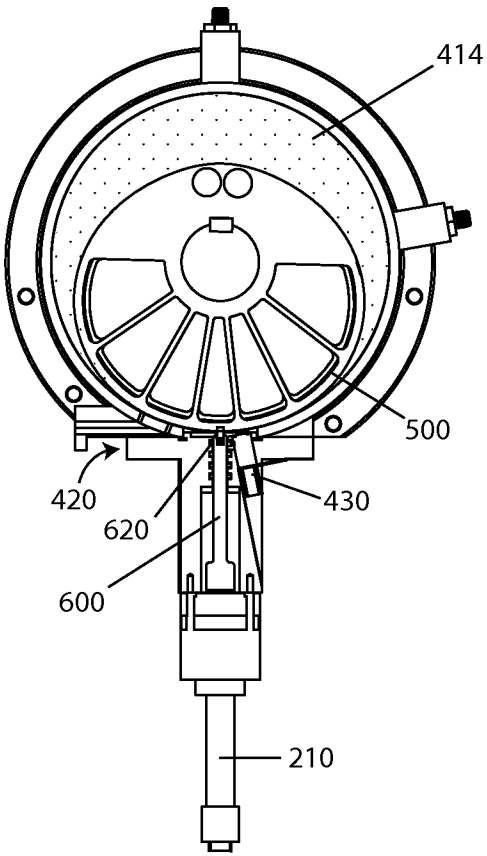
Figure 26F:
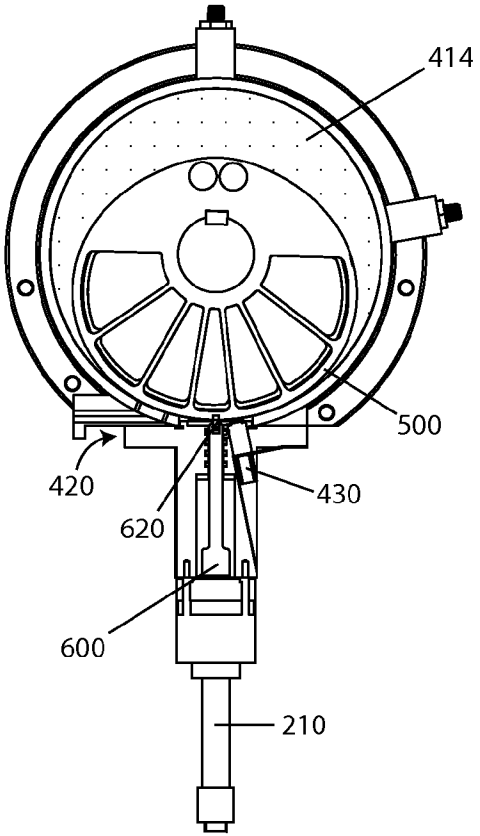
Figure 26E:
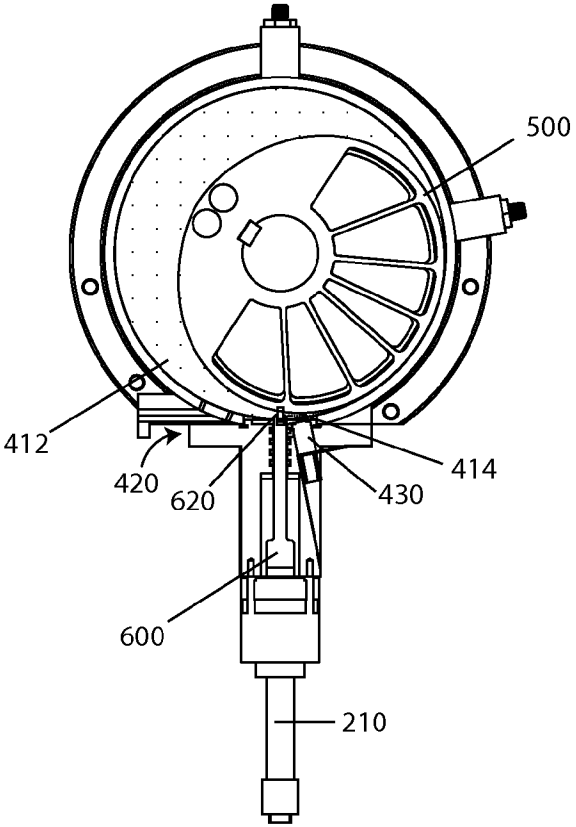
Figure 26D:
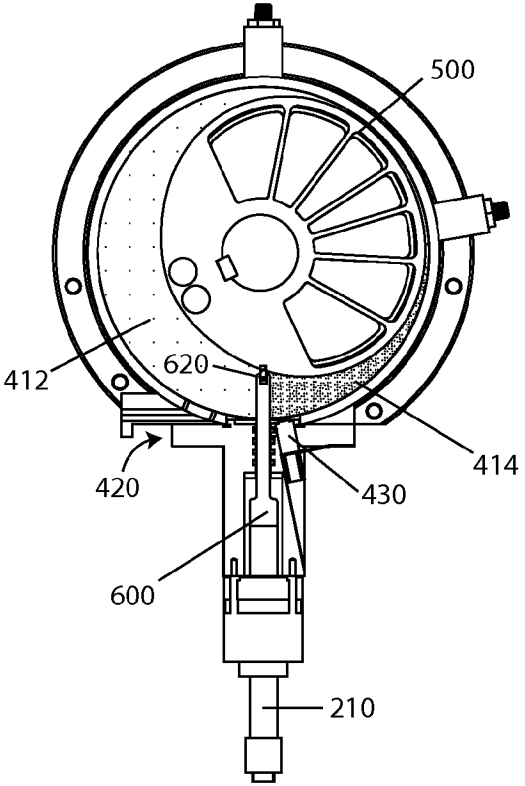
Figure 27C:
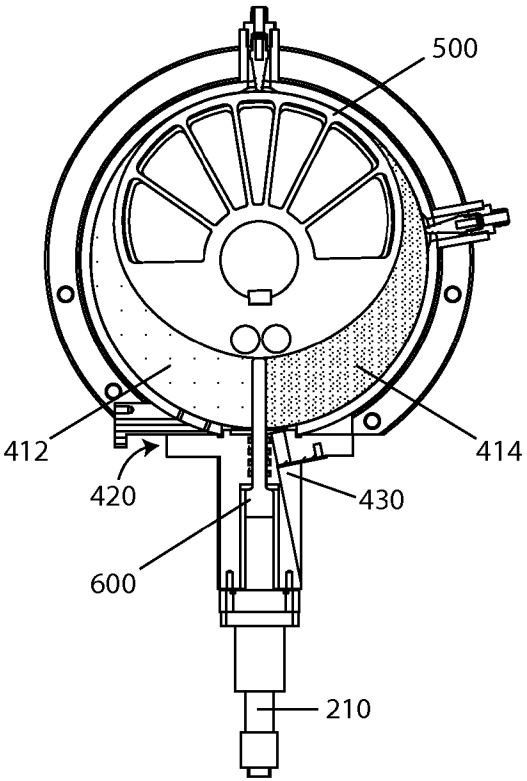
FIGS. 27A-F are cross-sectional views of the inside of an embodiment of a rotary compressor without a contacting tip seal in a compression cycle in accordance with another embodiment of the present invention.
Figure 27B:
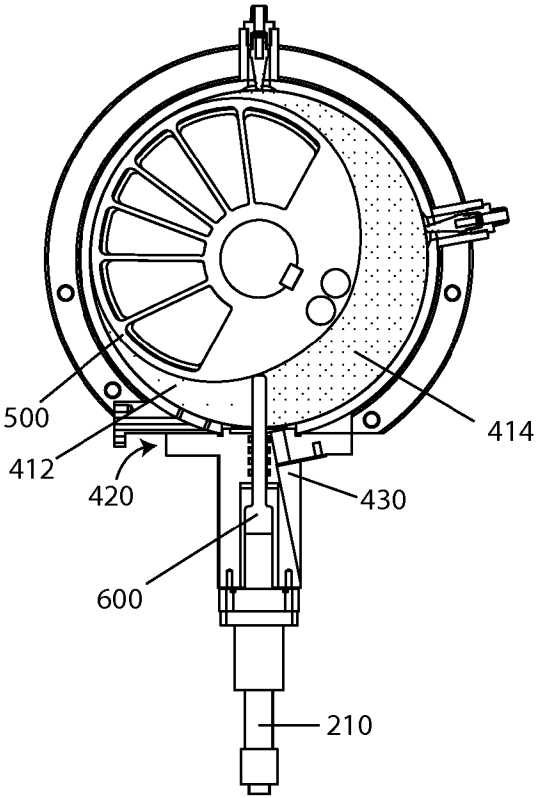
Figure 27A:
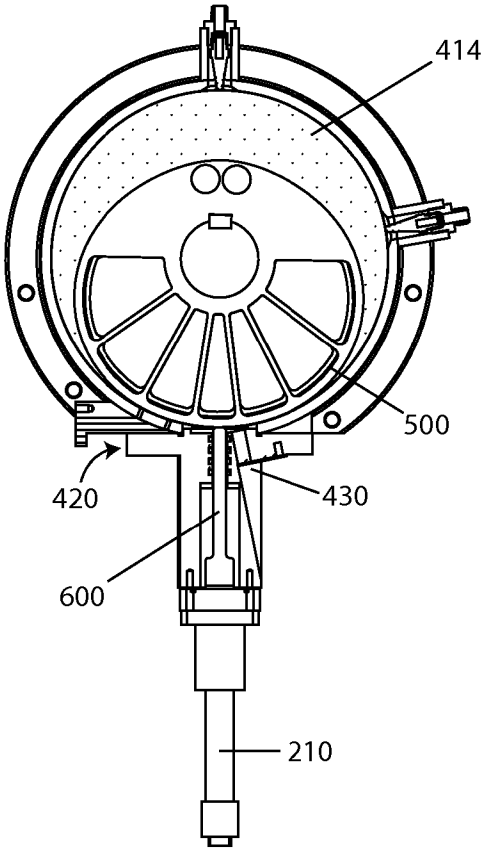
Figure 27F:
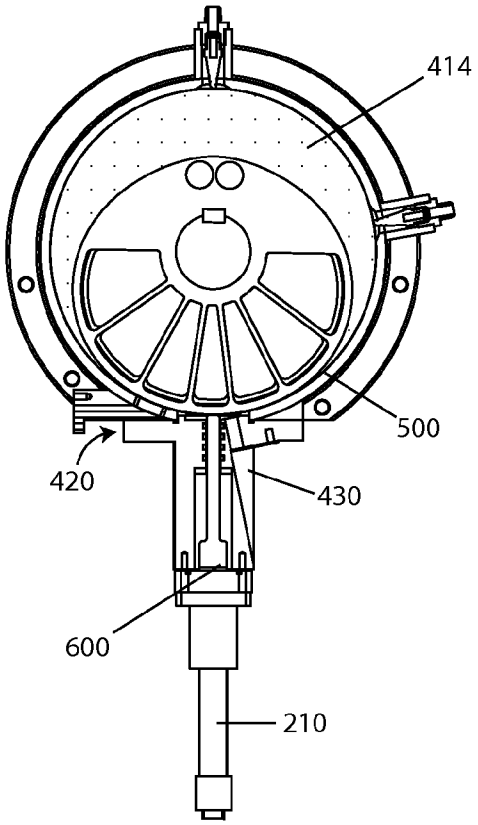
Figure 27E:
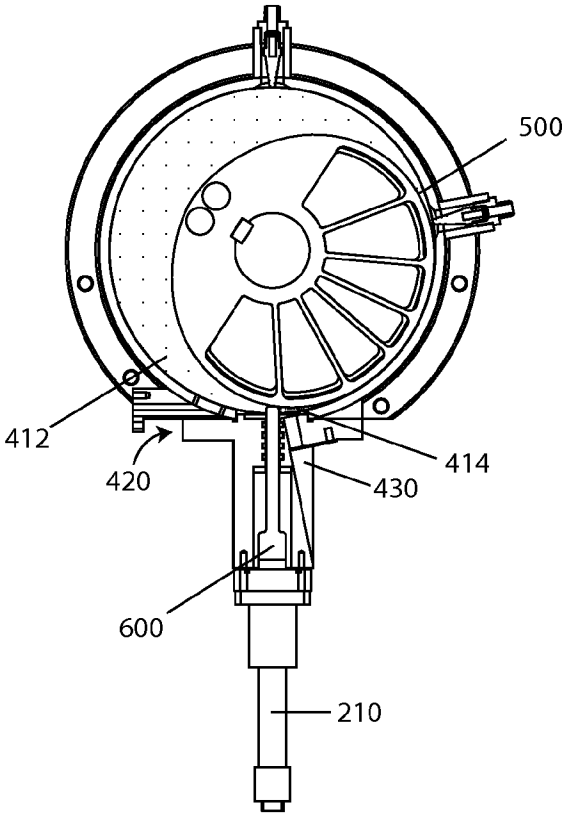
Figure 27D:
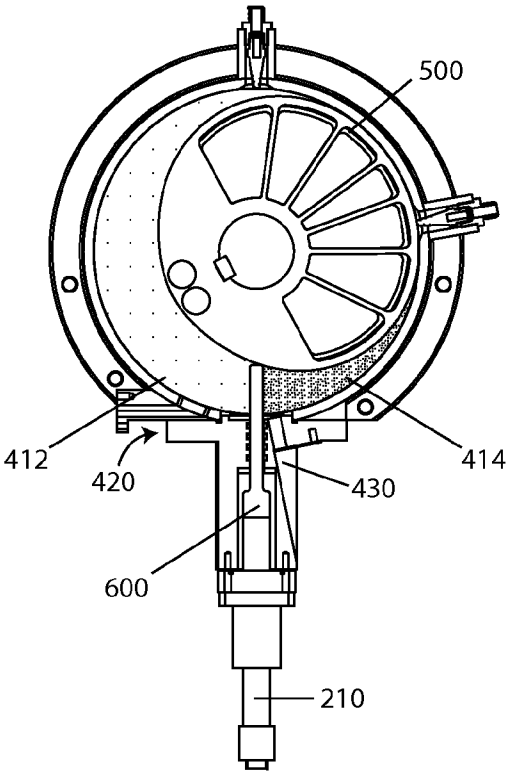

FIGS. 26A-F depict steady state operation. Accordingly, in FIG. 26A, where the rotor 500 is in the 6 o'clock position, the compression volume 414, which constitutes a subset of the rotor casing volume 410, already has received fluid. In FIG. 26B, the rotor 500 has turned clockwise and gate 600 has risen so that the tip seal 620 makes contact with the rotor 500 to separate the intake volume 412, which also constitutes a subset of the rotor casing volume 410, from the compression volume 414. Embodiments using the roller tip 650 discussed below instead of tip seal 620 would operate similarly. As the rotor 500 turns, as shown further in FIGS. 26C-E, the intake volume 412 increases, thereby drawing in more fluid from inlet 420, while the compression volume 414 decreases. As the volume of the compression volume 414 decreases, the pressure increases. The pressurized fluid is then expelled by way of an outlet 430. At a point in the compression cycle when a desired high pressure is reached, the outlet valve opens and the high pressure fluid can leave the compression volume 414. In this embodiment, the valve outputs both the compressed gas and the liquid injected into the compression chamber.

FIGS. 27A-27F show an embodiment in which the gate 600 does not use a tip seal. Instead, the gate 600 is timed to be proximate to the rotor 500 as it turns. The close proximity of the gate 600 to the rotor 500 leaves only a very small path for high pressure fluid to escape. Close proximity in conjunction with the presence of liquid (due to the liquid injectors 136 or an injector placed in the gate itself) allow the gate 600 to effectively create an intake fluid component 412 and a compression component 414. Embodiments incorporating notches 640 would operate similarly.

FIG. 28 shows a cross-sectional perspective view of the rotor casing 400, the rotor 500, and the gate 600. The inlet port 420 shows the path that gas can enter. The outlet 430 is comprised of several holes that serve as outlet ports 435 that lead to outlet valves 440. The gate casing 150 consists of an inlet side 152 and an outlet side 154. A return pressure path (not shown) may be connected to the inlet side 152 of the gate casing 150 and the inlet port 420 to ensure that there is no back pressure build up against gate 600 due to leakage through the gate seals. As one of ordinary skill in the art would appreciate, it is desirable to achieve a hermetic seal, although perfect hermetic sealing is not necessary.

Figure 29:
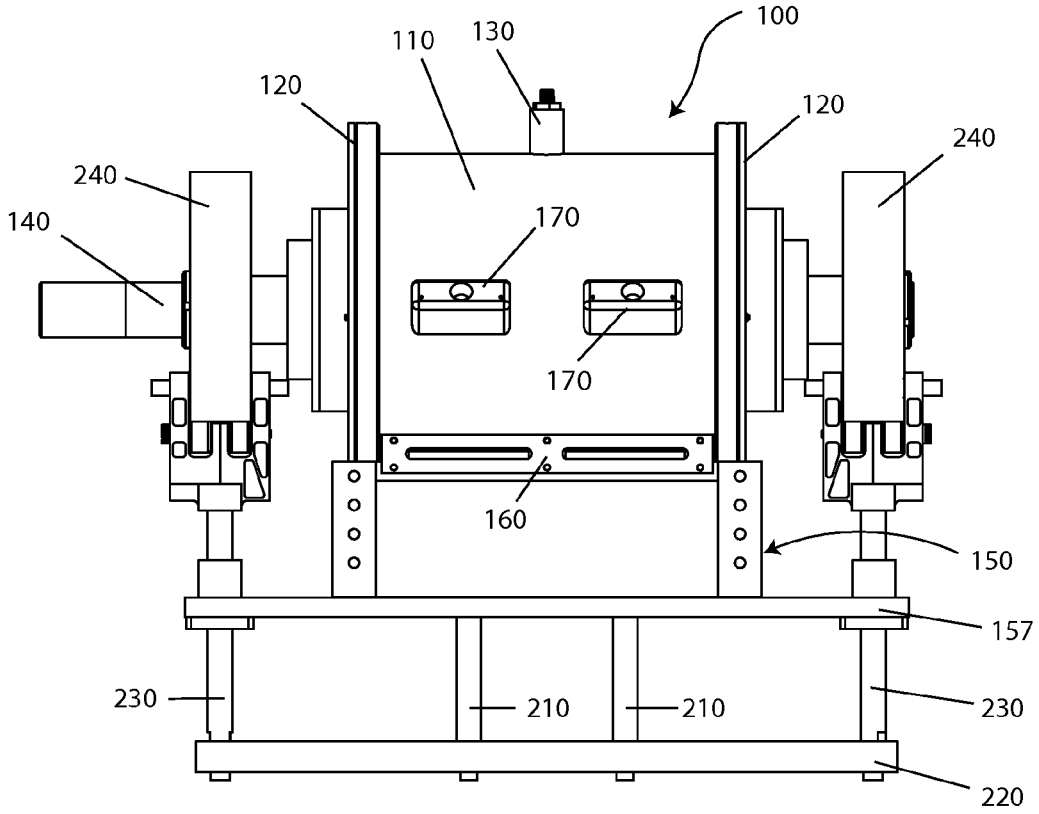
FIG. 29 is a left-side view of an additional liquid injectors embodiment of the present invention.

FIG. 29 shows an alternative embodiment in which flat spray liquid injector housings 170 are located on the main casing 110 at approximately the 3 o'clock position. These injectors can be used to inject liquid directly onto the inlet side of the gate 600, ensuring that it does not reach high temperatures. These injectors also help to provide a coating of liquid on the rotor 500, helping to seal the compressor.

Figure 30:
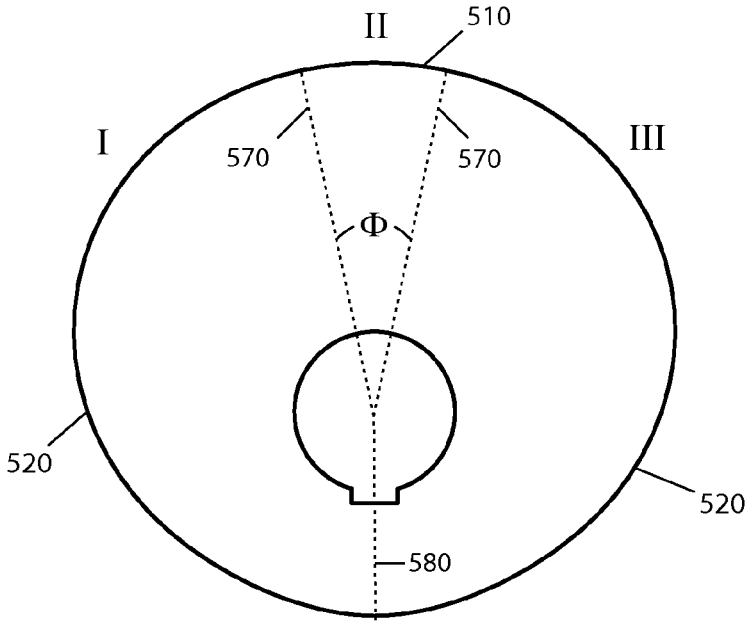
FIG. 30 is a cross-section view of a rotor design in accordance with an embodiment of the present invention.

As discussed above, the preferred embodiments utilize a rotor that concentrically rotates within a rotor casing. In the preferred embodiment, the rotor 500 is a right cylinder with a non-circular cross-section that runs the length of the main casing 110. FIG. 30 shows a cross-sectional view of the sealing and non-sealing portions of the rotor 500. The profile of the rotor 500 is comprised of three sections. The radii in sections I and III are defined by a cycloidal curve. This curve also represents the rise and fall of the gate and defines an optimum acceleration profile for the gate. Other embodiments may use different curve functions to define the radius such as a double harmonic function. Section II employs a constant radius 570, which corresponds to the maximum radius of the rotor. The minimum radius 580 is located at the intersection of sections I and III, at the bottom of rotor 500. In a preferred embodiment, Φ is 23.8 degrees. In alternative embodiments, other angles may be utilized depending on the desired size of the compressor, the desired acceleration of the gate, and desired sealing area.

The radii of the rotor 500 in the preferred embodiment can be calculated using the following functions:

$$r(t) = \begin{cases} r_I = r_{min} + h\left[\frac{t_I}{T} + \sin\left(\frac{2\pi t_I}{T}\right)\right] \\ r_{II} = r_{max} \\ r_{III} = r_{min} + h\left[\frac{t_{III}}{T} + \sin\left(\frac{2\pi t_{III}}{T}\right)\right] \end{cases}$$

In a preferred embodiment, the rotor 500 is symmetrical along one axis. It may generally resemble a cross-sectional egg shape. The rotor 500 includes a hole 530 in which the drive shaft 140 and a key 540 may be mounted. The rotor 500 has a sealing section 510, which is the outer surface of the rotor 500 corresponding to section II, and a non-sealing section 520, which is the outer surface of the rotor 500 corresponding to sections I and III. The sections I and III have a smaller radius than sections II creating a compression volume.

The sealing portion 510 is shaped to correspond to the curvature of the rotor casing 400, thereby creating a dwell seal that effectively minimizes communication between the outlet 430 and inlet 420. Physical contact is not required for the dwell seal. Instead, it is sufficient to create a tortuous path that minimizes the amount of fluid that can pass through. In a preferred embodiment, the gap between the rotor and the casing in this embodiment is less than 0.008 inches. As one of ordinary skill in the art would appreciate, this gap may be altered depending on tolerances, both in machining the rotor 500 and rotor housing 400, temperature, material properties, and other specific application requirements.

Additionally, as discussed below, liquid is injected into the compression chamber. By becoming entrained in the gap between the sealing portion 510 and the rotor casing 400, the liquid can increase the effectiveness of the dwell seal.

Figure 31A:
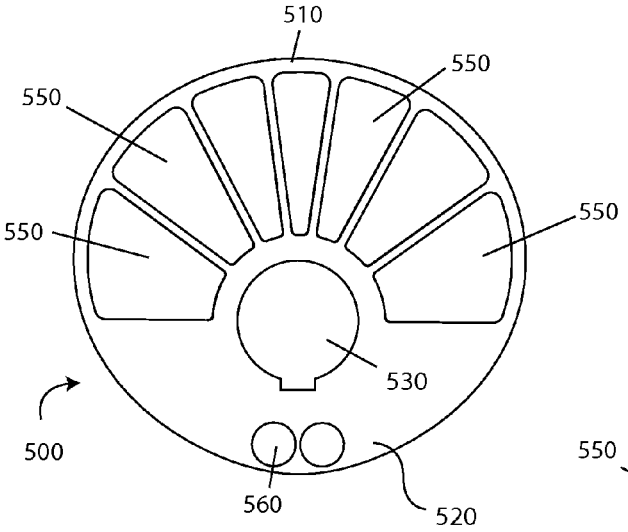
FIGS. 31A-D are cross-sectional views of rotor designs in accordance with various embodiments of the present invention.

As shown in FIG. 31A, the rotor 500 is balanced with cut out shapes and counterweights. Holes, some of which are marked as 550, lighten the rotor 500. Counterweights, one of which is labeled as 560, are made of a denser material than the remainder of the rotor 500. The shapes of the counterweights can vary and do not need to cylindrical.

The rotor design provides several advantages. As shown in the embodiment of FIG. 31A, the rotor 500 includes 7 cutout holes 550 on one side and two counterweights 560 on the other side to allow the center of mass to match the center of rotation. An opening 530 includes space for the drive shaft and a key. This weight distribution is designed to achieve balanced, concentric motion. The number and location of cutouts and counterweights may be changed depending on structural integrity, weight distribution, and balanced rotation parameters.

The cross-sectional shape of the rotor 500 allows for concentric rotation about the drive shaft's axis of rotation, a dwell seal 510 portion, and open space on the non-sealing side for increased gas volume for compression. Concentric rotation provides for rotation about the drive shaft's principal axis of rotation and thus smoother motion and reduced noise.

Figure 31B:
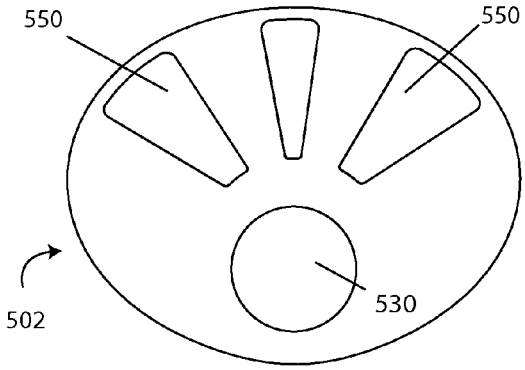
Figure 31C:
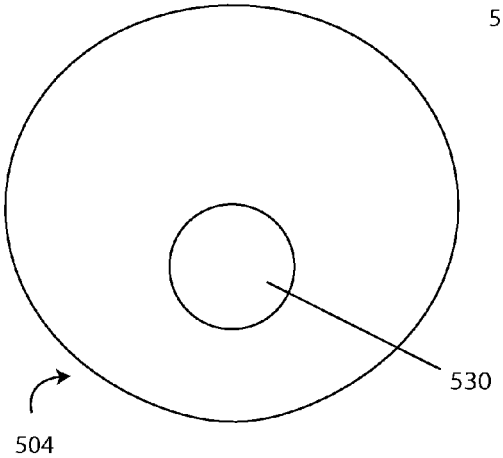
Figure 31D:
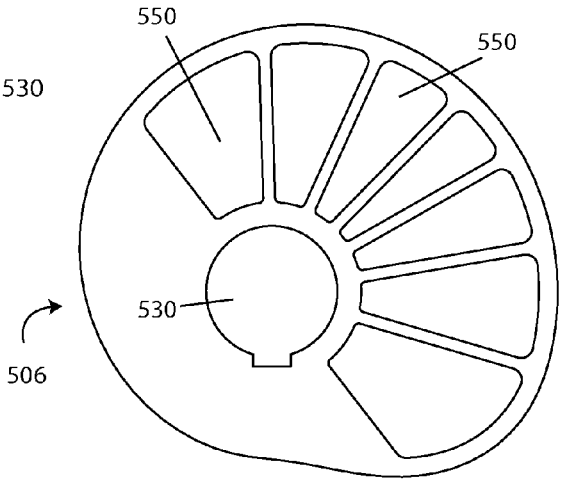

An alternative rotor design 502 is shown in FIG. 31B. In this embodiment, a different arc of curvature is implemented utilizing three holes 550 and a circular opening 530. Another alternative design 504 is shown in FIG. 31C. Here, a solid rotor shape is used and a larger hole 530 (for a larger drive shaft) is implemented. Yet another alternative rotor design 506 is shown in FIG. 31D incorporating an asymmetrical shape, which would smooth the volume reduction curve, allowing for increased time for heat transfer to occur at higher pressures. Alternative rotor shapes may be implemented for different curvatures or needs for increased volume in the compression chamber.

The rotor surface may be smooth in embodiments with contacting tip seals to minimize wear on the tip seal. In alternative embodiments, it may be advantageous to put surface texture on the rotor to create turbulence that may improve the performance of non-contacting seals. In other embodiments, the rotor casing's interior cylindrical wall may further be textured to produce additional turbulence, both for sealing and heat transfer benefits. This texturing could be achieved through machining of the parts or by utilizing a surface coating. Another method of achieving the texture would be through blasting with a waterjet, sandblast, or similar device to create an irregular surface.

The main casing 110 may further utilize a removable cylinder liner. This liner may feature microsurfacing to induce turbulence for the benefits noted above. The liner may also act as a wear surface to increase the reliability of the rotor and casing. The removable liner could be replaced at regular intervals as part of a recommended maintenance schedule. The rotor may also include a liner.

The exterior of the main casing 110 may also be modified to meet application specific parameters. For example, in subsea applications, the casing may require to be significantly thickened to withstand exterior pressure, or placed within a secondary pressure vessel. Other applications may benefit from the exterior of the casing having a rectangular or square profile to facilitate mounting exterior objects or stacking multiple compressors. Liquid may be circulated in the casing interior to achieve additional heat transfer or to equalize pressure in the case of subsea applications for example.

Figure 32A:
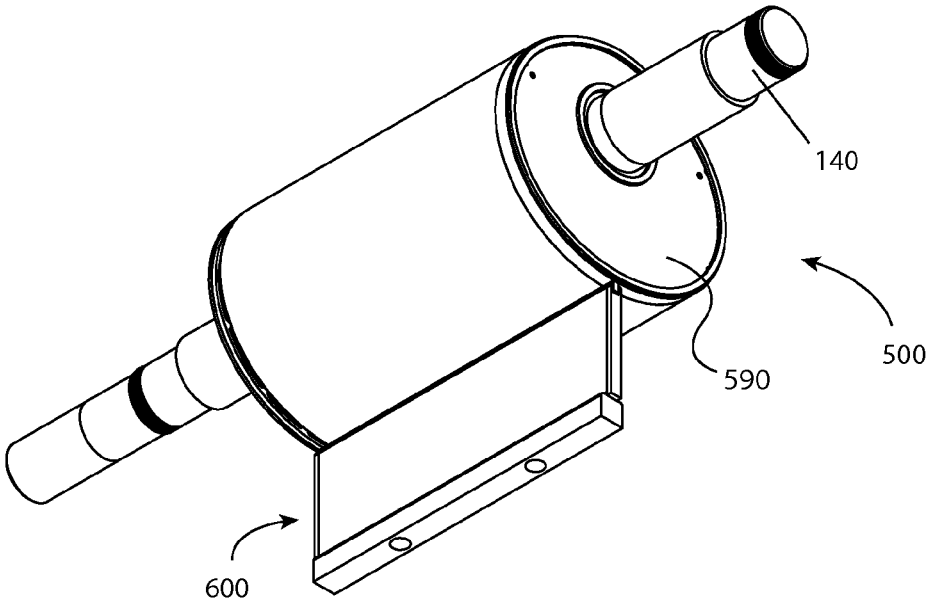
FIGS. 32A and B are perspective and right-side views of a drive shaft, rotor, and gate in accordance with an embodiment of the present invention.
Figure 32B:
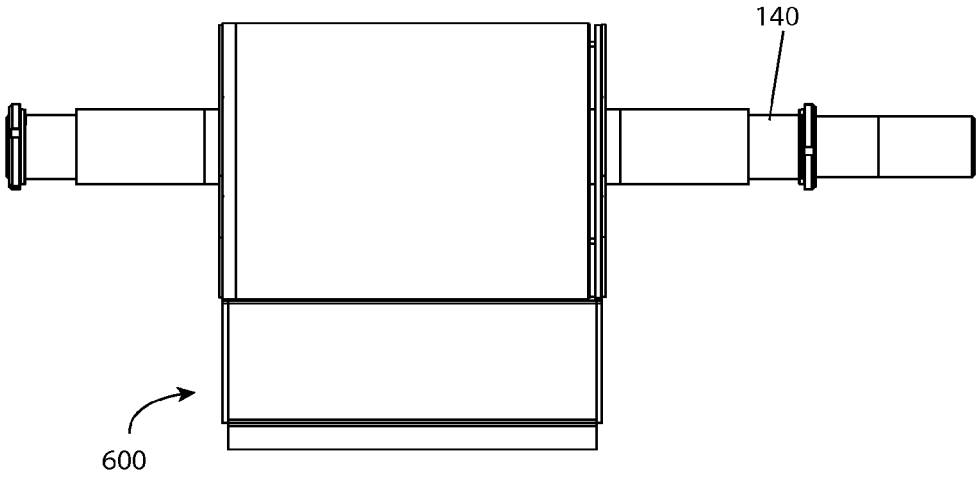
Figure 33:
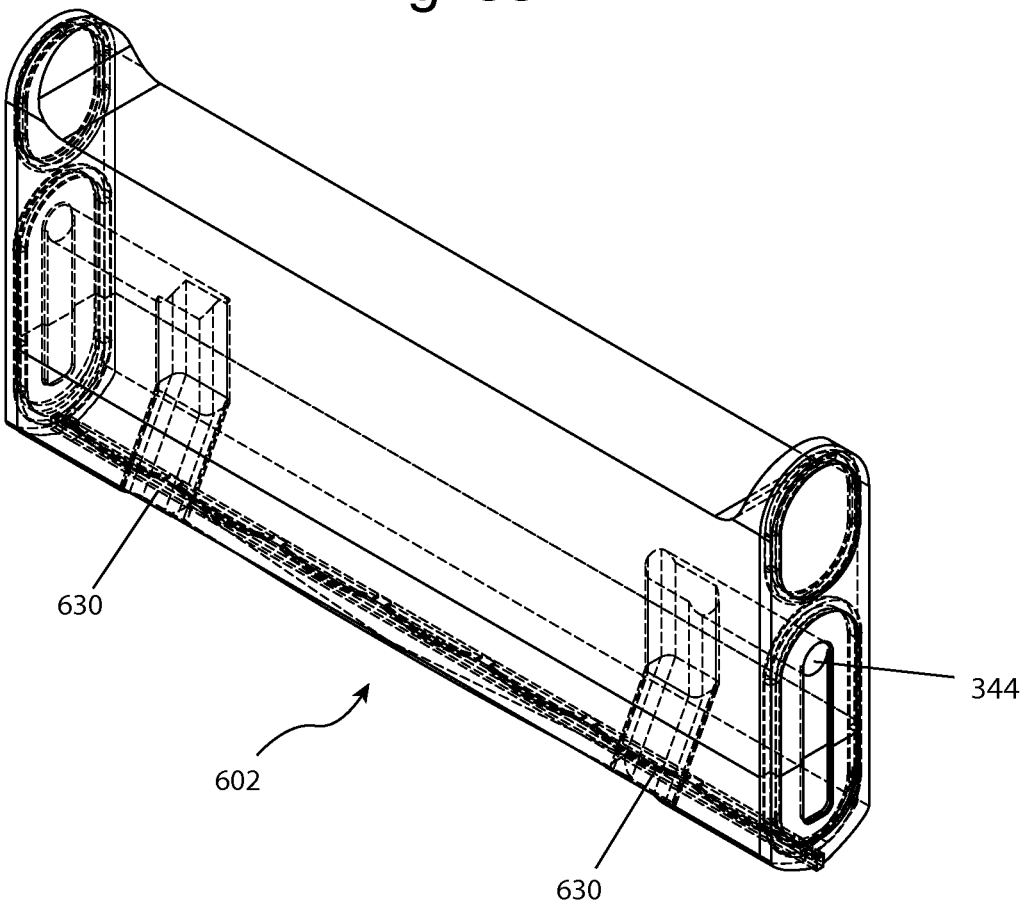
FIG. 33 is a perspective view of a gate with exhaust ports in accordance with an embodiment of the present invention.

As shown in FIGS. 32A and B, the combination of the rotor 500 (here depicted with rotor end caps 590), the gate 600, and drive shaft 140, provide for a more efficient manner of compressing fluids in a cylinder. The gate is aligned along the length of the rotor to separate and define the inlet portion and compression portion as the rotor turns.

The drive shaft 140 is mounted to endplates 120 in the preferred embodiment using one spherical roller bearing in each endplate 120. More than one bearing may be used in each endplate 120, in order to increase total load capacity. A grease pump (not shown) is used to provide lubrication to the bearings. Various types of other bearings may be utilized depending on application specific parameters, including roller bearings, ball bearings, needle bearings, conical bearings, cylindrical bearings, journal bearings, etc. Different lubrication systems using grease, oil, or other lubricants may also be used. Further, dry lubrication systems or materials may be used. Additionally, applications in which dynamic imbalance may occur may benefit from multi-bearing arrangements to support stray axial loads.

Operation of gates in accordance with embodiments of the present invention are shown in FIGS. 8, 17, 22, 24B, 26A-F, 27A-F, 28, 32A-B, and 33-36. As shown in FIGS. 26A-F and 27A-F, gate 600 creates a pressure boundary between an intake volume 412 and a compression volume 414. The intake volume 412 is in communication with the inlet 420. The compression volume 414 is in communication with the outlet 430. Resembling a reciprocating, rectangular piston, the gate 600 rises and falls in time with the turning of the rotor 500.

The gate 600 may include an optional tip seal 620 that makes contact with the rotor 500, providing an interface between the rotor 500 and the gate 600. Tip seal 620 consists of a strip of material at the tip of the gate 600 that rides against rotor 500. The tip seal 620 could be made of different materials, including polymers, graphite, and metal, and could take a variety of geometries, such as a curved, flat, or angled surface. The tip seal 620 may be backed by pressurized fluid or a spring force provided by springs or elastomers. This provides a return force to keep the tip seal 620 in sealing contact with the rotor 500.

Figure 35:
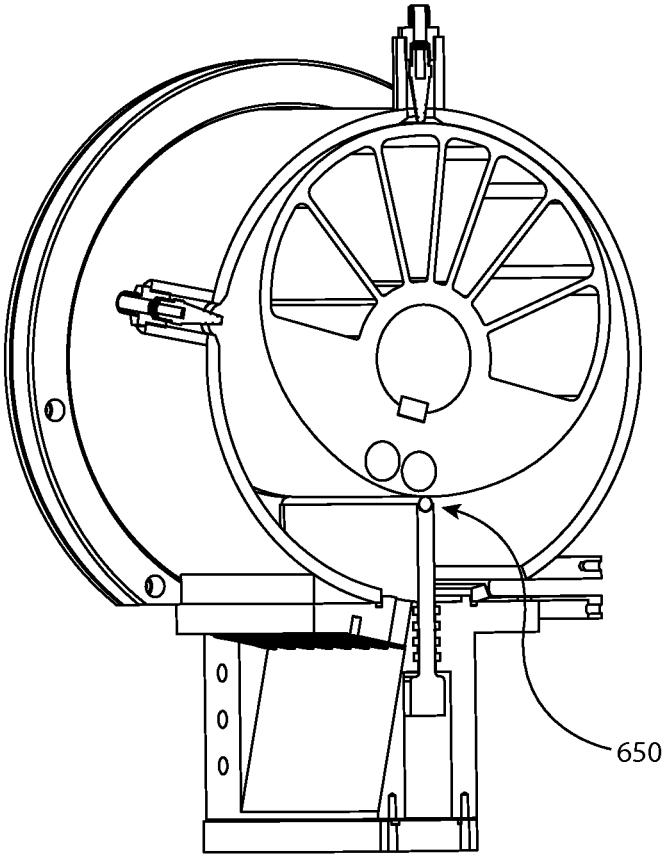
FIG. 35 is a cross-sectional, perspective view a gate with a rolling tip in accordance with an embodiment of the present invention.

Different types of contacting tips may be used with the gate 600. As shown in FIG. 35, a roller tip 650 may be used. The roller tip 650 rotates as it makes contact with the turning rotor 500. Also, tips of differing strengths may be used. For example, a tip seal 620 or roller tip 650 may be made of softer metal that would gradually wear down before the rotor 500 surfaces would wear.

Alternatively, a non-contacting seal may be used. Accordingly, the tip seal may be omitted. In these embodiments, the topmost portion of the gate 600 is placed proximate, but not necessarily in contact with, the rotor 500 as it turns. The amount of allowable gap may be adjusted depending on application parameters.

Figure 34A:
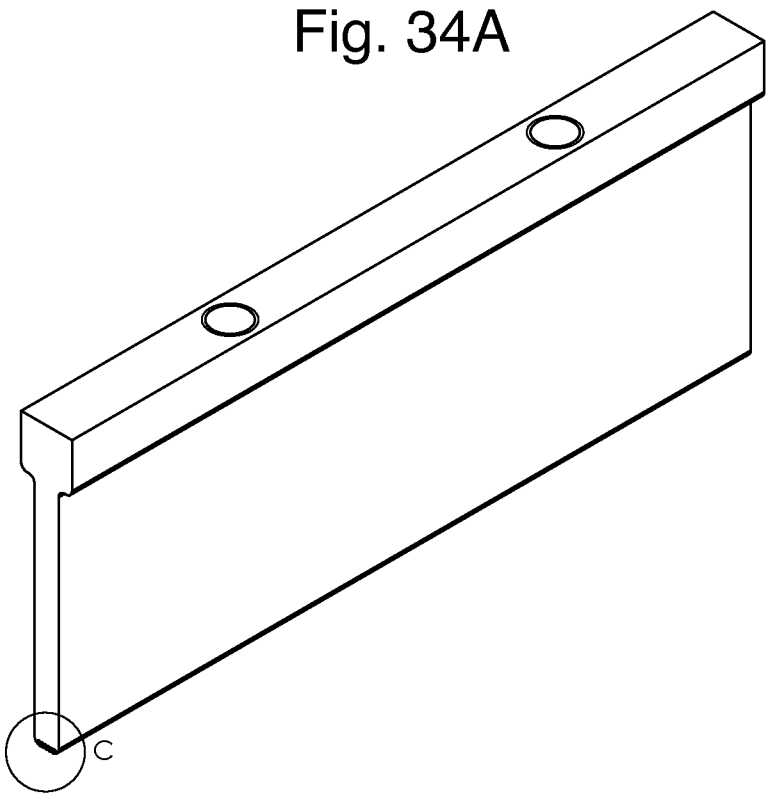
FIGS. 34A and B are a perspective view and magnified view of a gate with notches, respectively, in accordance with an embodiment of the present invention.
Figure 34B:
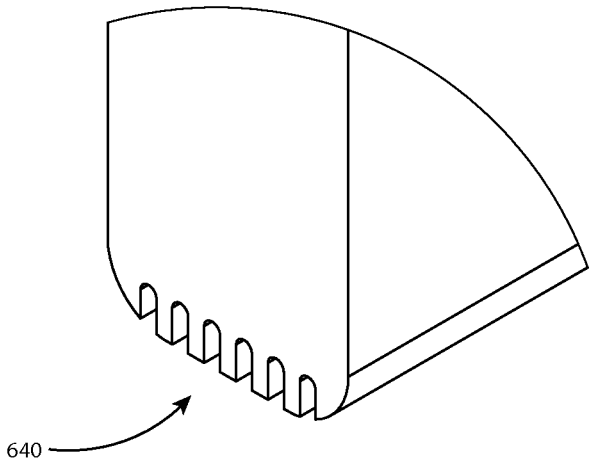

As shown in FIGS. 34A and 34B, in an embodiment in which the tip of the gate 600 does not contact the rotor 500, the tip may include notches 640 that serve to keep gas pocketed against the tip of the gate 600. The entrained fluid, in either gas or liquid form, assists in providing a non-contacting seal. As one of ordinary skill in the art would appreciate, the number and size of the notches is a matter of design choice dependent on the compressor specifications.

Figure 36:
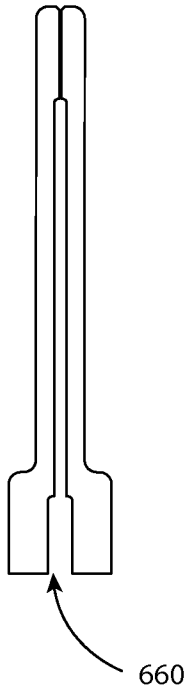
FIG. 36 is a cross-sectional front view of a gate with a liquid injection channel in accordance with an embodiment of the present invention.

Alternatively, liquid may be injected from the gate itself. As shown in FIG. 36, a cross-sectional view of a portion of a gate, one or more channels 660 from which a fluid may pass may be built into the gate. In one such embodiment, a liquid can pass through a plurality of channels 660 to form a liquid seal between the topmost portion of the gate 600 and the rotor 500 as it turns. In another embodiment, residual compressed fluid may be inserted through one or more channels 660. Further still, the gate 600 may be shaped to match the curvature of portions of the rotor 500 to minimize the gap between the gate 600 and the rotor 500.

Preferred embodiments enclose the gate in a gate casing. As shown in FIGS. 8 and 17, the gate 600 is encompassed by the gate casing 150, including notches, one of which is shown as item 158. The notches hold the gate seals, which ensure that the compressed fluid will not release from the compression volume 414 through the interface between gate 600 and gate casing 150 as gate 600 moves up and down. The gate seals may be made of various materials, including polymers, graphite or metal. A variety of different geometries may be used for these seals. Various embodiments could utilize different notch geometries, including ones in which the notches may pass through the gate casing, in part or in full.

The seals may use energizing forces provided by springs or elastomers with the assembly of the gate casing 150 inducing compression on the seals. Pressurized fluid may also be used to energize the seals.

A rotor face seal may also be placed on the rotor 500 to provide for an interface between the rotor 500 and the endplates 120. An outer rotor face seal is placed along the exterior edge of the rotor 500, preventing fluid from escaping past the end of the rotor 500. A secondary inner rotor face seal is placed on the rotor face at a smaller radius to prevent any fluid that escapes past the outer rotor face seal from escaping the compressor entirely. This seal may use the same or other materials as the gate seal. Various geometries may be used to optimize the effectiveness of the seals. These seals may use energizing forces provided by springs, elastomers or pressurized fluid.

Minimizing the possibility of fluids leaking to the exterior of the main housing 100 is desirable. Various seals, such as gaskets and o-rings, are used to seal external connections between parts. For example, in a preferred embodiment, a double o-ring seal is used between the main casing 110 and endplates 120. Further seals are utilized around the drive shaft 140 to prevent leakage of any fluids making it past the rotor face seals. A lip seal is used to seal the drive shaft 140 where it passes through the endplates 120. Other forms of seals could also be used, such as mechanical or labyrinth seals.

It is desirable to achieve near isothermal compression. To provide cooling during the compression process, liquid injection is used. In preferred embodiments, the liquid is atomized to provide increased surface area for heat absorption. In other embodiments, different spray applications or other means of injecting liquids may be used.

Liquid injection is used to cool the fluid as it is compressed, increasing the efficiency of the compression process. Cooling allows most of the input energy to be used for compression rather than heat generation in the gas. The liquid has dramatically superior heat absorption characteristics compared to gas, allowing the liquid to absorb heat and minimize temperature increase of the working fluid, achieving near isothermal compression. As shown in FIGS. 8 and 17, liquid injector assemblies 130 are attached to the main casing 110. Liquid injector housings 132 include an adapter for the liquid source 134 (if it is not included with the nozzle) and a nozzle 136. Liquid is injected by way of a nozzle 136 directly into the rotor casing volume 410.

The amount and timing of liquid injection may be controlled by a variety of implements including a computer-based controller capable of measuring the liquid drainage rate, liquid levels in the chamber, and/or any rotational resistance due to liquid accumulation through a variety of sensors. Valves or solenoids may be used in conjunction with the nozzles to selectively control injection timing. Variable orifice control may also be used to regulate the amount of liquid injection and other characteristics.

Analytical and experimental results are used to optimize the number, location, and spray direction of the injectors 136. These injectors 136 may be located in the periphery of the cylinder. Liquid injection may also occur through the rotor or gate. The current embodiment of the design has two nozzles located at 12 o'clock and 10 o'clock. Different application parameters will also influence preferred nozzle arrays.

The nozzle array is designed for a high flow rate of greater than 5 gallons per minute and to be capable of extremely small droplet sizes of 150 microns or less at a low differential pressure of less than 100 psi. Two exemplary nozzles are Spraying Systems Co. Part Number: 1/4HHSJ-SS12007 and Bex Spray Nozzles Part Number: 1/4YS12007. The preferred flow rate and droplet size ranges will vary with application parameters. Alternative nozzle styles may also be used. For example, one embodiment may use micro-perforations in the cylinder through which to inject liquid, counting on the small size of the holes to create sufficiently small droplets. Other embodiments may include various off the shelf or custom designed nozzles which, when combined into an array, meet the injection requirements necessary for a given application.

As discussed above, the rate of heat transfer is improved by using such atomizing nozzles to inject very small droplets of liquid into the compression chamber. Because the rate of heat transfer is proportional to the surface area of liquid across which heat transfer can occur, the creation of smaller droplets improves cooling. Numerous cooling liquids may be used. For example, water, triethylene glycol, and various types of oils and other hydrocarbons may be used. Ethylene glycol, propylene glycol, methanol or other alcohols in case phase change characteristics are desired may be used. Refrigerants such as ammonia and others may also be used. Further, various additives may be combined with the cooling liquid to achieve desired characteristics. Along with the heat transfer and heat absorption properties of the liquid helping to cool the compression process, vaporization of the liquid may also be utilized in some embodiments of the design to take advantage of the large cooling effect due to phase change.

The effect of liquid coalescence is also addressed in the preferred embodiments. Liquid accumulation can provide resistance against the compressing mechanism, eventually resulting in hydrolock in which all motion of the compressor is stopped, causing potentially irreparable harm. As is shown in the embodiments of FIGS. 8 and 17, the inlet 420 and outlet 430 are located at the bottom of the rotor casing 400 on opposite sides of the gate 600, thus providing an efficient location for both intake of fluid to be compressed and exhausting of compressed fluid and the injected liquid. A valve is not necessary at the inlet 420. The inclusion of a dwell seal allows the inlet 420 to be an open port, simplifying the system and reducing inefficiencies associated with inlet valves. However, if desirable, an inlet valve could also be incorporated. Additional features may be added at the inlet to induce turbulence to provide enhanced thermal transfer and other benefits. Hardened materials may be used at the inlet and other locations of the compressor to protect against cavitation when liquid/gas mixtures enter into choke and other cavitation-inducing conditions.

Alternative embodiments may include an inlet located at positions other than shown in the figures. Additionally, multiple inlets may be located along the periphery of the cylinder. These could be utilized in isolation or combination to accommodate inlet streams of varying pressures and flow rates. The inlet ports can also be enlarged or moved, either automatically or manually, to vary the displacement of the compressor.

In these embodiments, multi-phase compression is utilized, thus the outlet system allows for the passage of both gas and liquid. Placement of outlet 430 near the bottom of the rotor casing 400 provides for a drain for the liquid. This minimizes the risk of hydrolock found in other liquid injection compressors. A small clearance volume allows any liquids that remain within the chamber to be accommodated. Gravity assists in collecting and eliminating the excess liquid, preventing liquid accumulation over subsequent cycles. Additionally, the sweeping motion of the rotor helps to ensure that most liquid is removed from the compressor during each compression cycle.

Outlet valves allow gas and liquid to flow out of the compressor once the desired pressure within the compression chamber is reached. Due to the presence of liquid in the working fluid, valves that minimize or eliminate changes in direction for the outflowing working fluid are desirable. This prevents the hammering effect of liquids as they change direction. Additionally, it is desirable to minimize clearance volume.

Reed valves may be desirable as outlet valves. As one of ordinary skill in the art would appreciate, other types of valves known or as yet unknown may be utilized. Hoerbiger type R, CO, and Reed valves may be acceptable. Additionally, CT, HDS, CE, CM or Poppet valves may be considered. Other embodiments may use valves in other locations in the casing that allow gas to exit once the gas has reached a given pressure. In such embodiments, various styles of valves may be used. Passive or directly-actuated valves may be used and valve controllers may also be implemented.

In the presently preferred embodiments, the outlet valves are located near the bottom of the casing and serve to allow exhausting of liquid and compressed gas from the high pressure portion. In other embodiments, it may be useful to provide additional outlet valves located along periphery of main casing in locations other than near the bottom. Some embodiments may also benefit from outlets placed on the endplates. In still other embodiments, it may be desirable to separate the outlet valves into two types of valves—one predominately for high pressured gas, the other for liquid drainage. In these embodiments, the two or more types of valves may be located near each other, or in different locations.

As shown in FIGS. 8 and 17, the sealing portion 510 of the rotor effectively precludes fluid communication between the outlet and inlet ports by way of the creation of a dwell seal. The interface between the rotor 500 and gate 600 further precludes fluid communication between the outlet and inlet ports through use of a non-contacting seal or tip seal 620. In this way, the compressor is able to prevent any return and venting of fluid even when running at low speeds. Existing rotary compressors, when running at low speeds, have a leakage path from the outlet to the inlet and thus depend on the speed of rotation to minimize venting/leakage losses through this flowpath.

The high pressure working fluid exerts a large horizontal force on the gate 600. Despite the rigidity of the gate struts 210, this force will cause the gate 600 to bend and press against the inlet side of the gate casing 152. Specialized coatings that are very hard and have low coefficients of friction can coat both surfaces to minimize friction and wear from the sliding of the gate 600 against the gate casing 152. A fluid bearing can also be utilized. Alternatively, pegs (not shown) can extend from the side of the gate 600 into gate casing 150 to help support the gate 600 against this horizontal force.

The large horizontal forces encountered by the gate may also require additional considerations to reduce sliding friction of the gate's reciprocating motion. Various types of lubricants, such as greases or oils may be used. These lubricants may further be pressurized to help resist the force pressing the gate against the gate casing. Components may also provide a passive source of lubrication for sliding parts via lubricant-impregnated or self-lubricating materials. In the absence of, or in conjunction with, lubrication, replaceable wear elements may be used on sliding parts to ensure reliable operation contingent on adherence to maintenance schedules. As one of ordinary skill in the art would appreciate, replaceable wear elements may also be utilized on various other wear surfaces within the compressor.

The compressor structure may be comprised of materials such as aluminum, carbon steel, stainless steel, titanium, tungsten, or brass. Materials may be chosen based on corrosion resistance, strength, density, and cost. Seals may be comprised of polymers, such as PTFE, HDPE, PEEK™, acetal copolymer, etc., graphite, cast iron, or ceramics. Other materials known or unknown may be utilized. Coatings may also be used to enhance material properties.

As one of ordinary skill in the art can appreciate, various techniques may be utilized to manufacture and assemble the invention that may affect specific features of the design. For example, the main casing 110 may be manufactured using a casting process. In this scenario, the nozzle housings 132, gate casing 150, or other components may be formed in singularity with the main casing 110. Similarly, the rotor 500 and drive shaft 140 may be built as a single piece, either due to strength requirements or chosen manufacturing technique.

Further benefits may be achieved by utilizing elements exterior to the compressor envelope. A flywheel may be added to the drive shaft 140 to smooth the torque curve encountered during the rotation. A flywheel or other exterior shaft attachment may also be used to help achieve balanced rotation. Applications requiring multiple compressors may combine multiple compressors on a single drive shaft with rotors mounted out of phase to also achieve a smoothened torque curve. A bell housing or other shaft coupling may be used to attach the drive shaft to a driving force such as engine or electric motor to minimize effects of misalignment and increase torque transfer efficiency. Accessory components such as pumps or generators may be driven by the drive shaft using belts, direct couplings, gears, or other transmission mechanisms. Timing gears or belts may further be utilized to synchronize accessory components where appropriate.

After exiting the valves the mix of liquid and gases may be separated through any of the following methods or a combination thereof: 1. Interception through the use of a mesh, vanes, intertwined fibers; 2. Inertial impaction against a surface; 3. Coalescence against other larger injected droplets; 4. Passing through a liquid curtain; 5. Bubbling through a liquid reservoir; 6. Brownian motion to aid in coalescence; 7. Change in direction; 8. Centrifugal motion for coalescence into walls and other structures; 9. Inertia change by rapid deceleration; and 10. Dehydration through the use of adsorbents or absorbents.

At the outlet of the compressor, a pulsation chamber may consist of cylindrical bottles or other cavities and elements, may be combined with any of the aforementioned separation methods to achieve pulsation dampening and attenuation as well as primary or final liquid coalescence. Other methods of separating the liquid and gases may be used as well.

The presently preferred embodiments could be modified to operate as an expander. Further, although descriptions have been used to describe the top and bottom and other directions, the orientation of the elements (e.g. the gate 600 at the bottom of the rotor casing 400) should not be interpreted as limitations on the present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

It is therefore intended that the foregoing detailed description be regarded as illustrative rather than limiting, and that it be understood that it is the following claims, including all equivalents, that are intended to define the spirit and scope of this invention. To the extent that "at least one" is used to highlight the possibility of a plurality of elements that may satisfy a claim element, this should not be interpreted as requiring "a" to mean singular only. "A" or "an" element may still be satisfied by a plurality of elements unless otherwise stated.

The invention claimed is:

1. A positive displacement compressor, comprising:

a compression chamber, including a cylindrical-shaped casing having a first end, a second end, and an inner curved surface;

a shaft located axially in the compression chamber;

a non-circular rotor mounted for rotation with the shaft relative to the casing, the non-circular rotor having a sealing portion, the sealing portion having a curved surface that corresponds with the inner curved surface of the cylindrical-shaped casing, and a non-sealing portion;

a gate, the gate having a first end and a second end; and a gate positioning system, the gate positioning system operable to locate the first end of the gate proximate to the non-circular rotor as the rotor turns, wherein the gate positioning system comprises at least one cam that drives the gate positioning system, wherein the gate positioning system comprises:

at least one cam follower connected to the at least one cam; and a gate support arm connecting the gate to the earn follower such that movement of the at least one cam follower causes movement of the gate, and wherein the gate positioning system comprises at least one spring connected to the cam follower so as to urge the cam follower to maintain contact with the cam.

2. The positive displacement compressor of claim 1, further comprising at least one liquid injection nozzle located to provide injected fluids into the compression chamber, wherein the at least one liquid injection nozzle is configured to provide an atomized liquid spray.

3. The positive displacement compressor of claim 1, further comprising at least one liquid injector positioned to inject liquid into an area within the compression chamber where compression occurs during operation of the compressor.

4. The positive displacement compressor of claim 1, wherein:

the rotor has a first end and a second end aligned horizontally;

the gate is located at the bottom of the casing and operable to move up and down;

an inlet is located on the casing on one side of the gate; and an outlet port is located on the casing on the opposite side of the gate.

5. The positive displacement compressor of claim 1, wherein the compressor is configured to be oriented such that the rotor rotates about a horizontal axis during operation of the compressor.

6. The positive displacement compressor of claim 1, wherein a portion of the gate positioning system is disposed outside of the compression chamber.

7. The positive displacement compressor of claim 1, wherein the cam is disposed outside of the compression chamber.

8. The positive displacement compressor of claim 1, further comprising an outlet port located near the cross-sectional bottom of the cylindrical casing.

9. A positive displacement compressor, comprising:

a compression chamber defined by an interior of a casing having a first end, a second end;

a shaft located in the compression chamber and mounted to the casing for rotation relative to the casing;

a rotor disposed in the compression chamber and mounted for rotation with the shaft relative to the casing, the rotor having a sealing portion;

a gate having a first end and a second end; and a gate positioning system operable to locate the first end of the gate proximate to the rotor as the rotor turns, wherein a portion of the gate positioning system is disposed outside of the compression chamber, wherein the gate positioning system comprises at least one cam that drives the gate positioning system, wherein the gate positioning system comprises:

at least one cam follower connected to the at least one cam; and a gate support arm connecting the gate to the cam follower such that movement of the at least one cam follower causes movement of the gate, and wherein the gate positioning system comprises at least one spring connected to the cam follower so as to urge the cam follower to maintain contact with the cam.

10. A positive displacement compressor, comprising;

a cylindrical rotor casing, the rotor casing having an inlet port, an outlet port, and an inner wall defining a rotor casing volume;

a rotor, the rotor having a sealing portion that corresponds to a curvature of the inner wall of the rotor casing;

at least one liquid injector connected with the rotor casing to inject liquids into the rotor casing volume; and a gate, having a first end and a second end, and operable to move within the rotor casing to locate the first end proximate to the rotor as it turns;

wherein the gate separates an inlet volume and a compression volume in the rotor casing volume, the inlet port is configured to enable suction in of gas, and the outlet is configured to enable expulsion of both liquid and gas, wherein the compressor further comprises a gate positioning system operable to locate the first end of the gate proximate to the rotor as the rotor turns, wherein the gate positioning system comprises at least one cam that drives the gate positioning system, wherein the gate positioning system comprises:

at least one cam follower connected to the at least one cam; and a gate support arm connecting the gate to the cam follower such that movement of the at least one cam follower causes movement of the gate, and wherein the gate positioning,system comprises at least one spring connected to the cam follower so as to urge the cam follower to maintain contact with the cam.

11. The positive displacement compressor of claim 10, further comprising a gate positioning system operable to locate the first end of the gate proximate to the rotor as the rotor turns, wherein a portion of the gate positioning system is disposed outside of a compression chamber of the compressor.

12. The positive displacement compressor of claim 10, further comprising a drive shaft, and wherein the rotor is rigidly mounted to the drive shaft for rotation with the drive shaft relative to the rotor casing.

13. The positive displacement compressor of claim 12, wherein the at least one cam is mounted for concentric rotation around the drive shaft.

14. The positive displacement compressor of claim 10, further comprising an outlet port located near the cross-sectional bottom of the cylindrical rotor casing.

15. The positive displacement compressor of claim 14, further comprising at least one outlet valve in fluid communication with the compression chamber to allow for the expulsion of liquids and gas.

16. The positive displacement compressor of claim 10, wherein the at least one liquid injector comprises a nozzle configured to provide an atomized liquid spray.

17. The positive displacement compressor of claim 10, wherein the at least one liquid injector is positioned to inject liquid into an area within the rotor casing volume where compression occurs during operation of the compressor.

18. The positive displacement compressor of claim 10, wherein the compressor is configured to be oriented such that the rotor rotates about a horizontal axis during operation of the compressor.

19. The positive displacement compressor of claim 10, wherein the rotor has at least one lightening feature in the cylinder to aid in balancing the rotor.

* * * * *